US010407757B2

(12) United States Patent
Schuh et al.

(10) Patent No.: US 10,407,757 B2
(45) Date of Patent: Sep. 10, 2019

(54) SINTERED NANOCRYSTALLINE ALLOYS

(71) Applicant: Massachusetts Institute of Technology, Cambridge, MA (US)

(72) Inventors: Christopher A. Schuh, Wayland, MA (US); Mansoo Park, Boston, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 794 days.

(21) Appl. No.: 14/214,282

(22) Filed: Mar. 14, 2014

(65) Prior Publication Data

US 2014/0271325 A1 Sep. 18, 2014

Related U.S. Application Data

(60) Provisional application No. 61/784,743, filed on Mar. 14, 2013.

(51) Int. Cl.
*C22C 27/04* (2006.01)
*B22F 3/10* (2006.01)
(Continued)

(52) U.S. Cl.
CPC ..... *C22C 27/04* (2013.01); *B22F 1/0044* (2013.01); *B22F 3/10* (2013.01); *C22C 1/045* (2013.01);
(Continued)

(58) Field of Classification Search
CPC .. B22F 3/00; B22F 3/10; B22F 3/1017; B22F 2998/10; B22F 1/00; B22F 1/0044;
(Continued)

(56) References Cited

U.S. PATENT DOCUMENTS 3,479,161 A * 11/1969 Evans ..... C22C 1/045 420/432
4,909,840 A * 3/1990 Schlump ..... B22F 1/0003 419/12
(Continued)

FOREIGN PATENT DOCUMENTS

CN 1070431 A 3/1993
CN 1498287 A 5/2004
(Continued)

OTHER PUBLICATIONS

"Alloy and Temper Designation Systems for Aluminum and Aluminum Alloys" R.B.C. Cayless, Alcan Rolled Products Company. ASM Handbook, vol. 2: Properties and Selection: Nonferrous Alloys and Special Purpose Materials ASM Handbook Committee, p. 15-28. DOI: 10.1361/asnnhba0001058 (Year: 1990).*
(Continued)

*Primary Examiner* — Alexandra M Moore
(74) *Attorney, Agent, or Firm* — Wolf, Greenfield & Sacks, P.C.

(57) ABSTRACT

Provided in one embodiment is a method, comprising: sintering a plurality of nanocrystalline particulates to form a nanocrystalline alloy, wherein at least some of the nanocrystalline particulates may include a non-equilibrium phase comprising a first metal material and a second metal material, and the first metal material may be soluble in the second metal material. The sintered nanocrystalline alloy may comprise a bulk nanocrystalline alloy.

31 Claims, 50 Drawing Sheets

(51) Int. Cl.
*C22C 27/06* (2006.01)
*B22F 1/00* (2006.01)
*C22C 1/04* (2006.01)

(52) U.S. Cl.
CPC ..... *C22C 27/06* (2013.01); *B22F 3/1035* (2013.01); *B22F 2998/10* (2013.01); *C22C 2200/04* (2013.01)

(58) Field of Classification Search
CPC .. C22C 1/00; C22C 1/04; C22C 1/045; C22C 1/05; C22C 1/058; C22C 1/1084; C22C 19/00; C22C 33/00; C22C 33/02; C22C 27/00; C22C 27/04; C22C 27/06; C22C 38/00; C22C 38/12; C22C 2200/04; C22C 45/006; C22C 45/10; C22C 28/00; C22C 38/14; C22C 38/18; C22C 38/22; C22C 38/40; C22C 38/44; C22C 38/50
See application file for complete search history.

(56) References Cited

U.S. PATENT DOCUMENTS

| | | | | |
|---|---|---|---|---|
| 4,944,800 | A | 7/1990 | Kolaska et al. | |
| 5,024,813 | A | 6/1991 | Nishiyama | |
| 5,207,821 | A | 5/1993 | Ikenoue et al. | |
| 5,425,822 | A * | 6/1995 | Hidaka | C22C 27/06 148/407 |
| 5,984,996 | A * | 11/1999 | Gonsalves | B22F 1/0018 501/87 |
| 6,010,580 | A * | 1/2000 | Dandliker | F42B 12/06 102/517 |
| 6,171,410 | B1 * | 1/2001 | Kojima | B82Y 25/00 148/100 |
| 6,277,326 | B1 * | 8/2001 | Vecchio | C22C 1/045 419/39 |
| 6,489,043 | B1 | 12/2002 | Deevi et al. | |
| 7,004,853 | B2 * | 2/2006 | Deshmukh | A63B 53/04 473/332 |
| 7,416,697 | B2 | 8/2008 | Woodfield et al. | |
| 7,708,974 | B2 * | 5/2010 | Yadav | B82Y 30/00 250/462.1 |
| 8,257,512 | B1 | 9/2012 | Branagan et al. | |
| 2003/0183306 | A1 | 10/2003 | Hehmann et al. | |
| 2004/0045402 | A1 | 3/2004 | Boily et al. | |
| 2004/0253136 | A1 | 12/2004 | Shamblen et al. | |
| 2005/0084407 | A1 * | 4/2005 | Myrick | B22F 1/0003 419/66 |
| 2006/0153728 | A1 * | 7/2006 | Schoenung | B22F 9/04 419/32 |
| 2007/0293348 | A1 * | 12/2007 | Hocknell | A63B 53/0466 473/342 |
| 2008/0223175 | A1 | 9/2008 | Lunk et al. | |
| 2010/0189910 | A1 | 7/2010 | Belashchenko | |
| 2016/0155566 | A1 | 6/2016 | Yoon et al. | |
| 2016/0223307 | A1 | 8/2016 | Bray et al. | |
| 2017/0080498 | A1 | 3/2017 | Burrow | |
| 2017/0234663 | A1 | 8/2017 | Schuh et al. | |
| 2017/0297112 | A9 | 10/2017 | Burrow | |

FOREIGN PATENT DOCUMENTS

| | | | |
|---|---|---|---|
| CN | 101223108 | A | 7/2008 |
| CN | 101423912 | A | 5/2009 |
| CN | 104419846 | A | 3/2015 |
| CN | 102888530 | B | 12/2015 |
| CN | 105238954 | A | 1/2016 |
| JP | 05-222481 | A | 8/1993 |
| JP | 09-157048 | A | 6/1997 |
| JP | 2012-192016 | A | 10/2012 |
| WO | WO 2007/086830 | A2 | 8/2007 |
| WO | WO 2011/091449 | A1 | 7/2011 |
| WO | WO 2014/152838 | A1 | 9/2014 |
| WO | WO 2018/125314 | A2 | 7/2018 |

OTHER PUBLICATIONS

Sinter and Hot Pressing Definitions from ISO 3252 (1999)(en) Powder Metallurgy Vocabulary (Year: 1999).*
"Activated Sintering of Tungsten with Small Additions of Nickel". Theory and Technology of Sintering, Thermal, and Chemicothermal Treatment Processes. Institute of Materials Science, Academy of Sciences of the UkrSSR. Translated from Poroshkovaya Metallurgiya, No. 2 (50), pp. 1-5. Feb. 1967. (Year: 1967).*
Han et al. "The effects of ball-milling treatment on the densification behavior of ultra-fine tungsten powder". Int. Journal of Refractory Metals and Hard Materials 29 (2011) 743-750. doi:10.1016/j.ijrmhm.2011.06.010 (Year: 2011).*
Kornilov I,I. "Solubility of the Elements in Chromium". Bulletin of the Academy of Sciences of the USSR, Division of chemical science. Nov. 1953, vol. 2, Issue 6, pp. 871-877. https://doi.org/10.1007/BF01167529 (Year: 1953).*
International Search Report and Written Opinion for Application No. PCT/US2014/027932 dated Jul. 29, 2014.
International Preliminary Report on Patentability for Application No. PCT/US2014/027932 dated Sep. 24, 2015.
Beth, Concrete Penetration. Division 2, National Defense Research Committee of the Office of Scientific Research and Development. Wright-Patterson Air Force Base—Dayton, Ohio. 1946. 65 pages.
Cho et al., Nanocrystalline and Ultra-Fine Grained Tungsten for Kinetic Energy Penetrator and Warhead Liner Applications. Army Research Laboratory. ARL-RP-180. Jun. 2007. 14 pages.
Cordero et al., Powder-Route Synthesis and Mechanical Testing of Ultrafine Grain Tungsten Alloys. Metallurgical and Materials Transactions A. Jul. 2014. 45A: 3609-3618. DOI: 10.1007/s11661-014-2286-1.
Ehlers et al. Small-Caliber Projectile Target Impact Angle Determined from Close Proximity Radiographs. Army Research Laboratory. DTIC Document. Oct. 2006. 51 pages.
Forrestal et al., A spherical cavity-expansion penetration model for concrete targets. International Journal of Solids and Structures. Nov. 1997. 34(31-32): 4127-46. doi:10.1016/S0020-7683(97)00017-6.
Forrestal et al., An empirical equation for penetration depth of ogive-nose projectiles into concrete targets. International Journal of Impact Engineering. Aug. 1994. 15(4): 395-405. doi:10.1016/0734-743X(94)80024-4.
Forrestal et al., Dynamic Spherical Cavity-Expansion in a Compressible Elastic-Plastic Solid. J. Appl Mech. Jun. 1, 1988. 55(2): 275-9. doi:10.1115/1.3173672.
Forrestal et al., Penetration into soil targets. International Journal of Impact Engineering. 1992. 1293: 427-44. doi:10.1016/0734-743X(92)90167-R.
Forrestal et al., Penetration of 6061-T651 Aluminum Targets With Rigid Long Rods. J Appl Mech. Dec. 1, 1988. 55(4): 755-60. doi:10.1115/1.3173718.
Forrestal et al., Penetration of concrete targets with deceleration-time measurements. International Journal of Impact Engineering. May 2003. 28(5): 479-97.
Forrestal et al., Penetration of grout and concrete targets with ogive-nose steel projectiles. International Journal of Impact Engineering. Jul. 1996. 18(5): 465-76. doi:10.1016/0734-743X(95)00048-F.
Forrestal et al., Penetration of reinforced concrete with ogive-nose penetrators. International Journal of Solids and Structures. 1988. 24(1):77-87.
Forrestal, Penetration into dry porous rock. International Journal of Solids and Structures. 1986. 22(12): 1485-1500. doi:10.1016/0020-7683(86)90057-0.
Frew et al., Penetration of concrete targets with ogive-nose steel rods. International Journal of Impact Engineering. Jun. 1, 1998. 21(6): 489-97. doi:10.1016/S0734-743X(98)00008-6.
Frew et al., The effect of concrete target diameter on projectile deceleration and penetration depth. International Journal of Impact Engineering. Oct. 2006. 32(10): 1584-1594. doi:10.1016/j.ijimpeng.2005.01.012.
German et al, Enhanced Low-Temperature Sintering of Tungsten. Metallurgical Transactions A. Dec. 1976. 7(12):1873-7. DOI: 10.1007/BF02659818.

(56) References Cited

OTHER PUBLICATIONS

German et al. The Effect of Nickel and Palladium Additions on Activated Sintering of Tungsten. Int J Powder Metall. 1976. 12: 115.
German et al., Systematic Trends in Chemically Activated Sintering of Tungsten. High Temp Sci. 1976. 8:267.
Kecskes et al., Grain size engineering of bcc refractory metals: Top-down and bottom-up—Application to tungsten. Mater Sci Eng A. Oct. 15, 2007. 467(1-2): 33-43. doi:10.1016/j.msea.2007.02.099.
Knowles, Dielectric Constant of Ethyl Alcohol Vapor and Possible Effect of Conductivity. The Journal of Physical Chemistry. 1931. 36(10): 2554-66. doi: 10.1021/j150340a003.
Leferink et al., Chromium Diffusion Coatings on Low-Alloyed Steels for Corrosion Protection Under Sulphidizing Conditions. VGB Kraftwerkstechnik 1993. 73(3): 1-14.
Luk et al., Penetration into semi-infinite reinforced-concrete targets with spherical and ogival nose projectiles. Intl J Impact Eng. 1987. 6(4): 291-301. doi:10.1016/0734-743X(87)90096-0.
Park et al., Accelerated sintering in phase-separating nanostructured alloys. Nature Communications, 6:6858 (2015) DOI: 10.1038/ncomms7858.
Park et al., Diffusion of tungsten in chromium: Experiments and atomistic modeling. J Alloy Compd. Available online May 27, 2014. 611: 433-9. doi:10.1016/j.jallcom.2014.05.085.
Silling et al., Mass loss from abrasion on ogive-nose steel projectiles that penetrate concrete targets. International Journal of Impact Engineering. Nov. 2007. 34(11): 1814-20. doi:10.1016/j.ijimpeng.2006.10.008.
Vacek et al., Uber die Beeinflussung des Sinterverhaltens von Wolfram. Methods of Influencing the Sintering Behavior of Tungsten. Planseeber. Pulvermet. 1959. bd 7, 6.
Warren et al., Evaluation of Large Amplitude Deceleration Data from Projectile Penetration into Concrete Targets. Experimental Mechanics. Feb. 2014. 54(2):241-53. E Pub Jul. 17, 2013. DOI: 10.1007/s11340-013-9767-9.
Wei et al., Dynamic behaviors of body-centered cubic metals with ultrafine grained and nanocrystalline microstructures. Mater Sci Eng A. Oct. 15, 2008. 493(1-2): 58-64. doi:10.1016/j.msea.2007.05.126.
Wei et al., Effect of low-temperature rolling on the tensile behavior of commercially pure tungsten. Mater Sci Eng A. Sep. 15, 2008. 491 (1-2): 62-9. doi:10.1016/j.msea.2008.01.013.
Wei et al., Microstructure and mechanical properties at different length scales and strain rates of nanocrystalline tantalum produced by high-pressure torsion. Acta Materialia. Apr. 2011. 59(6): 2423-36. doi:10.1016/j.actamat.2010.12.042.
Wei et al., Microstructure and mechanical properties of super-strong nanocrystalline tungsten processed by high-pressure torsion. Acta Materialia. Sep. 2006. 54 (15): 4079-89.
Wei et al., Nanoengineering opens a new era for tungsten as well. The Journal of The Minerals, Metals & Materials Society (TMS). Sep. 2006. 58(9):40-4. DOI10.1007/s11837-006-0081-1.
Amato, "On the mechanism of activated sintering of tungsten powders", Materials Science and Engineering, 10, 15-22 (1972).
Ames, et al. "Unraveling the nature of room temperature grain growth in nanocrystalline materials", ACTA Materialia, vol. 56, 4255-4266 (2008).
Bose, et al. "Microstructural Refinement of W—Ni—Fe Heavy Alloys by Alloying Additions", Metallurgical Transactions A, vol. 19A, pp. 3100-3103 (Dec. 1988).
Bui, et al. "On the strengthening behavior of ultrafine-grained nickel processed from nanopowders", Materials Science and Engineering A, vol. 527, 3227-3235 (2010).
Chen, et al. "Sintering dense nanocrystalline ceramics without final-stage grain growth", Nature, vol. 404, 168-171 (Mar. 9, 2000).
Chookajorn, et al. "Design of Stable Nanocrystalline Alloys", Science 337, 951-954 (Aug. 23, 2012).
Gente, et al. "Formation of Thermodynamically Unstable Solid-Solutions in the Cu—Co System by Mechanical Alloying", Physical Review B, Vo. 48, No. 18, 13244-13252 (1993).
German, "Microstructure of the Gravitationally Settled Region in a Liquid-Phase Sintered Dilute Tungsten Heavy Alloy", Metallurgical and Materials Transactions A, vol. 26A, 279-288 (Feb. 1995).
German, RM. "Liquid phase sintering", (Plenum Press, New York, 1985—TOC).
Gleiter, "Nanocrystalline Materials", Progress in Materials Science, vol. 33, 223-315 (1989).
Gupta, et al. "Thin intergranular films and solid-state activated sintering in nickel-doped tungsten", ACTA Materialia, Vo. 55, pp. 3131-3142 (2007).
Hague, et al. "Modeling densification during sinter-forging of yttria-partially-stabilized zirconia", Materials Science and Engineering A204, 83-89 (1995).
Hausner, H, Metal Powder Industries Federation. Modern developments in powder metallurgy; proceedings, vol. 1 (Plenum Press, New York,, 1966).
Johnson, et al. "Solid-state contributions to densification during liquid-phase sintering", Metallurgical and Materials Transactions B, vol. 27B, 901-909 (Dec. 1996).
Kang, et al. "Densification and Shrinkage during Liquid-Phase Sintering", Journal American Ceramic Society, vol. 74, No. 2, pp. 425-427 (1991).
Kirchheim, "Grain coarsening inhibited by solute segregation", ACTA Materialia, vol. 50, 413-419 (2002).
Kleinlogel, et al. "Sintering of nanocrystalline $C_eO_2$ ceramics", Advanced Materials, vol. 13, No. 14, 1081-1085 (2001).
Kothari, "Densification and Grain Growth during Liquid-Phase Sintering of Tungsten-Nickel-Copper Alloys", Journal of the Less-Common Metals, vol. 13, 457-468 (1967).
Kuczynski, et al. "Segregation in Homogeneous Alloys during Sintering", ACTA Metallurgica, vol. 8, 209-215 (1960).
Kumar, et al. "Densification of Nanostructured Titania Assisted by a Phase-Transformation", Nature, vol. 358, 48-51 (Jul. 2, 1992).
Lee, et al. "Microstructural Evolution and Mechanical Properties under High Strain Rate Testing of W—3.99Ni—1.71Fe Sintered by a Two-Stage Sintering Process", Materials Transactions, vol. 53, No. 7, 1318-1323 (2012).
Lee, et al. "Theoretical analysis of liquid-phase sintering: Pore filling theory", Acta Mater. vol. 46, No. 9, 3191-3202 (1998).
Li, et al. "The Properties of Tungsten Processed by Chemically Activated Sintering", Metallurgical Transactions A, vol. 14A, 2031-2041 (Oct. 1983).
Lian, et al. "On the Enhanced Grain-Growth in Ultrafine Grained Metals", Acta Metall Mater vol. 43, No. 11, pp. 4165-4170 (1995).
Liao, et al. "Theory of high pressure low temperature sintering of bulk nanocrystalline $TiO_2$", Acta Mater, vol. 45, No. 10, 4027-4040 (1997).
Luo, et al. "Grain boundary disordering in binary alloys", Applied Physics Letters, vol. 92, pp. 101901-1 to 101901-3, 2008.
Luo, et al. "Segregation-induced grain boundary premelting in nickel-doped tungsten", Applied Physics Letters, vol. 87,(2005), pp. 231902-1 to 231902-3.
Luo, et al. "The Role of a Bilayer Interfacial Phase on Liquid Metal Embrittlement", Science, vol. 333, 1730-1733 (2011).
Mishra, et al. "High-pressure sintering of nanocrystalline $\gamma$- $Al_2O_3$", J. Am. Ceram. Soc., vol. 79, No. 11, 2989-2992 (1996).
Monma, et al. "Diffussion of Ni63 and Cr51 in nickelchromium alloys", Nihon Kinzoku Gakkai, 28, 188-192 (1964).
Mundy, et al. "Self-Diffusion in Chromium", Physical Review B, vol. 24, No. 2, 658-665 (Jul. 15, 1981).
Mundy, et al. "Self-Diffusion in Tungsten", Physical Review B, vol. 18, No. 12, 6566-6575 (Dec. 15, 1978).
Murdoch, et al. "Stability of binary nanocrystalline alloys against grain growth and phase separation", Acta Materialia, vol. 61, 2121-2132 (2013).
Orru, et al. "Consolidation/synthesis of materials by electric current activated/assisted sintering", Materials Science and Engineering R, 2009, vol. 63, pp. 127-287.
Park, et al. "Grain growth behavior of tungsten heavy alloys based on the master sintering curve concept", Metallurgical and Materials Transactions A, vol. 37A, 3337-3346 (Nov. 2006).

(56) References Cited

OTHER PUBLICATIONS

Park, et al. "Microstructural Change during Liquid-Phase Sintering of W—Ni—Fe Alloy", Metallurgical Transactions A, vol. 20A, 837-845 (May 1989).
Sirinivasarao, et al. "Bimodally grained high-strength Fe fabricated by mechanical alloying and spark plasma sintering", Acta Materialia, vol. 57, 3277-3286 (2009).
Su, et al. "Master sintering curve: A practical approach to sintering", Journal American Ceramic Society, vol. 79, No. 12, 3211-3217 (1996).
Turchi, et al. "Modeling of Ni—Cr—Mo based alloys: Part I—phase stability", Computer Coupling of Phase Diagrams and Thermochemistry, vol. 30, 70-87 (2006).
Uenishi, et al. "Formation of a Super-Saturated Solid-Solution in the Ag—Cu System by Mechanical Alloying", Materials Science and Engineering, A 134, 1342-1345 (1991).
Weissmuller, "Alloy Effects in Nanostructures", NanoStructured Materials, vol. 3, pp. 261-272 (1993).
Yavari, et al. "Mechanically Driven Alloying of Immiscible Elements", Physical Review Letters, Vo. 68, No. 14, 2235-2238 (1992).
Yih, Wang CT. Tungsten : sources, metallurgy, properties, and applications (Plenum Press, New York, 1979).
Yoon, et al. "Grain-Growth and Densification during Liquid-Phase Sintering of W—Ni" Acta Metallurgica, vol. 27, pp. 693-698 (1979).
Zhan, et al. "Single-wall carbon nanotubes as attractive toughening agents in alumina-based nanocomposites", Nature Materials, vol. 2, 38-42 (2003).
Zhang et al. "Microstructure characteristic, mechanical properties and sintering mechanism of nanocrystalline copper obtained by SPS process", Materials Science and Engineering A, vol. 523, 134-138 (2009).
Zhang, et al. "Fabrication of,bulk nanocrystalline Fe—C alloy by spark plasma sintering of mechanically milled powder", Scripta Materialia, vol. 53, 863-868 (2005).
Extended European Search Report for Application No. EP 14768344.5 dated Nov. 9, 2016.
Da Costa, Sinter densification of nanocrystalline composite W—Cu powder. International Journal of Powder Metallurgy. Jul. 31, 2005; 41(4): 51-57.
Telu et al. Densification and characterisation of W—Cr—Nb alloys prepared by sintering of mechanically alloyed nanocrystalline powders. Powder Metallurgy Feb. 28, 2013; 56(1): 83-88.
Yan et al., Fabrication of nano-crystalline W—Ni—Fe pre-alloyed powders by mechanical alloying technique. Trans. Nonferrous Met Soc China Dec. 1, 2009; 19:s711-s717.
Chinese Office Action, and English translation thereof, dated Aug. 10, 2017 for Application No. 201480014408.2.
Chinese Office Action dated May 4, 2018 for Application No. 201480014408.2.
Japanese Office Action, with English translation thereof, dated Mar. 30, 2018 for Application No. JP 2016-502666.
Amram et al., Interplay between thermodynamic and kinetic stabilization mechanisms in nanocrystalline Fe—Mg alloys. Acta Mater. 2018;144:447-58. Epub Nov. 7, 2017.
Chookajorn et al., Duplex nanocrystalline alloys: Entropic nanostructure stabilization and a case study on W—Cr. J Mater Res. Jan. 28, 2015;30(2):151-63.
Clark et al., Thermal stability comparison of nanocrystalline Fe-based binary alloy pairs. JOM. Jun. 2016;68(6):1625-33. Epub Mar. 24, 2016.
Cordero et al., Sub-scale ballistic testing of an ultrafine grained tungsten alloy into concrete targets. Int J Impact Eng. 2016;91:1-5. Epub Dec. 18, 2015.
Darling et al., Mitigating grain growth in binary nanocrystalline alloys through solute selection based on thermodynamic stability maps. Comput Mater Sci. Mar. 2014; 84:255-66. Epub Dec. 31, 2013.
Darling et al., Extreme creep resistance in a microstructurally stable nanocrystalline alloy. Nature. Sep. 15, 2016;537:378-81. Suppl Info 10 pages. doi: 10/1038/nature19313.
Huang et al., Exploring the concurrence of phase transition and grain growth in nanostructured alloy. Acta Mater. Oct. 1, 2016;118:306-16. Epub Aug. 5, 2016.
Huskins et al., Micropillar compression testing of powders. J Mater Sci. 2015;50(21):7058-63. Epub Jul. 21, 2015.
Kalidindi et al., Nanocrystalline materials at equilibrium: A thermodynamic review. JOM. Dec. 2015;67(12):2834-43. Epub Sep. 23, 2015.
Khalajhedayati et al., High-temperature stability and grain boundary complexion formation in a nanocrystalline Cu—Zr alloy. JOM. Dec. 2015;67(12):2788-801. Epub Sep. 23, 2015.
Moelle et al., Thermal stability of nanocrystalline iron prepared by mechanical attrition. NanoStructured Mater. 1995;6:421-24.
Natter et al., Nanocrystalline nickel and nickel-copper alloys: Synthesis, characterization, and thermal stability. J Mater Res. May 1998;13(5):1186-97.
Nieman et al., Tensile strength and creep properties of nanocrystalline palladium. Scripta Metall et Mater. Jan. 1990;24(1):145-50.
Oda et al., Microstructure and sinterability of nano-crystal tungsten powders. J Japan Inst Met. , The Japan Institute of Metals and Materials. Nov. 2005;679(11):967-72. doi:10/2320/jinstmet.69.697.
Ogawa, Mechanical properties of hot compacting high nitrogen nanocrystalline austenite stainless steel powders mechanically alloyed. Study 52, Collection of papers of lectures by the Iron and Steel Inst of Japan, Materials and Processes, Current Advances in Materials and Processes, Japan, The Iron and Steel Institute of Japan, CAMP-ISIJ, 2005;18:1342-4. ISSN:0914-6628. 7 pages.
Paiste, Deforming and compacting chromium-tungsten powders to create stronger metals. MIT News, Phys Org. Dec. 3, 2014. Retrieved Aug. 10, 2015 from http://phys.org/news/2014-12-deforming-compacting-chromium-tungsten-powders-stronger.html. 4 pages.
Paiste, Alloying tougher tungsten. MIT MPC Webpage. Updated Dec. 1, 2014. https://mpc-www.mit/edu/component/k2/item/469-alloying-tougher-tungsten, accessed on the internet Aug. 10, 2015. 5 pages.
Paiste, Tougher tungsten to replace uranium in armor-piercing projectiles. PDD Webpage. Dec. 4, 2014. https://www.pddnet.com/news/2014/12/tougher-tungsten-replace-uranium-armor-piercing-projectiles, accessed on the internet Aug. 10, 2015. 11 pages.
Park, Design of Bulk Nanocrystalline Tungsten Alloys via Nano-Phase Separation Sintering. PhD Thesis, Massachusetts Institute of Technology. Department of Materials Science and Engineering. Submitted Feb. 2015 Believed to have been published Aug. 2015 112 pages.
Robertson et al., Review of densification of titanium based powder systems in press and sinter processing. Powder Metall. 2010;53(2):146-62.
Schuh et al., Powder processing of amorphous tungsten-bearing alloys and composites. Defense Threat Reduction Agency, DTRA-TR-14-73, Technical Report. Mar. 2015. HDTRA1-11-1-0062. 25 pages.
Schuster et al., Nanocrystalline refractory metals for extreme condition applications. JOM. Dec. 2011;63(12):27-31.
Xu et al., Microstructures and stabilization mechanisms of nanocrystalline iron-chromium alloys with hafnium addition. Metall Mater Trans A. Sep. 2015;46A:4394-404. Epub Jun. 2, 2015.
Japanese Office Action, and English translation thereof, dated Mar. 8, 2019 for counterpart Application No. JP 2016-502666.
Chinese Office Action dated Jan. 30, 2019 for Application No. CN 201480014408.2.
Examination Report for Application No. EP 14768344.5 dated Apr. 15, 2019.

* cited by examiner

SINTERED NANOCRYSTALLINE ALLOYS

RELATED APPLICATION

This application claims priority to U.S. Provisional Application Ser. No. 61/784,743, filed Mar. 14, 2013, which is hereby incorporated by reference in its entirety.

STATEMENT REGARDING FEDERALLY SPONSORED RESEARCH

This invention was made with Government support under Grant No. HDTRA1-11-1-0062 awarded by the Defense Threat Reduction Agency (DTRA), and Grant No. W911NF-09-1-0422 awarded by the Army Research Office (ARO). The Government has certain rights in the invention.

BACKGROUND

Nanocrystalline materials may be susceptible to grain growth. The susceptibility may make it difficult to produce bulk nanocrystalline materials with high relative densities and small grain sizes utilizing pre-existing sintering techniques. Additionally, the susceptibility may limit the ability of sintered nanocrystalline materials to be subjected to post-sintering processing techniques without experiencing undesired grain growth.

SUMMARY

In view of the foregoing, the present Inventors have recognized and appreciated the advantages of a nanocrystalline alloy with controlled grain size. A nanocrystalline alloy with controlled grain size may be produced by sintering a plurality of nanocrystalline particulates.

Accordingly, provided in one embodiment herein is a method, comprising: sintering a plurality of nanocrystalline particulates to form a nanocrystalline alloy. At least some of the nanocrystalline particulates may include a non-equilibrium phase comprising a first metal material and a second metal material. The first metal material may be soluble in the second metal material.

In another embodiment, a method is provided that includes sintering a plurality of nanocrystalline particulates to form a nanocrystalline alloy. At least some of the nanocrystalline particulates may include a non-equilibrium phase comprising a first metal material and a second metal material. The sintering may involve a first sintering temperature, and the first sintering temperature may be lower than a second sintering temperature needed for sintering the first metal material in the absence of the second metal material.

In another embodiment, a sintered nanocrystalline alloy that includes at least one of tungsten and chromium is provided, wherein the nanocrystalline alloy has a relative density of at least about 90%. In one embodiment, this sintered nanocrystalline alloy includes tungsten. In another embodiment, this sintered nanocrystalline alloy includes both tungsten and chromium.

Accordingly, provided in one embodiment is a method, comprising: sintering a plurality of nanocrystalline particulates to form a nanocrystalline alloy. At least some of the nanocrystalline particulates may include a non-equilibrium phase comprising a first metal material and a second metal material. The first metal material may be soluble in the second metal material. The nanocrystalline alloy has a relative density of at least about 90%.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

DETAILED DESCRIPTION

Following below are more detailed descriptions of various concepts related to, and embodiments of, inventive sintering methods and sintered nanocrystalline alloys. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Introduction

Figure 1A:
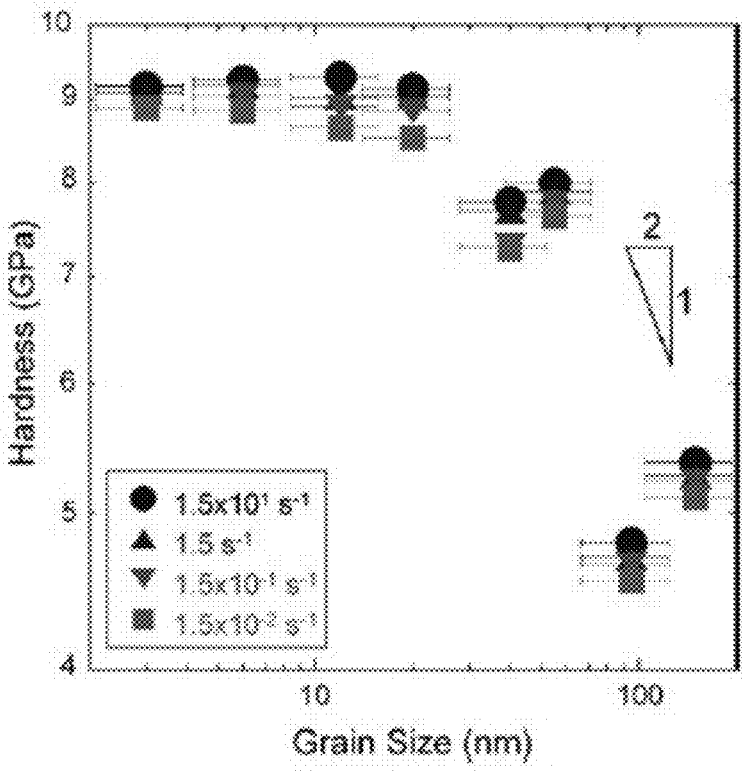
FIGS. 1(*a*)-1(*b*) depict, respectively, the hardness of nanocrystalline Ni—W alloys as a function of grain size in one embodiment and of the activation volume for deformation of the nanocrystalline Ni—W alloys in one embodiment.
Figure 1B:
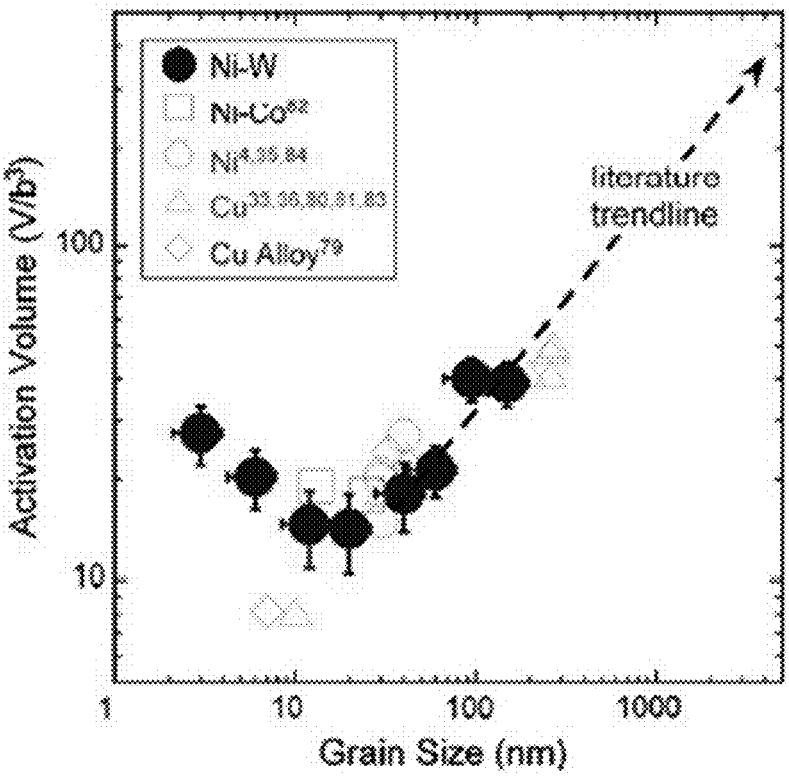

Desirable properties, such as high strength and increased resistance, have spurred considerable research in nanocrystalline metals with an average grain size generally smaller than 100 nm. These properties may arise from a high number of grain boundaries and may vary greatly even with small variations in grain size. FIGS. 1(*a*) and 1(*b*) present mechanical test data on nanocrystalline Ni—W alloys. A grain size change from 10 to 100 nm may produce a hardness decrease of about 50% and an increase of more than four times in activation volume (rate sensitivity may be denoted as the inverse of the activation volume). Therefore, controlling grain size may be important to tailor the material properties of nanocrystalline metals.

Figure 2:
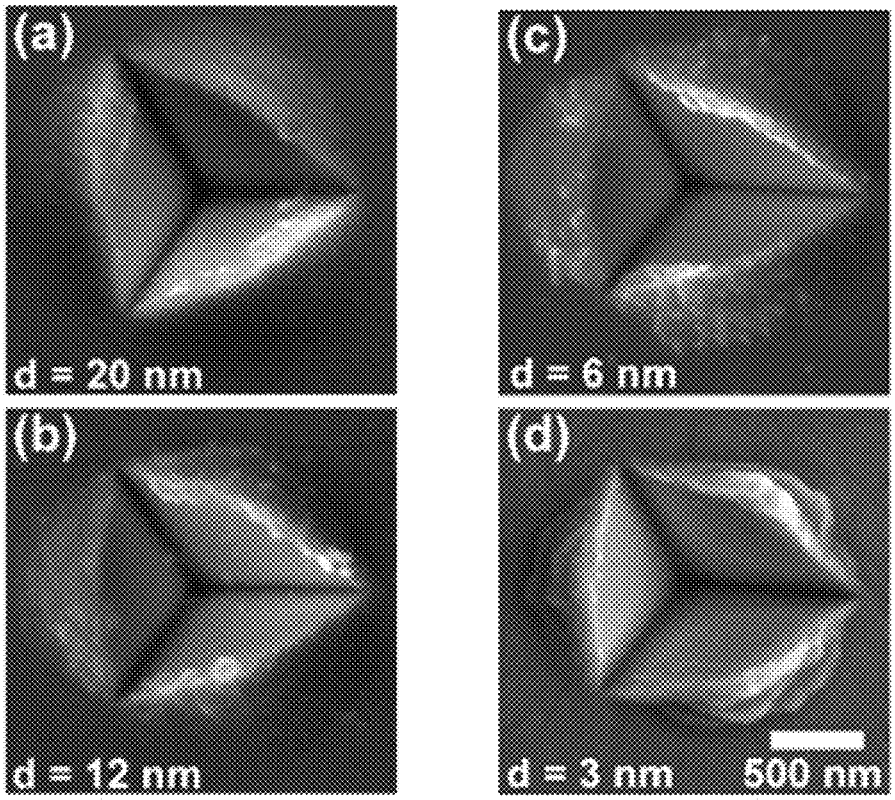
FIGS. 2(*a*)-2(*d*) depict SEM images of Ni—W alloy specimens in one embodiment.

Additionally, specific grain size (or size range) may correspond to the desired mechanical properties. As shown in FIG. 1(*a*), hardness may peak at a grain size of about 10 nm, and then decrease with further grain refinement. The activation volume may also decrease and then increase as grain size becomes smaller, as shown in FIG. 1(*b*). A shear band may become noticeable in a Ni—W alloy with a grain size below 12 nm, as shown in FIGS. 2(*a*)-2(*d*). As a result, a finite grain size may exist which results in a desired value for a property. Thus, scalable control over grain size may be an important feature of manufacturing nanocrystalline metal materials with desired properties.

Nanocrystalline Materials

Nanocrystalline materials may generally refer to materials that comprise grains with a size in the nanometer range—i.e., smaller than about 1000 nm: e.g., smaller than or equal to about 900 nm, about 800 nm, about 700 nm, about 600 nm, about 500 nm, about 400 nm, about 300 nm, about 200 nm, about 150 nm, about 100 nm, about 50 nm, about 30 nm, about 20 nm, about 10 nm, about 5 nm, about 2 nm, or smaller. In some embodiments herein, to further distinguish the different grain size regimes, the term "ultra-fine grain" is used to denote a grain size of greater than about 100 nm and less than about 1000 nm and the term "nanocrystalline grain" is used to denote a grain size of less than or equal to about 100 nm. In one embodiment, the nanocrystalline material may be a polycrystalline material. In another embodiment the nanocrystalline material may be a single crystalline material.

In one embodiment, the grain size may refer to the largest dimension of a grain. The dimension may refer to the diameter, length, width, or height of a grain, depending on the geometry thereof. In one embodiment, the grains may be spherical, cubic, conical, cylindrical, needle-like, or any other suitable geometry.

In one embodiment, the nanocrystalline material may be in the form of particulates. The shape of the particulates may be spherical, cubical, conical, cylindrical, needle-like, irregular, or any other suitable geometry.

In one embodiment, the nanocrystalline material may be a nanocrystalline alloy that may comprise a first metal material and a second metal material. The first and/or second metal material may comprise a first and/or second metal element, respectively. The term "element" herein refers to the chemical symbol that may be found in the Periodic Table. The first metal material may be a metal element. A metal element may include any of the elements in Groups 3-14 of the Periodic Table. In one embodiment, the metal element may be a refractory metal element. In another embodiment, the metal element is a transition metal (any of those in Groups 3-12 of the periodic table). While tungsten is employed to provide the description of several embodiments below, any suitable first metal material may be utilized in the place of tungsten. According to another embodiment, the first metal material may comprise chromium. In another embodiment, the first metal material may comprise at least one of tungsten and chromium.

In one embodiment, the second metal material element may comprise, or be, an activator material, relative to the first metal material. In another embodiment, the second metal material may comprise, or be, a stabilizer material, relative to the first metal material. In one embodiment, the second metal material may comprise a metal element that is the same as, or different from, the first metal material. For example, the metal element of the second metal material may be a transition metal. In one embodiment, the second metal material may comprise Cr, Ti, or both. According to another embodiment, the second metal material may comprise Ni.

The nanocrystalline material may have any value of relative density, depending on the material. Relative density may refer to the ratio between the experimentally measured density of the nanocrystalline material and the theoretical density of the nanocrystalline material.

In one embodiment, the nanocrystalline material may be a bulk nanocrystalline alloy. A bulk nanocrystalline alloy may be a material that is not in the form of a thin film. For example, a bulk nanocrystalline alloy in one embodiment may refer to a material with a smallest dimension of at least about 1 micron—e.g., at least about 10 microns, about 25 microns, about 50 microns, about 75 microns, about 100 microns, about 250 microns, about 500 microns, about 1 mm, about 5 mm, about 10 mm, or larger. In another embodiment, the nanocrystalline alloy is not in the form of a coating.

Stabilization of Nanocrystalline Structure

Figure 3A:
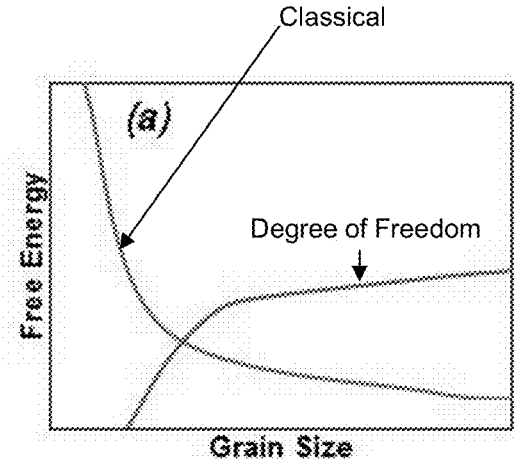
FIGS. 3(*a*)-3(*b*) depict, respectively, the classical free energy curve and the degree of freedom arising from solute segregation in one embodiment and the general form of grain boundary energy in alloys as a function of grain size in one embodiment.
Figure 3B:
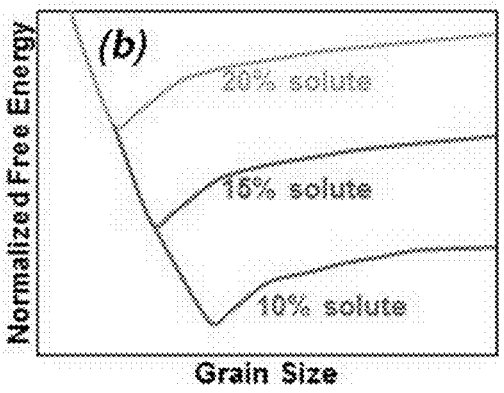

A nanocrystalline microstructure with a high surface-to-volume ratio may have a large number of interfacial regions or grain boundaries, which may make it unstable. In one embodiment, instability may indicate a high amount of excess energy in the system, and significant grain growth may be observed in pure nanostructured materials even at room temperature. Not to be bound by any particular theory, but this phenomenon may be understood from a thermodynamic viewpoint. The Gibbs free energy. G, is proportional to the grain boundary energy, γ, multiplied by grain boundary area, A. Therefore, the decrease in grain boundary area that occurs as a result of grain growth may bring the system into a lower energy state. This phenomenon, in one embodiment, is illustrated in FIG. 3(*a*).

$$dG \propto dA \tag{1}$$

The high driving force for grain growth may limit further technological applications of pure nanostructured materials because even a small change in grain size over the service lifetime of the material may lead to a dramatic change in the material properties. Additionally, the propensity for grain growth may limit the amount of post-processing a nanostructured material may be subjected to, including consolidation and shape forming.

In one embodiment, two basic approaches may be used to stabilize nanocrystalline materials: a kinetic approach and a thermodynamic approach. The kinetic approach attempts to diminish grain boundary mobility to reduce grain growth. For example, grain boundary mobility may be limited by methods including second phase drag, solute drag, and chemical ordering. These strategies may postpone the time at which grain growth occurs. However, these methods may not reduce the driving force for grain growth. Thus, kinetically stabilized products may experience grain growth and may not provide constant performance throughout a service lifetime.

In contrast, the thermodynamic approach attempts to reduce the grain boundary energy by segregating solute atoms, thus reducing the driving force for grain growth. Not to be bound by any particular theory, but in alloy systems the grain boundary energy, γ, may be described in terms of the solute concentration, $c_s$, by the Gibbs adsorption equation:

$$\partial\gamma=-RT\Gamma_s\partial \ln c_s, \quad (2)$$

where T is temperature, R is the gas constant, and $\Gamma_s$ is the interfacial excess of the solute atoms. In the case of segregation, $\Gamma_s>0$, and thus γ will decrease with increasing solute concentration, $c_s$. A nanocrystalline alloy may be in a metastable state if γ is close to zero at a specific solute concentration. From Equation (2), the total grain boundary energy is given by:

$$\gamma=\gamma_0-\Gamma_s(\Delta H_{seg}+kT \ln X), \quad (3)$$

where $\gamma_0$ is the specific grain boundary energy of the pure element, $\Delta H_{seg}$ is the segregation enthalpy of solute atoms, k is the Boltzmann constant, and X is the solute concentration in the grain boundary. Stabilization of nanocrystalline material grain size by solute segregation may be conducted for Ni—P alloys, Y—Fe alloys, Nb—Cu alloys, Pd—Zr alloys, and Fe—Zr alloys, among many others.

The new degree of freedom to Gibbs free energy produced by solute segregation is plotted in FIG. 3(*a*), showing a countertrend to classical grain boundary energy. The classical grain boundary energy modified by the solute segregation effect is depicted in FIG. 3(*b*). In one embodiment, this curve is different from the classical grain boundary energy curve, because it does not simply decrease but rather exhibits a minimum at a specific grain size. Thus, stabilized nanostructured materials with fine grain size may be produced by reducing the driving force for grain growth with solute segregation.

Nanocrystalline Tungsten

In one embodiment, nanocrystalline body-centered cubic metals may be desirable because these metals exhibit desirable properties, including localized shearing under high rate loading. The formation of shear bands under high rate loading may be beneficial for a material utilized in a kinetic energy penetrator device because it may allow more energy to be conveyed to the object to be penetrated by reducing the energy that is dissipated as a result of plastic deformation of the penetrator. In one embodiment, tungsten may be desirable as a prospective replacement for depleted uranium in kinetic energy penetrator applications because of its high density and strength. In addition, unlike tungsten with larger grain sizes, nanocrystalline tungsten may exhibit shear bands under high rate loading.

Two methodologies may be employed to manufacture nanocrystalline materials: bottom-up and top-down. The top-down strategy may refine a bulk coarse grain material into the nanoscale regime. The bottom-up method may employ nanosize particles followed by consolidation at high temperature.

One exemplary top-down method for refining the grain size of tungsten is severe plastic deformation (SPD). There are at least two typical SPD techniques: equal-channel-angular-pressing (ECAP) and high-pressure torsion (HPT). An ECAP process may result in a tungsten grain size of a few microns by initiating dynamic recrystallization and grain growth as a result of the high processing temperature of around 1000° C. Therefore, a warm rolling process may follow an ECAP process to obtain a grain size in the ultra-fine grain regime. Another SPD processing method, HPT, applies high pressure and torsion to a disk of tungsten. The resulting plastic strain may yield a material with a grain size of about 100 nm. These SPD techniques may produce an ultra-fine grain size tungsten that may be perfectly plastic with no strain hardening, may exhibit a reduced strain rate sensitivity, and/or may exhibit localized shearing under high rate loading.

In some instances, problems may exist with the use of the SPD technique to produce ultra-fine grain size tungsten (or even finer grains). First, a large scale product is not produced through the SPD technique. In one embodiment, the SPD technique utilizes large amounts of energy per unit volume of material processed. Also, the fine grain size of the produced material may be lost if the material is subjected to subsequent processing (e.g., shape forming). Additionally, the SPD technique may not provide a scalable way to precisely control grain size, and thus may not produce a material with the specific grain size needed for a specific application. In one embodiment, the SPD technique does not reduce the driving force for grain growth.

In one embodiment of the bottom-up method, particles containing nanosize grains of the material may be synthesized, and then the particles may be consolidated. Thus, in one embodiment, this method herein may be referred to as a "two-step" process. The consolidation may be achieved by a sintering process. However, materials produced through the bottom-up method may exhibit poor ductility as a result of volume defects that are not removed during the consolidation step. These volume defects may include residual porosity, poor inter-particle bonding, and impurity contamination.

Bottom-up processes may be utilized to produce nanocrystalline tungsten. These processes may include the production of nanocrystalline tungsten powders synthesized through mechanical working, including ball milling and/or high energy milling. In some instances, although tungsten with nanosized grains of about 5 nm to about 15 nm may be produced, the resulting nanostructure may become unstable and may be susceptible to thermally activated grain growth. In one embodiment, to produce a tungsten material with a stable nanostructure, additive elements may be employed to reduce susceptibility to thermally activated grain growth. As described elsewhere herein, additive elements in one embodiment may be a stabilizer, an activator, or both, with respect to tungsten in the nanocrystalline alloy.

Elements for Stabilizing Nanocrystalline Tungsten

In selecting elements for stabilizing a tungsten material with nanosized grains, $\Delta dH_{seg}$ may be important. As shown in Eq. (3), elements with a large value of $\Delta H_{seg}$ may reduce grain boundary energy. The $\Delta H_{seg}$ of a solution may be directly related to the elastic strain energy of the solution, and the elastic strain energy of a solution may scale with atomic radius mismatch. Therefore, in one embodiment, as atomic radius mismatch increases, the grain boundary energy may be reduced.

Figure 4:
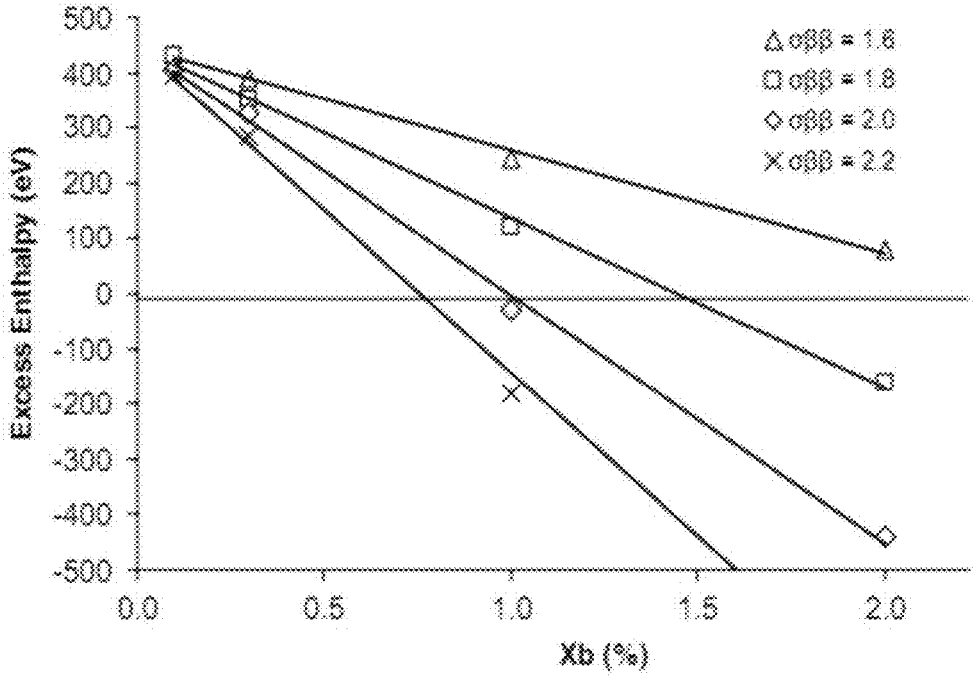
FIG. 4 depicts a plot of the excess enthalpy for varying solute concentrations and dopant sizes in one embodiment.

As shown in FIG. 4, the slope of excess enthalpy may become more negative as the ratio of the atomic radius of the solute to that of the host atom increases, indicating an increased potential for grain boundary energy reduction with increasing atomic radius mismatch. Other factors that may be considered in selecting an element for the stabilization of tungsten include chemical interaction and grain boundary energy difference. In the case of elements with a positive heat of mixing, solubility may be directly related to chemical interaction, and solutes with high immiscibility with host atoms may be more likely to segregate to grain boundaries.

In considering the segregation strength of tungsten alloys with positive heats of mixing, the elements Ti, V, Sc, and Cr may have good segregation strength with respect to their enthalpies of mixing. In one embodiment, vanadium exhibits a low heat of mixing, and thus may not be desirable for certain applications.

Figure 5:
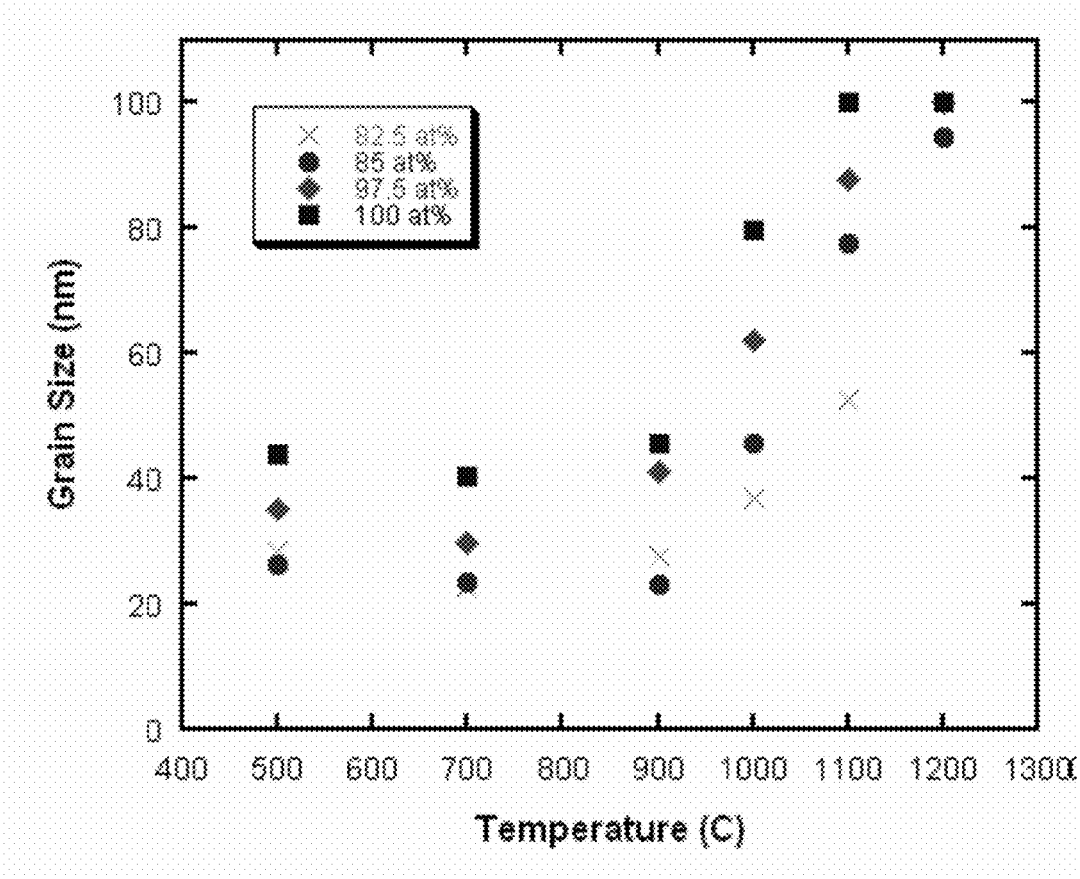
FIG. 5 depicts the grain size of tungsten powders at various annealing temperatures in one embodiment.

The thermal stability of an alloy may be determined and/or confirmed by any suitable techniques. For example, in one embodiment, the thermal stability of a W—Ti alloy may be confirmed with x-ray diffraction (XRD) data collected in-situ at different temperatures. The alloy sample may already have been annealed at various temperatures, for various predetermined periods of time. FIG. 5 shows the XRD data of a W—Ti alloy after being annealed for 1.5 hours at various temperatures. As shown in FIG. 5, while the grain size of pure tungsten may increase at 1000° C., the grain size increase in a W-17.5 at % Ti alloy may be suppressed. Therefore, not to be bound by any theory, but at least in this embodiment Ti may play a role in inhibiting grain growth by reducing the grain boundary energy.

Activated Sintering of Tungsten

Because tungsten has a high melting point of 3422° C., tungsten may be employed as a refractory metal material. In one embodiment, even with sintering techniques, high temperatures of about 2400° C. to about 2800° C. may be needed to obtain a full density sintered tungsten material. Small amounts of additional elements may be added to tungsten to enhance the sintering kinetics, and in turn lower the sintering temperature. The additive elements may be metal elements, including any of those aforedescribed. In one embodiment, the additive elements may be at least one of Pd, Pt, Ni, Co and Fe. These additive metal elements may surround the tungsten particles and provide a relatively high transport diffusion path for the tungsten, thereby reducing the activation energy of tungsten diffusion. In one embodiment, this technique is referred to as activated sintering.

Figure 6A:
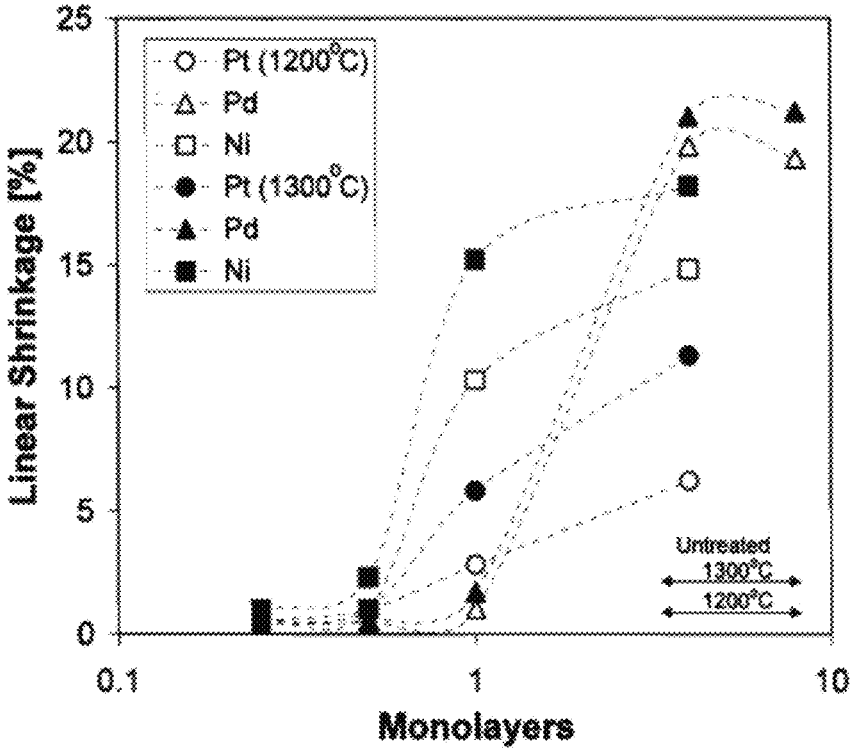
FIGS. 6(*a*)-6(*b*) depict, respectively, the linear shrinkage of tungsten compacts with three transition metal activators for a varying number of layers in one embodiment and the linear shrinkage of various tungsten alloys with four monolayers of additives as a function of varying temperatures in one embodiment.
Figure 6B:
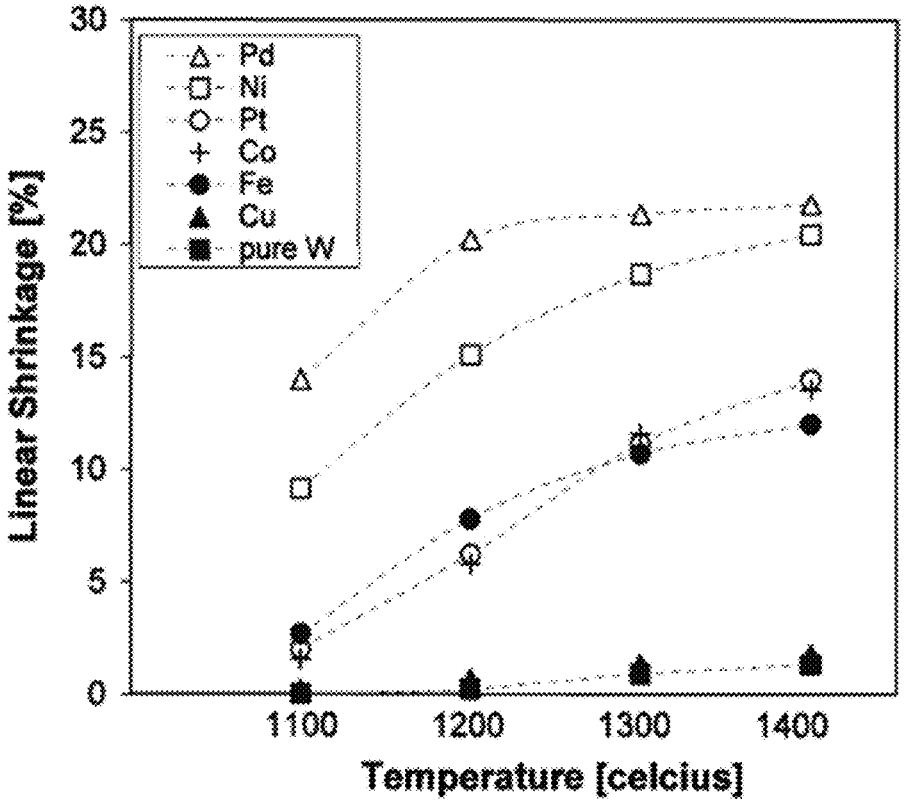

Activated sintering may be explained by different mechanisms. It may be ascribed to dislocation climb, the transfer of electrons from the additive element to the d-orbital of tungsten, and an enhancement of the grain boundary diffusion rate. The effect of additive elements that are transition metal elements on the sintering kinetics of tungsten are shown in FIGS. 6(*a*) and 6(*b*). In these figures, the degree of sintering may be reflected by the degree of shrinkage of the tungsten compacts under a constant force at an elevated temperature, with shrinkage correlating to the amount of sintering that has occurred. FIG. 6(*a*) depicts the amount of shrinkage for various monolayers of the additive elements on the tungsten particles, and FIG. 6(*b*) depicts the shrinkage of tungsten particles with four monolayers of different additive elements at different temperatures. In one embodiment, the use of Pd and Ni as additional elements may result in the activated sintering of tungsten. In another embodiment, the additive element Cu may have a minimal impact on the sintering kinetics and may result in the same linear shrinkage as pure tungsten, as shown in FIG. 6(*b*). Not to be bound by any theory, but this may be a result of the low solubility of tungsten in Cu, which low solubility may prevent Cu from providing a fast transport path to tungsten atoms during sintering.

Sintering Kinetics

While additive elements may be desirable in some instances, too much of an additive element may hinder the densification of tungsten. Not to be bound by any particular theory, but this may suggest that activated sintering of tungsten may be a diffusion controlled process. The activation energies of the additive elements Fe, Co, Ni, and Pd, are 480 kJ/mol, 370 kJ/mol, 280 kJ/mol, and 200 kJ/mol, respectively.

The activation energy of pure tungsten sintering is about 380-460 kJ/mol. Not to be bound by any theory, but the value suggests that the mechanism of sintering of pure tungsten in the initial stage may be grain boundary diffusion because the activation energy of pure tungsten sintering is comparable to that of grain boundary diffusion of tungsten as shown in Table 1.

TABLE 1

Activation energy of three mass-transport mechanisms in tungsten.

| Diffusion Type | Activation Energy (kJ/mol) |
|---|---|
| Surface Diffusion | 250~290 |
| Grain Boundary Diffusion | 380~460 |
| Volume Diffusion | 500~590 |

Activation Energy for Densification

Sintering may be a complex process that includes the change of microstructure as a result of several different diffusion mechanisms. In one embodiment, this complex sintering process may be distinguished into three stages based on the evolution of the microstructure: initial, intermediate and final stage. The initial stage may begin at a low temperature when necks are created between particles. The necks may be created through surface diffusion and may result in a small increase in density. The initial stage may correlate to less than 3% linear shrinkage. The intermediate stage may produce considerable densification. The densification in the intermediate stage may be up to a relative density of 93%. During the final stage, isolated pores may be formed and then removed. In the final stage, volume diffusion may be predominant.

The sintering behavior may be explained by geometric models. While these models may be in line with experimental results in some cases, slight deviations from the geometric models, such as the use of non-spherical particles or a variety of particle sizes, may make the results of the geometric models unreliable. Moreover, geometric models based on the initial sintering process may not be accurate beyond the first 5% of linear shrinkage. In addition, the actual evolution of the microstructure of powder compacts may be different from the predictions of geometric models. As a result, it may be difficult to quantitatively predict sintering kinetics.

The entire sintering process may be described in an approach that focuses on more than the three sintering stages. To evaluate the precise activation energy of the sintering process, a generalized sintering equation may be utilized. Not to be bound by any particular theory, but the instantaneous densification rate during sintering may be represented with temperature-dependent, grain-size-dependent, and density-dependent terms, as shown in Eq. (4).

$$\frac{d\rho}{dt} = A\frac{e^{-Q/RT}}{T}\frac{f(\rho)}{d^n} \text{ where } A = \frac{C\gamma V^{2/3}}{R}, \tag{4}$$

where ρ is the bulk density, d is the grain or particle size, γ is the surface energy, V is the molar volume, R is the gas constant, T is the absolute temperature, Q is the activation energy, and f(ρ) is a function only of density. C is a constant and A is a material parameter that is not related to d, T, or ρ. Finally, the diffusion mechanism such as grain boundary diffusion or volume diffusion, determines the value of n. In isotropic shrinkage situations, p may be obtained based on the simple mathematic relationship and the shrinkage data:

$$\rho(t) = \left(\frac{1}{1 + \Delta l / l_0}\right)\rho_0. \tag{5}$$

Upon taking the logarithm of Eq. 4, the following equation is obtained:

$$\ln\left(T\frac{d\rho}{dt}\right) = -\frac{Q}{RT} + \ln[f(p)] + \ln A - n\ln d. \tag{6}$$

Therefore, the activation energy, Q, may be evaluated through the slope by plotting ln(Tdρ/dt) versus 1/T at a constant ρ and d. Moreover, Equation (6) produces a different Q at different density values.

Thermodynamic Stabilization of Tungsten Alloys Through Segregation

In one embodiment, additive alloying elements may be employed: a stabilizer element and/or an activator element. The stabilizer element may thermodynamically stabilize nanocrystalline tungsten by segregation in the grain boundaries. This segregation may reduce the grain boundary energy, and in turn may reduce the driving force for grain growth. In one embodiment, the nanocrystalline tungsten alloy may be thermodynamically stable or substantially thermodynamically stable at temperatures greater than or equal to about 1000° C.—e.g., greater than or equal to about 1050° C., about 1000° C., about 1150° C., about 1200° C., about 1250° C., about 1300° C., about 1350° C., about 1400° C., about 1450° C. about 1500° C., or higher.

The activator element may enhance the sintering kinetics of tungsten by providing a high diffusion path for tungsten atoms. As a result, the sintering temperature in one embodiment may be less than or equal to about 1500° C.—e.g., less than or equal to about 1450° C., about 1400° C., about 1350° C., about 1300° C., about 1250° C., about 1200° C., about 1150° C., about 1100° C., about 1050° C., or lower. In one embodiment, the sintering temperature may be about 1000° C. The reduction of the sintering temperature may allow sintering to take place in the temperature range where the nanostructure of the nanocrystalline tungsten is thermodynamically stable. In one embodiment, the sintering temperature may be affected by the heating rate employed.

Stabilizer Elements

The stabilizer element may be any element capable of reducing the grain boundary energy of the sintered material, thereby reducing the driving force for grain growth. Generally, the stabilizer element may exhibit a positive heat of mixing with the sintered material. In one embodiment, the stabilizer element may be a metal element, which may be any of the aforedescribed metal elements.

The stabilizer element may be present in an amount of greater than or equal to about 2.5 at %—e.g., greater than or equal to about 5 at %, about 7.5 at %, about 10 at %, about 12.5 at % about 15 at %, about 17.5 at %, about 20 at %, about 25 at %, about 30 at %, about 35 at %, about 40 at %, about 45 at %, or greater. In one embodiment, the stabilizer element may be present in an amount of from about 2.5 at % to about 45 at %—e.g., about 5 at % to about 40 at %, about 7.5 at % to about 35 at %, about 10 at % to about 30 at %, about 12.5 at % to about 25 at %, or about 15 at % to about 20 at %, etc. In one embodiment, the stabilizer element may be present in an amount of about 2.5 at %, about 5 at %, about 7.5 at %, about 10 at %, about 12.5 at %, about 15 at %, about 17.5 at %, about 20 at %, about 25 at %, about 30 at %, about 35 at %, about 40 at %, or about 45 at %.

Activator Elements

The activator element may be any element capable of enhancing the sintering kinetics of the sintered material. In one embodiment of activated sintering, the activator element may act as a fast carrier path for the diffusion of tungsten. As a result, in one embodiment the selection of an activator element may be based on two conditions. First, the solubility of the activator element in tungsten and segregation at the interparticle interfaces may be low. Additionally, the activator element should exhibit relatively high solubility for tungsten, allowing the activator element to act as a fast diffusion path for tungsten atoms. Second, the diffusion rate of tungsten in a phase rich in an activator element may be relatively high. Additionally, the diffusion rate of tungsten in an activator element rich phase should be higher than the diffusion rate of the tungsten in itself. The term "rich" with respect to the content of an element in a phase refers, in one embodiment, to a content of the element in the phase of at least about 50 at %—e.g., at least about 60 at %, about 70 at %, about 80 at %, about 90 at %, about 99%, or higher. The term "phase" in one embodiment refers to a state of matter. For example, in one embodiment a phase may refer to a phase shown on a phase diagram.

In one embodiment, tungsten is soluble in the activator element. In another embodiment, the solubility of the tungsten in the activator element increases with increasing temperature. In one embodiment, the melting temperature of the activator element may be less than the melting temperature of the tungsten.

Generally, the amount of an activator may be minimized so that the quantity available for interaction with the stabilizer element is reduced. In one embodiment, the activator element may be present in an amount greater than or equal to about 0.15 at %—e.g., greater than or equal to or about 0.3 at %, about 0.5 at %, about 1 at %, about 3 at %, about 5 at %, about 8 at %, about 10 at %, about 13 at %, about 15 at %, about 18 at %, about 20 at %, about 23 at %, about 25 at %, about 30 at %, about 35 at %, about 40 at %, about 45 at %, or greater. In one embodiment, the activator element may be present in an amount of about 0.15 at % to about 45 at %—e.g., about 0.3 at % to about 40 at %, about 0.5 at % to about 35 at %, about 1 at % to about 30 at %, about 3 at % to about 25 at %, about 5 at % to about 23 at %, about 8 at % to about 20 at %, about 10 at % to about 18 at %, or about 13 at % to about 15 at %, etc. In one embodiment, the activator element may be present in an amount of about 0.15 at %, about 0.3 at %, about 0.5 at %, about 1 at %, about 3 at %, about 5 at %, about 8 at %, about 10 at %, about 13 at %, about 15 at %, about 18 at %, about 20 at %, about 23 at %, about 25 at %, about 30 at %, about 35 at %, about 40 at %, or about 45 at %.

In one embodiment, the activator element may be a metal element, which may be any of the aforedescribed metal elements. In one embodiment the activator element may be at least one of Pd, Pt, Ni, Co, and Fe.

In one embodiment, the activator element may also be the stabilizer element. As shown in Eq. (3), the activator element that provides the largest $\Delta H_{seg}$ may produce the largest stabilization effect, and $\Delta H_{seg}$ may be related to three factors: atomic radius mismatch (elastic strain energy), chemical interaction and grain boundary energy difference. The atomic radius mismatch between Ni and tungsten is bigger than the mismatch between Pd and tungsten. Therefore, Ni may be a better element for stabilizing tungsten if only elastic strain energy is considered. In one embodiment, Ni or Pd may act as both the stabilizer element and the activator element, producing W—Ni and W—Pd nanocrystalline alloys.

In another embodiment, the stabilizer element may also be the activator element. The use of a single element both as the stabilizer and activator elements has the added benefit of removing the need to consider the interaction between the activator and the stabilizer. In one embodiment the element that may be utilized as both the activator and stabilizer element may be a metal element, which may be any of the aforedescribed metal elements. In one embodiment at least one of Ti, V, Cr, and Sc, or combinations thereof, may be utilized as both the activator and stabilizer element. In another embodiment Cr, Ti, or both may be utilized as both the activator and stabilizer element.

Figure 7B:
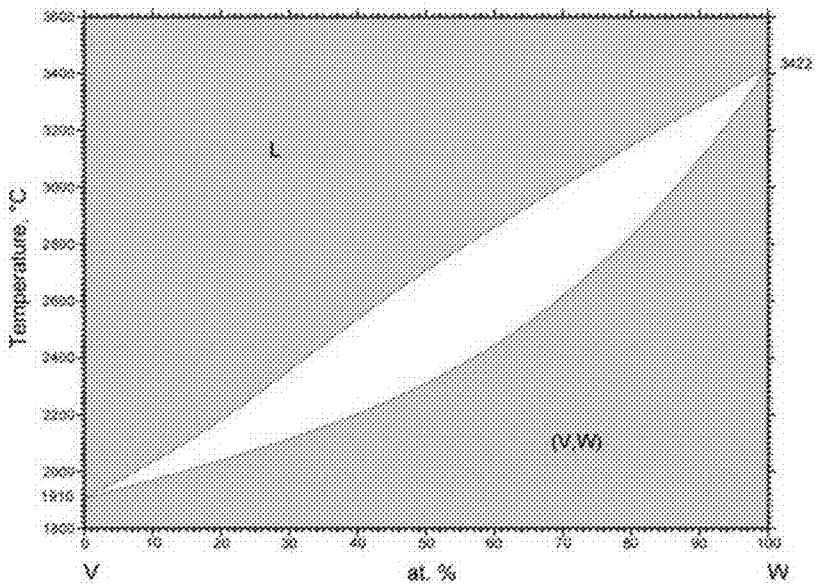
FIGS. 7(*a*)-7(*b*) depict, respectively, the phase diagram of Ti—W and the phase diagram of V—W.
Figure 7A:
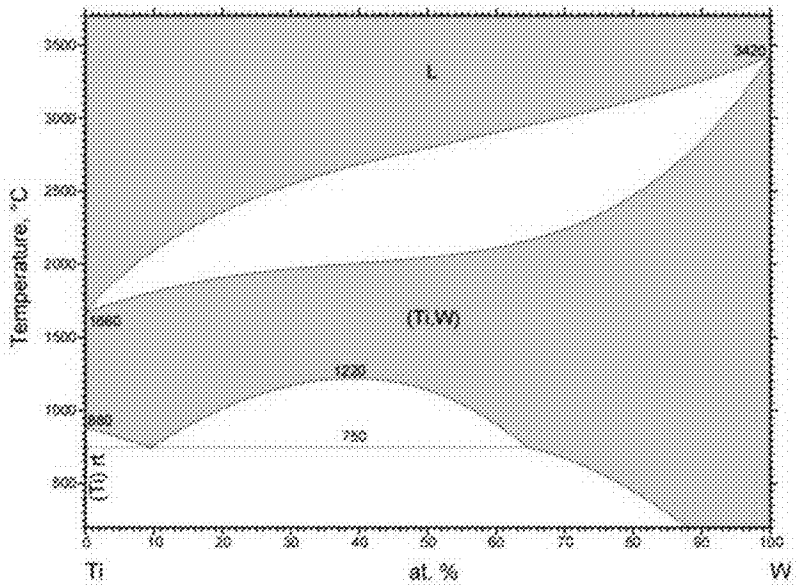
Figure 8A:
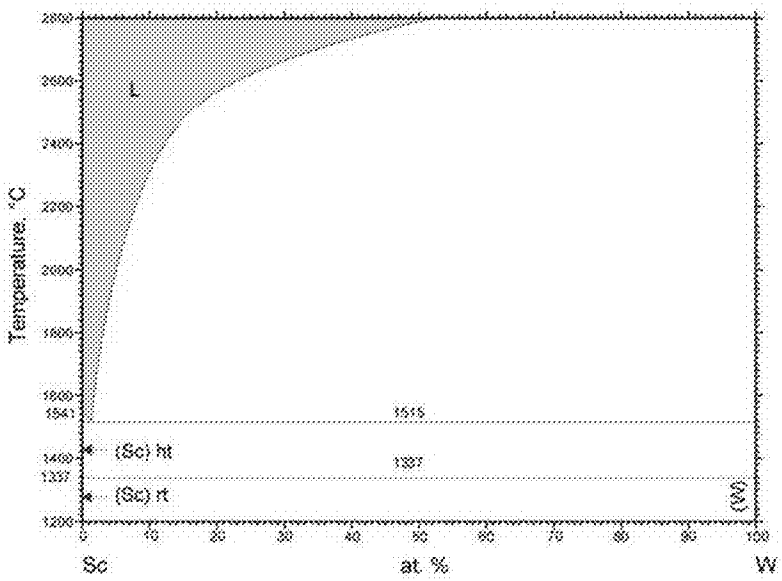
FIGS. 8(*a*)-8(*b*) depict, respectively, the phase diagram of Sc—W and the phase diagram of Cr—W.
Figure 8B:
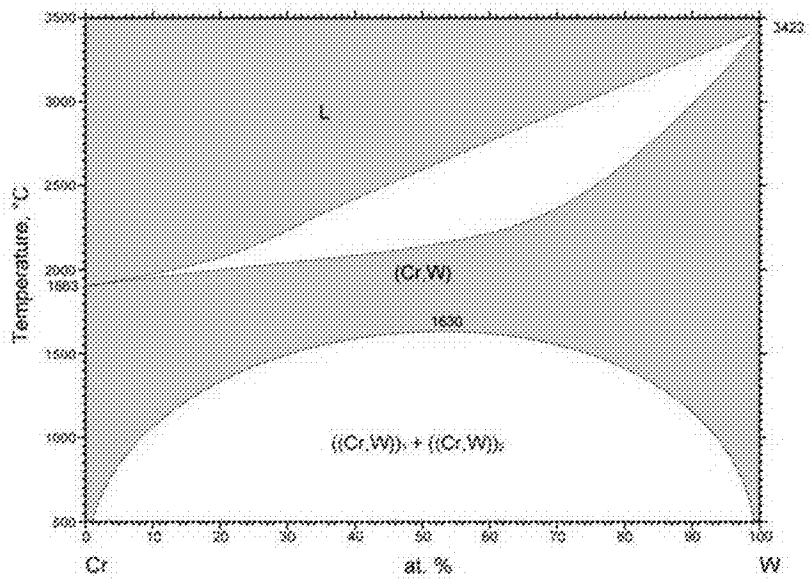

In the case of both Ti and V, a solid solution is formed with tungsten at the sintering temperature (below 1500° C.), as shown in the phase diagrams in FIGS. 7(*a*) and 7(*b*). In the case of Sc, the Sc and W phases exist separately at the expected sintering temperature (below 1500° C.), as shown in the phase diagram in FIG. 8(*a*). Thus, in one embodiment the Sc may be able to provide a diffusion path for the tungsten. In the case of Cr, the Cr rich and W rich phases exist separately at the expected sintering temperature (below 1500° C.), as shown in the phase diagram in FIG. 8(*b*). In addition, Cr has a relatively high segregation enthalpy compared to other stabilizers, and the diffusivity of tungsten in Cr is higher than the self-diffusivity of tungsten. In one embodiment Cr may act as both the activator element and the stabilizer element, producing a W—Cr nanocrystalline alloy.

Interaction of Activator and Stabilizer

When one element cannot act as both the stabilizer and the activator, two elements may be employed. The interaction between the two elements may be accounted for to ensure that the activator and stabilizer roles are properly fulfilled. For example, when the activator and the stabilizer form an intermetallic compound each of the elements may be prevented from fulfilling their designated role. As a result, activator and stabilizer combinations with the ability to form intermetallic compounds at the expected sintering temperatures should be avoided at least in some instances. The potential for the formation of intermetallic compounds between two elements may be analyzed with phase diagrams.

The amount of each additive may be important in determining the potential for the formation of an intermetallic phase based on the phase diagram. For example, as shown in FIG. 5, 17.5 at % Ti may be a desirable stabilizer with respect to W. In one embodiment, for simplicity an amount of 20 at % stabilizer may be considered based on FIG. 5. On the other hand, the amount of an activator added may change with particle size. In one embodiment, although the exact amount of an activator to be added may not be known until measuring the distribution of the tungsten particle size, it may be roughly approximated as 0.5 wt % compared to tungsten.

Figure 9B:
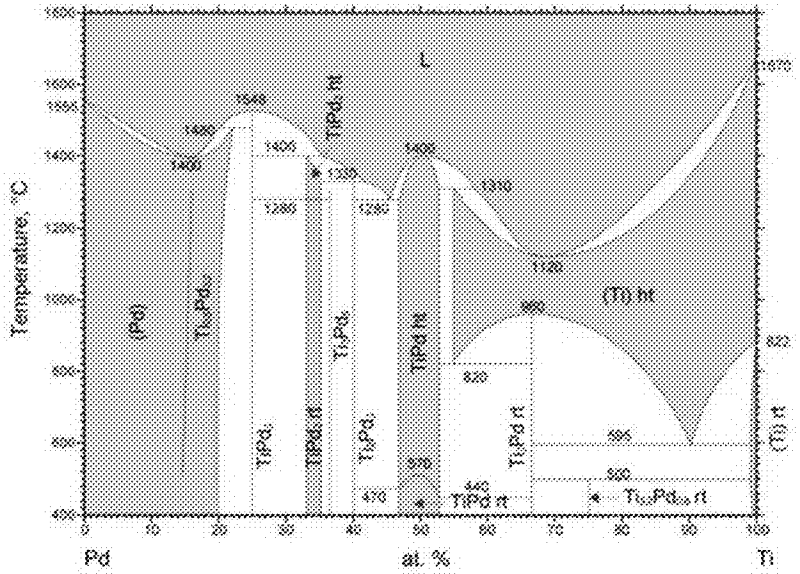
FIGS. 9(*a*)-9(*b*) depict, respectively, the phase diagram of Ni—Ti and the phase diagram of Pd—Ti.
Figure 9A:
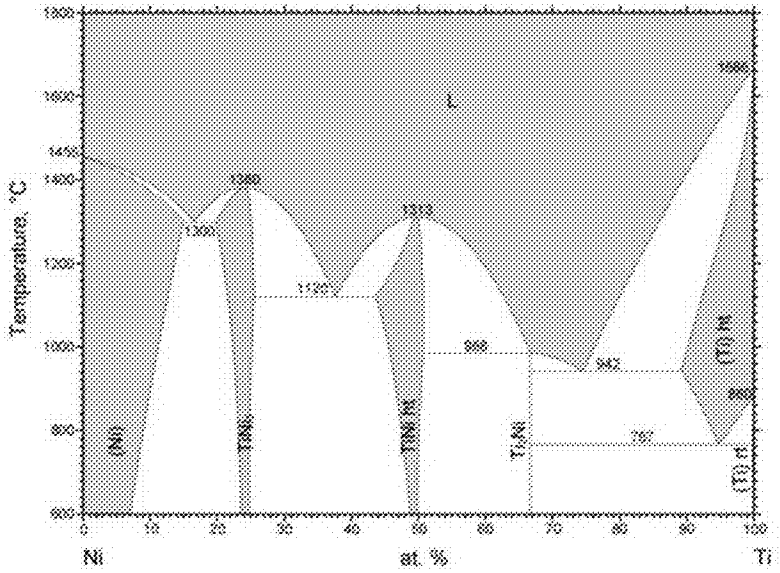

FIG. 9(*a*) illustrates one embodiment, wherein Ti and Ni in an amount of 20 at % Ti and 1.3 at % Ni (corresponding to 0.5 wt % Ni compared to tungsten) are added. As shown in FIG. 9(*a*), a $Ti_2Ni$ intermetallic phase and a Ti(HCP) phase coexist at temperatures below 767° C. More importantly for the purposes of activated sintering, a two phase region—Ti(HCP), liquid—exists at temperatures of about 1200° C. and above, at this concentration.

FIG. 9(*b*) illustrates one embodiment, wherein Ti and Pd in an amount of 20 at % Ti and 0.7 at % Pd (corresponding to 0.5 wt % Pd compared to tungsten) are added. As shown in FIG. 9(*b*), a Ti(HCP) phase exists at about 1500° C.

Figure 10B:
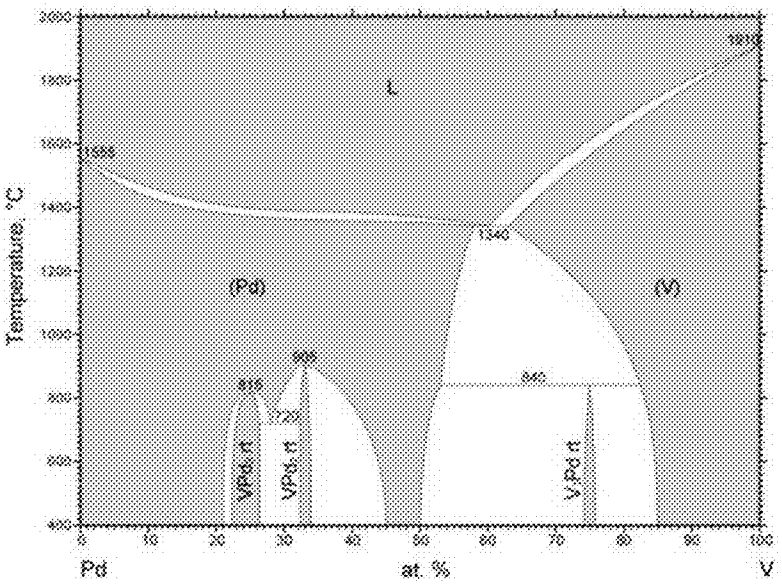
FIGS. 10(*a*)-10(*b*) depict, respectively, the phase diagram of Ni—V and the phase diagram of Pd—V.
Figure 10A:
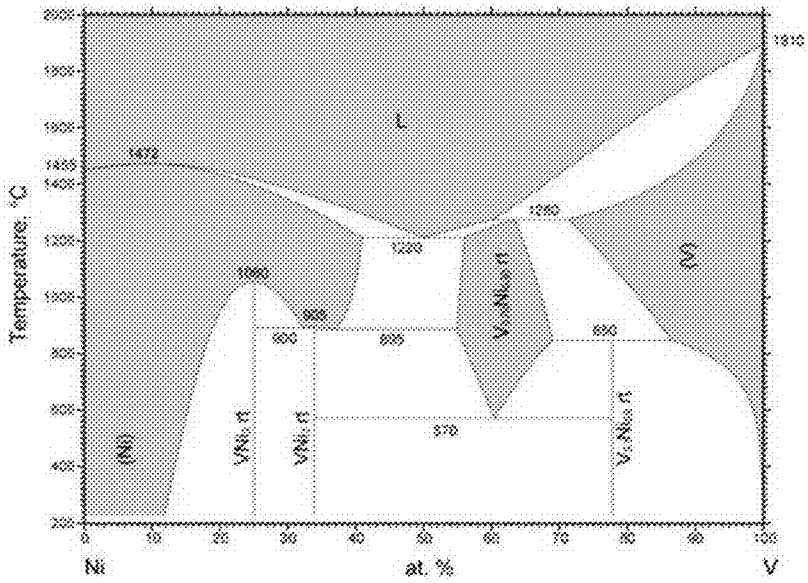

FIG. 10(*a*) illustrates one embodiment, wherein V and Ni in an amount of 20 at % V and 1.3 at % Ni (corresponding to 0.5 wt % Ni compared to tungsten) are added. As shown in FIG. 10(*a*), a $V_{3.1}Ni_{0.9}$ intermetallic compound and a V phase coexist at about 800° C., and a V phase exists at high temperature.

FIG. 10(*b*) illustrates one embodiment, wherein V and Pd in an amount of 20 at % V and 0.7 at % Pd (corresponding to 0.5 wt % Pd compared to tungsten) are added. As shown in FIG. 10(*b*), only a V phase exists up to about 1900° C.

Figure 11B:
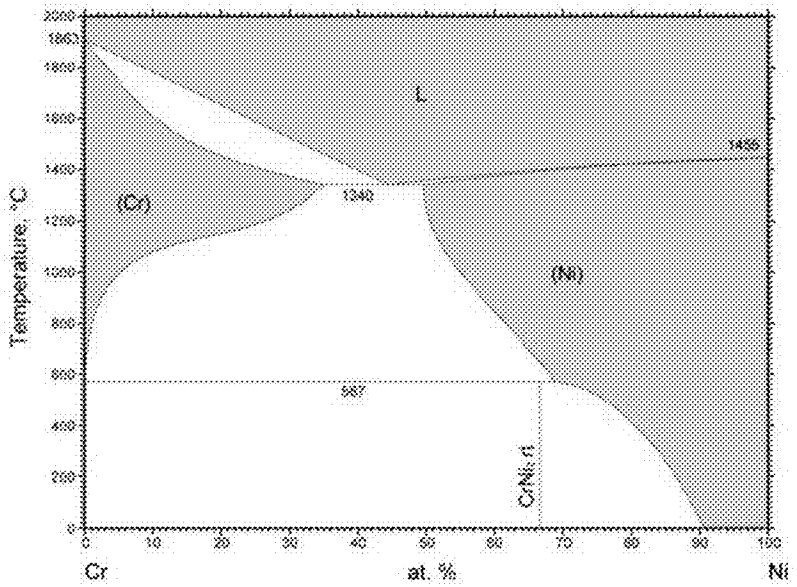
FIGS. 11(*a*)-11(*b*) depict, respectively, the phase diagram of Cr—Pd and the phase diagram of Cr—Ni.
Figure 11A:
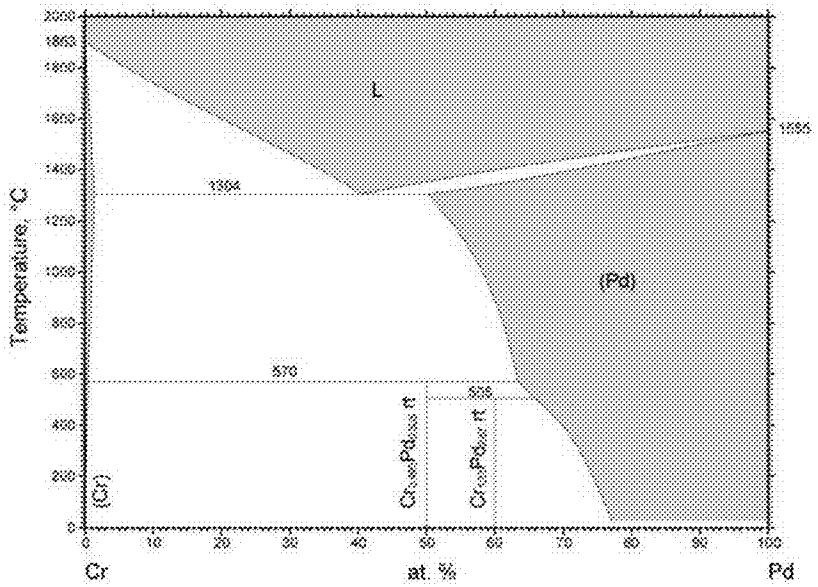

FIG. 11(*a*) illustrates one embodiment, wherein Cr and Pd in an amount of 20 at % Cr and 0.7 at % Pd (corresponding to 0.5 wt % Pd compared to tungsten) are added. As shown in FIG. 11(*a*), a Cr phase and a Pd phase coexist above 570° C., and a Cr phase and a liquid phase coexist above 1304° C. Although a ternary diagram may be important in determining whether an intermetallic compound may be formed, the binary phase diagrams indicate that separate Cr and Pd phases may coexist. In one embodiment, the sintering temperature may be below 1300° C., and Cr and the Pd exist in this temperature range as separate phases based on the binary phase diagrams, allowing Cr and Pd to fulfill the roles of a stabilizer and activator, respectively, without interference from each other. In another embodiment, the processing temperature may be above 1300° C., and a liquid sintering technique may be employed.

FIG. 11(*b*) illustrates one embodiment, wherein Cr and Ni in an amount of 20 at % Cr and 1.3 at % Ni (corresponding to 0.5 wt % Ni compared to tungsten) are added. As shown in FIG. 11(*b*), a Cr phase and a Ni phase coexist above 587° C., and only the Cr phase exists above 1000° C.

Figure 12B:
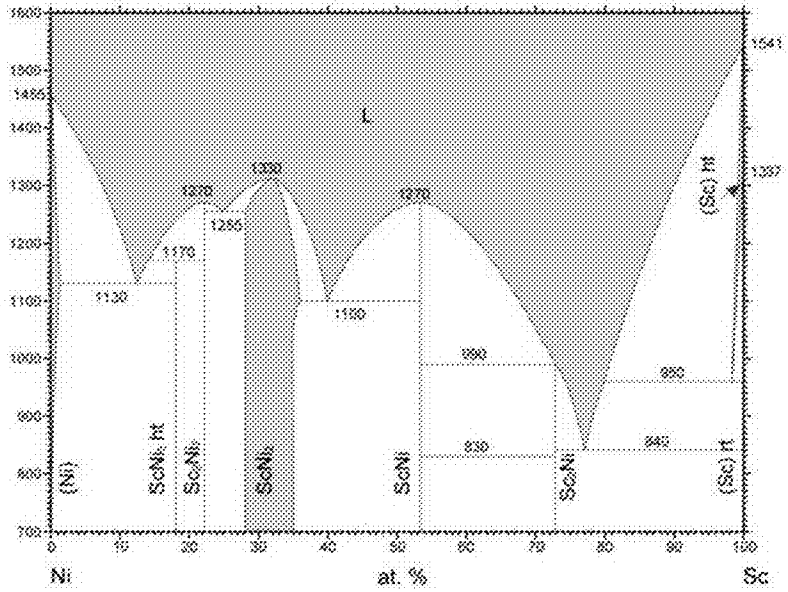
FIGS. 12(*a*)-12(*b*) depict, respectively, the phase diagram of Pd—Sc and the phase diagram of Ni—Sc.
Figure 12A:
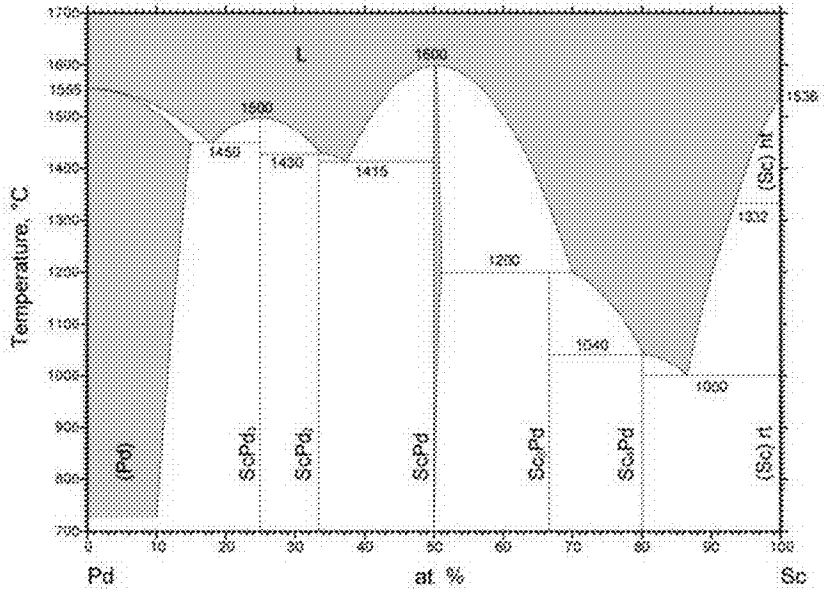

FIG. 12(*a*) illustrates one embodiment, wherein Sc and Pd in an amount of 20 at % Sc and 0.7 at % Pd (corresponding to 0.5 wt/o Pd compared to tungsten) are added. As shown in FIG. 12(*a*), a Sc phase and a liquid phase coexist above 1000° C., and only a liquid phase exists above 1400° C.

FIG. 12(*b*) illustrates one embodiment, wherein Sc and Ni in an amount of 20 at % Sc and 1.3 at % Ni (corresponding to 0.5 wt % Ni compared to tungsten) are added. As shown in FIG. 12(*b*), a Sc phase and a liquid phase coexist above 960° C., and only the liquid phase exists above 1400° C.

The ternary phase diagrams of the activator-stabilizer combination with tungsten indicate that a liquid phase may be formed with some stabilizer-activator combinations. In one embodiment, the stabilizer-activator combinations that may form a liquid phase may be Ni—Ti, Sc—Ni, Sc—Pd, and Cr—Pd.

Figure 13:
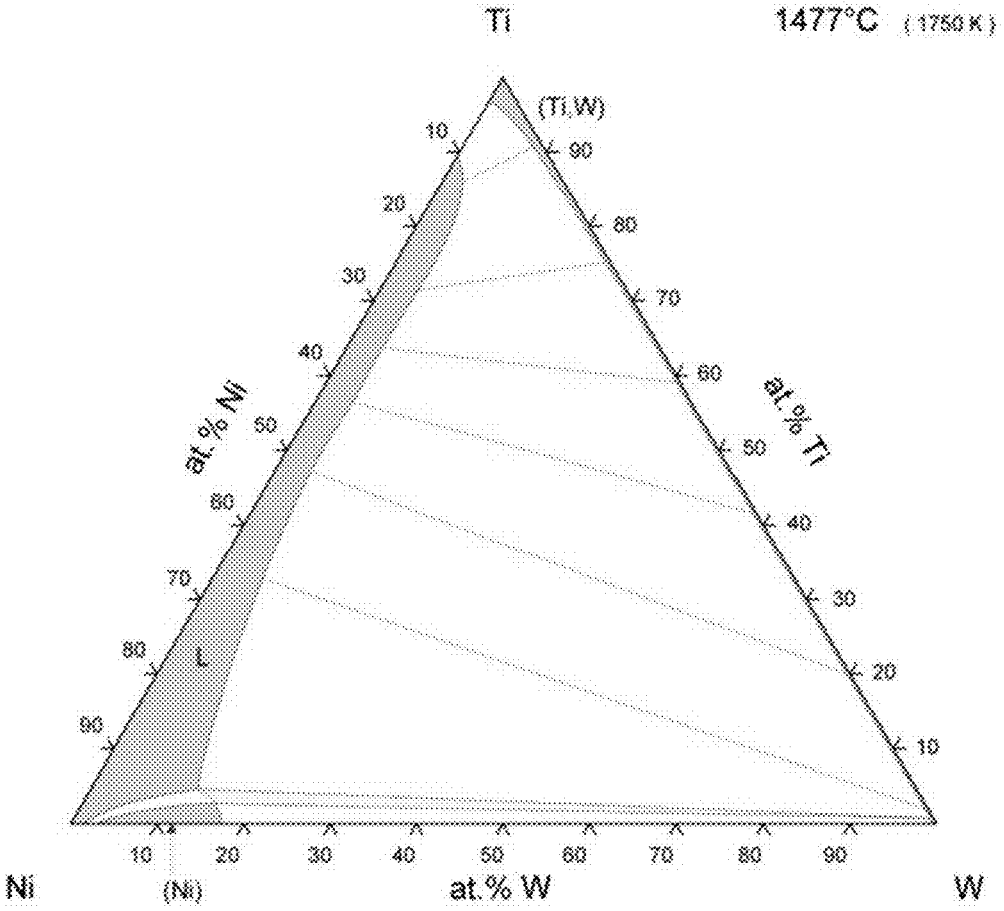
FIG. 13 depicts the ternary phase diagram of W—Ti—Ni at 1477° C.

The ternary phase diagram for W—Ti—Ni, as shown in FIG. 13 for 1477° C., indicates that a liquid phase exists at the composition, W-20 at % Ti-1.3 at % Ni. In one embodiment, a liquid phase sintering technique may be employed for W—Ti—Ni, which may further enhance sintering kinetics like activated sintering.

Liquid Phase Sintering

In at least one embodiment of liquid phase sintering, the alloy contains more than one component above the solidus line of the components at the expected processing temperature, and a liquid phase is present at the expected processing temperature. The densification rate may be faster for liquid phase sintering, compared to solid state sintering, due to the high diffusivity of atoms in the liquid phase. Industrial sintering may generally be performed in the presence of a liquid phase due to cost and productivity advantages. Over 70% of sintered materials may be processed using liquid phase sintering techniques.

Figure 14B:
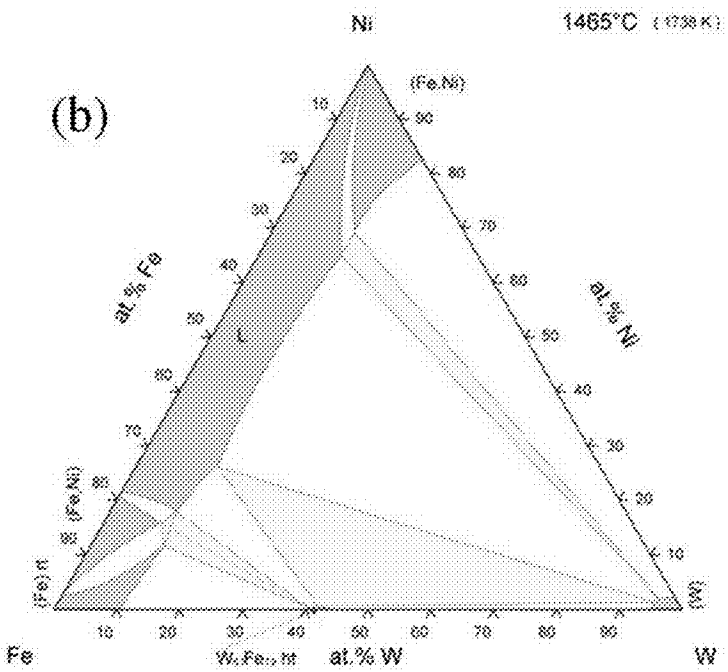
FIGS. 14(*a*)-14(*b*) depict, respectively, the phase diagram of Fe—Ni and the ternary phase diagram of W—Fe—Ni at 1465° C.
Figure 14A:
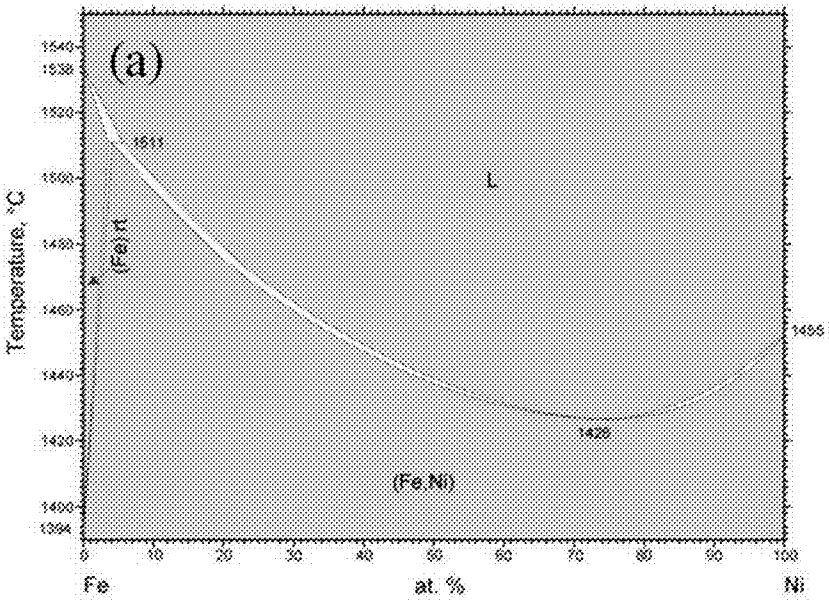

In one embodiment a W—Ni—Fe alloy system may be sintered by liquid phase sintering techniques to produce a material employed in applications such as kinetic energy penetrators. A temperature above 1460° C. may be applied for liquid phase sintering of 98 wt % W-1 wt % Ni-1 wt % Fe. A liquid phase may emerge at this concentration combination of Ni and Fe, as shown in FIGS. 14(*a*)-(*b*). The low solubility of Ni and Fe in tungsten may aid tungsten powder sintering. This system may be similar to the W—Ni—Ti alloy system.

Figure 15:
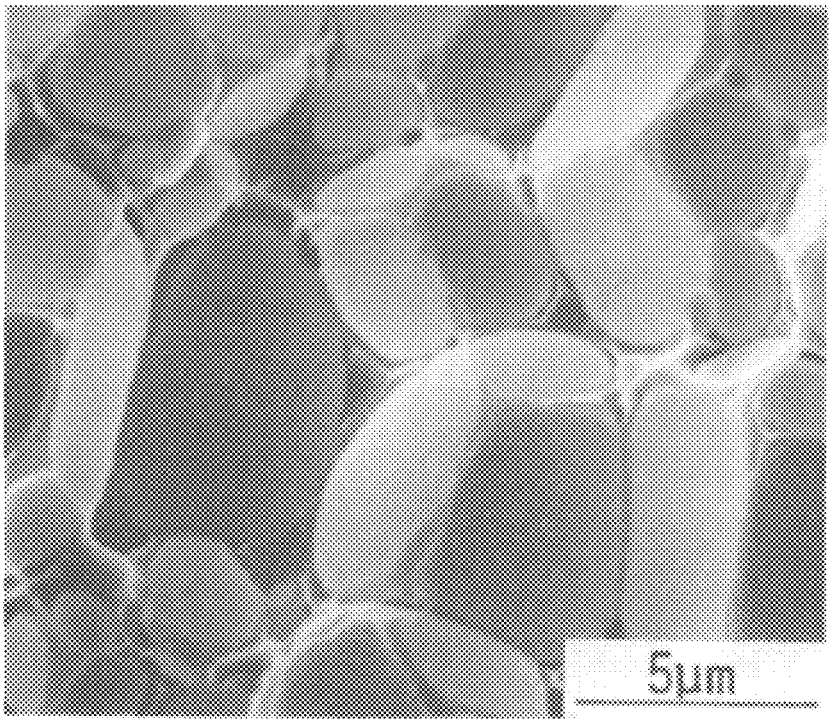
FIG. 15 depicts a fracture surface of W—Ni 1 at %-Fe 1 at % sintered at 1460° C. in one embodiment.

In some instances, liquid phase sintering techniques may exhibit concomitant microstructural coarsening. The inclusion of a stabilizer, such as Ti, in a nanocrystalline material may prevent microstructural coarsening. The occurrence of liquid phase sintering may be confirmed through scanning electron microscope (SEM) images at different temperatures throughout the sintering process. In one embodiment, the liquid phase sintering process may be the result of a pore filling mechanism. A pore filling mechanism and successful liquid phase sintering may be detected by the presence of liquid filled branches surrounding the sintered particles, as shown in FIG. 15.

Production of Sintered Nanocrystalline Alloys

In one embodiment, a process for the production of a nanocrystalline alloy includes sintering a plurality of nanocrystalline particulates. The nanocrystalline particulates may include a first metal material, such as tungsten, and a second metal material, such as an activator element. The nanocrystalline particulates may include a non-equilibrium phase where the second metal material is dissolved in the first metal material. According to one embodiment, the non-equilibrium phase may be a supersaturated phase. The term "supersaturated phase" is described further below. The non-equilibrium phase may undergo decomposition during the sintering of the nanocrystalline particulates. The sintering of the nanocrystalline particulates may cause the formation of a phase rich in the second metal material at at least one of the surface and grain boundaries of the nanocrystalline particulates. The formation of the phase rich in the second metal material may be the result of the decomposition of the non-equilibrium phase during the sintering. The phase rich in the second metal material may act as a fast diffusion path for the first metal material, enhancing the sintering kinetics and accelerating the rate of sintering of the nanocrystalline particulates. According to one embodiment, the decomposition of the non-equilibrium phase during the sintering of the nanocrystalline particulates accelerates the rate of sintering of the nanocrystalline particulates. The nanocrystalline alloy produced as a result of the sintering process may be a bulk nanocrystalline alloy.

In one embodiment, the second metal material may have a lower melting temperature than the first metal material. In another embodiment, the first metal material may be soluble in the second metal material. In one embodiment, the solubility of the first metal material in the second metal material may increase with increasing temperature. In another embodiment, the diffusivity of the first metal material in a phase rich in the second metal material is greater than the diffusivity of the first metal material in itself. Specifically, the first metal material and second metal material may include the elements described above in the Nanocrystalline Alloy section.

In one embodiment, the sintered nanocrystalline alloy may exhibit a relative density of greater than or equal to about 75%—e.g., at least about 80%, about 85%, about 90%, about 91%, about 92%, about 93%, about 94%, about 95%, about 96%, about 97%, about 98%, about 99%, or about 99.9%. The term "relative density" is already described above. In another embodiment, the relative density of the sintered material may be about 100%. According to one embodiment the sintered material may be fully dense. As utilized herein, the term "fully dense" or "full density" refers to a material with a relative density of at least 98%—e.g., at least about 98%, about 99%, about 99.5%, or higher. The density of the sintered material may impact other material properties of the sintered material. Thus, by controlling the density of the sintered material the other material properties may be controlled.

In one embodiment, the grain size of the sintered nanocrystalline alloy may be in the nanometer range—e.g., smaller than or equal to about 1000 nm: e.g., less than or equal to about 900 nm, about 800 nm, about 700 nm, about 600 nm, about 500 nm, about 450 nm, about 400 nm, about 350 nm, about 300 nm, about 250 nm, about 200 nm, about 150 nm, about 125 nm, about 100 nm, about 75 nm, about 50 nm, about 40 nm, about 30 nm, about 25 nm, about 20 nm, about 15 nm, about 10 nm, or smaller. In some embodiments herein, to further distinguish the different grain size regimes, the term "ultra-fine grain" is used to denote a grain size of greater than about 100 nm and less than about 1000 nm and the term "nanocrystalline grain" is used to denote a grain size of less than or equal to about 100 nm. In one embodiment, the grain size of the sintered nanocrystalline alloy may be about 1 nm to about 1000 nm—e.g., about 10 nm to about 900 nm, about 15 nm to about 800 nm, about 20 nm to about 700 nm, about 25 nm to about 600 nm, about 30 nm to about 500 nm, about 40 nm to about 450 nm, about 50 nm to about 400 nm, about 75 nm to about 350 nm, about 100 nm to about 300 nm, about 125 nm to about 250 nm, or about 150 nm to about 200 nm, etc. In one embodiment, the grain size of the sintered nanocrystalline alloy may be smaller than the grain size of a sintered material that includes the first metal material in the absence of the second metal material. In one embodiment, the grain size of the sintered nanocrystalline alloy may be about the same as the grain size of a sintered material that includes the first metal material in the absence of the second metal material. In one embodiment, the grain size of the sintered nanocrystalline alloy may be larger than or the same as the grain size of a sintered material that includes the first metal material in the absence of the second metal material. In one embodiment, the sintering mechanism described herein may be useful for the production of ultra-fine and nanocrystalline sintered materials due to the ability of second phases and alloying elements to maintain ultra-fine and nanocrystalline structures during heat treatment.

The sintering conditions for the production of the sintered material may be any appropriate conditions. According to one embodiment, a high sintering temperature may be employed for a short sintering time to produce the sintered material. Alternatively, a comparably lower sintering temperature may be employed for a longer sintering time to produce a sintered material that is densified to the same degree. In one embodiment, extended sintering times may result in an undesired increase in grain size. The sintering may be a pressureless sintering process. The sintering mechanism described herein allows the production of fully dense sintered ultra-fine and nanocrystalline materials even in the absence of external pressure applied during the sintering process.

Process for Making Nanocrystalline Particulates

One embodiment provides a method for making nanocrystalline tungsten particulates, which method involves mechanically working a powder including a plurality of tungsten particulates and a second metal material. In one embodiment, the second metal material may be an activator element or a stabilizer element. The mechanical working may be a ball-milling process or a high-energy ball milling process. In an exemplary ball-milling process, a tungsten carbide or steel milling vial may be employed, with a ball-to-powder ratio of about 2:1 to about 5:1, and a steric acid process control agent content of about 0.01 wt % to about 3 wt %. In another embodiment, the mechanical working may be carried out in the presence of a steric acid process control agent content of about 1 wt %, about 2 wt %, or about 3 wt %. According to another embodiment, the mechanical working is carried out in the absence of a process control agent. In one embodiment, the ball milling may be performed under any conditions sufficient to produce a nanocrystalline particulate comprising a supersaturated phase.

According to another embodiment, any appropriate method of mechanical powder milling may be employed to mechanically work a powder and form nanocrystalline particulates. In one embodiment, a high-energy ball mill of attritor mill may be employed. In other embodiments, other types of mills may be employed, including shaker mills and planetary mills. In general, any mechanical milling method that produces a mechanical alloying effect may be employed.

Figure 16B:
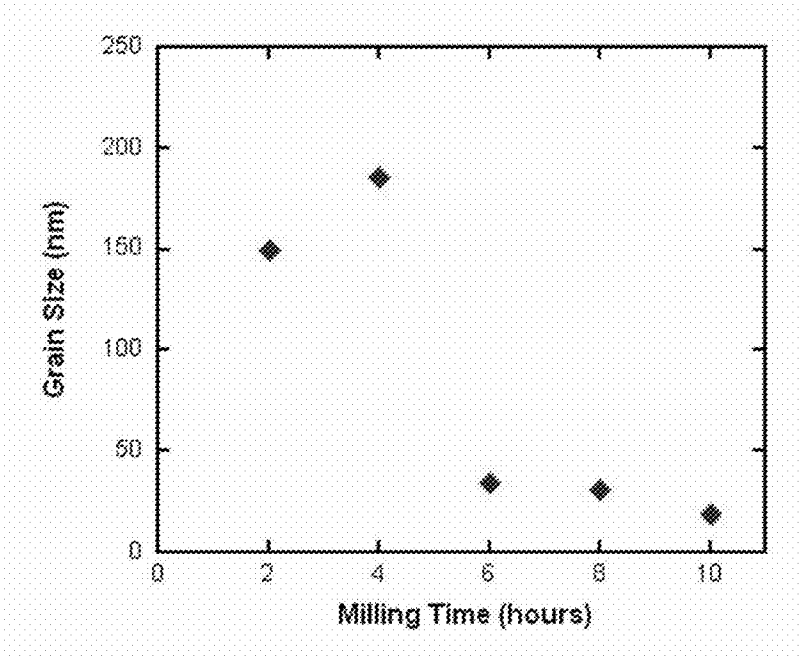
FIGS. 16(*a*)-16(*b*) depict, respectively, X-ray diffraction patterns of tungsten at different milling times in one embodiment and the grain size of tungsten at different milling times in one embodiment.
Figure 16A:
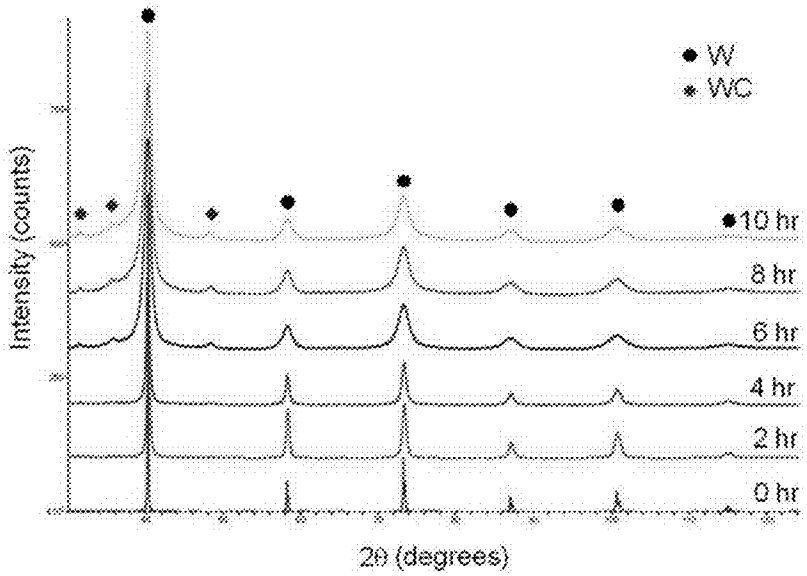

The average grain size of the nanocrystalline particulates may be calculated by peak broadening measurements obtained through x-ray diffraction (XRD). As shown in FIG. 16(*a*), the change in XRD patterns may be a function of milling time. As shown in this embodiment, peaks in the XRD patterns may start to be broadened after a milling time of about 6 hours. The grain size of the milled material may also significantly drop after a milling time of about 6 hours, as shown in FIG. 16(*b*).

In one embodiment, the ball milling may be conducted for a time of greater than or equal to about 2 hours—e.g., greater than or equal to about 4 hours, about 6 hours, about 8 hours, about 10 hours, about 12 hours, about 15 hours, about 20 hours, about 25 hours, about 30 hours, or about 35 hours. In one embodiment the ball-milling may be conducted for a time of about 1 hour to about 35 hours—e.g., about 2 hours to about 30 hours, about 4 hours to about 25 hours, about 6 hours to about 20 hours, about 8 hours to about 15 hours, or about 10 hours to about 12 hours. If the milling time is too long, the tungsten powder may be contaminated by the milling vial material. The amount of the second metal material that is dissolved in the tungsten material may also increase with increasing milling time. In one embodiment, after the ball-milling step, a phase rich in the second metal material may be observed.

In one embodiment the grain size of the produced nanocrystalline particulates may be smaller than about 1000 nm—e.g., smaller than or equal to about 900 nm, about 800 nm, about 700 nm, about 600 nm, about 500 nm, about 400 nm, about 300 nm, about 200 nm, about 150 nm, about 100 nm, about 50 nm, about 30 nm, about 20 nm, about 10 nm, about 5 nm, about 2 nm, or smaller. In one embodiment the grain size of the produced nanocrystalline particulates may be about 1 nm to about 1000 nm—e.g., about 10 nm to about 900 nm, about 15 nm to about 800 nm, about 20 nm to about 700 nm, about 25 nm to about 600 nm, about 30 nm to about 500 nm, about 40 nm to about 450 nm, about 50 nm to about 400 nm, about 75 nm to about 350 nm, about 100 nm to about 300 nm, about 125 nm to about 250 nm, or about 150 nm to about 200 nm, etc. In another embodiment, the nanocrystalline particulates may have a grain size of about 7 nm to about 8 nm.

In one embodiment, the nanocrystalline particulates are polycrystalline—e.g., the nanocrystalline particulates contain a plurality of grains. In another embodiment, the nanocrystalline particulates are single crystalline materials—e.g., at least one of the nanocrystalline particulates contains a single grain.

In at least one embodiment, ball-milling of the tungsten powder and the activator element may produce a non-equilibrium phase. The non-equilibrium phase may contain a solid solution. The non-equilibrium phase may be a supersaturated phase. A "supersaturated phase" may be a non-equilibrium phase that includes the activator element forcibly dissolved in the tungsten in an amount that exceeds the amount of activator element that could be otherwise dissolved in an equilibrium tungsten phase. In one embodiment, the supersaturated phase may be the only phase present after the ball-milling process. In another embodiment, a second phase rich in the activator element may be present after ball milling.

In at least one embodiment, the sintering behavior of the particulate material may be observed by heating a compact of the particulate material under a constant force. A change in the length of the compact indicates sintering and densification. The force may be of any value, depending on the application. In one embodiment, the constant force applied to the compact throughout the heating process is about 0.05 N or about 0.1 N. The sintering temperature of the particulate material may be defined as the temperature at which the change in the length of the compact is 1%.

According to one embodiment, the sintering may include a liquid phase sintering mechanism.

Matter Sintering Curve

Figure 41:
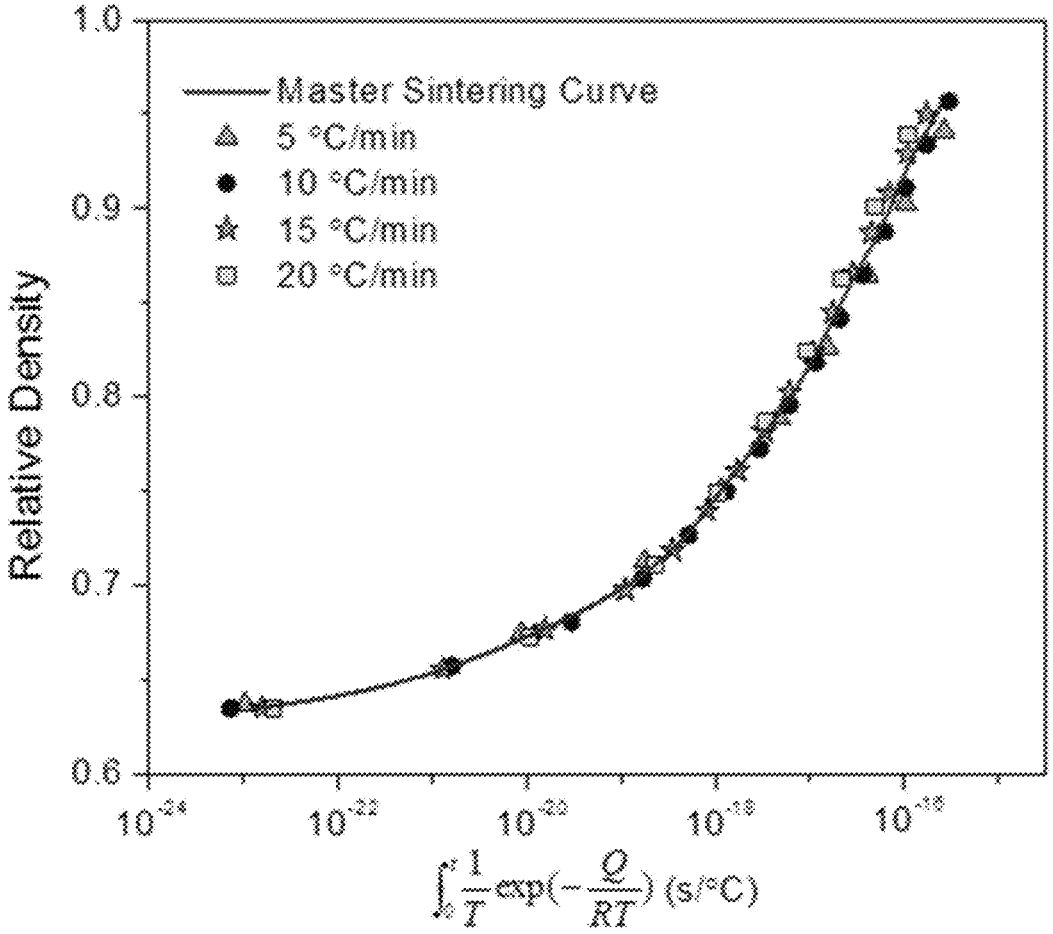
FIG. 41 depicts the master sintering curve and heating profiles of W—Cr 15 at % at various heating rates, in one embodiment.
Figure 45:
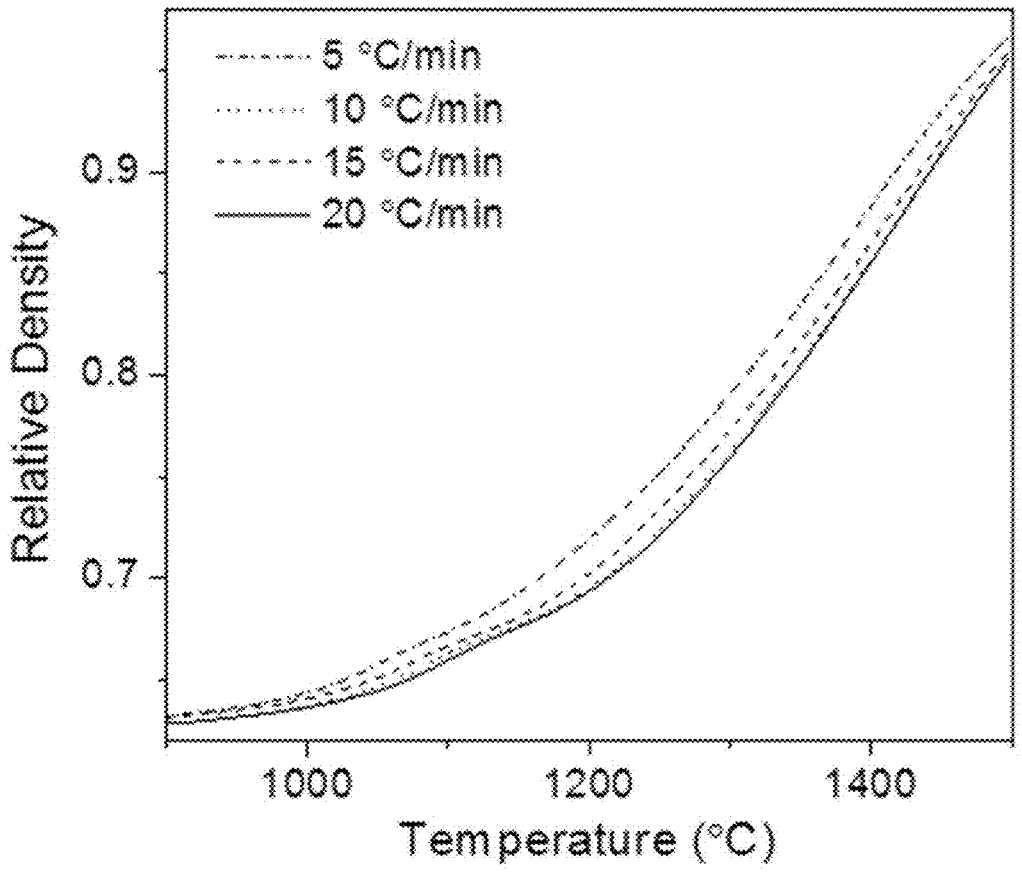
FIG. 45 depicts the relative density of W—Cr 15 at % as a function of temperature at a variety of heating rates in one embodiment.

The integral of instantaneous linear shrinkage rate during sintering can be represented as follows:

$$\int_{\rho_0}^{\rho} \frac{(G(\rho))^n}{3\rho\Gamma(\rho)}\,d\rho = \int_0^t \frac{\gamma\Omega D_0}{kT}\exp\left(-\frac{Q}{RT}\right)dt \tag{7}$$

where γ is the surface energy, Ω the atomic volume, R the gas constant, T the temperature, G the average grain size, t time, Γ the parameter which relate the driving force, mean diffusion distance, and other geometric features of the microstructures, $D_0=(D_v)_0$ and n=3 for volume diffusion, and $D_0=(\delta D_g)_0$ and n=4 for grain-boundary diffusion. With the slight rearrangement, 7 is divided into two parts:

$$\Phi(\rho)\ \frac{k}{\gamma\Omega D_0}\int_{\rho_0}^{\rho} \frac{(G(\rho))^n}{3\rho\Gamma(\rho)}\,d\rho \tag{8}$$

which comprises all microstructural and materials properties except for activation energy.

$$\Theta(t, T(t)) = \int_0^t \exp\left(-\frac{Q}{RT}\right)dt \tag{9}$$

which relies only on Q and heating time-temperature profile. The activation energy can be estimated by computing 9; the correct activation energy, Q, will make all of the data computed through 9 collapse onto a single curve. For assessing the sintering activation energy of nanocrystalline W-Cr 15 at %, their heating profiles with 5, 10, 15, 20° C./min shown in FIG. 45 which are required to calculate 9 were employed. As shown in FIG. 41, an activation energy of 373 kJ/mol causes the sintering curves of W—Cr 15 at % to collapse in to a single master sintering curve.

NON-LIMITING WORKING EXAMPLES

Materials and Methods

In one example, a tungsten powder with a particulate size of about 1-5 um and a purity of 99.9% is utilized as the first metal material.

In another example a high-energy ball mill is utilized to form nanocrystalline tungsten through mechanical milling. The ball milling may be conducted in an argon atmosphere in a glove box. The ball-milled material was formed in to green cylindrical disk compacts with a 6 mm diameter and about 3-4 mm height with an initial density of about 11.1-11.2 g/cm3 by compacting at a pressure of 360 MPa.

A thermodilatometer may be used to measure the change of dimensions of the sample according to temperature. The thermodilatometer may be operated with an atmosphere of $N_2/H_2$(4%) forming gas, $Ar/H_2$(3%), or flowing argon gas. The force on the pellet subjected to sintering for the purposes of measuring the change in sample dimensions was 100 mN.

In one example the sintering may be conducted in an atmosphere containing hydrogen, a vacuum, air, or an inert gas atmosphere. The sintering atmosphere may affect the sinterability of tungsten powder. Hydrogen-containing atmospheres may generally be used for sintering tungsten powder. A hydrogen containing atmosphere may produce a relatively high density material. Vacuum atmospheres may produce a sintered material with a modest density. In some instances, limited or no densification may be detected when an argon sintering environment is employed. Not to be bound by any particular theory, but a volatile vapor phase oxide hydrate of the tungsten particulates ($WO_2(OH)_2$) may develop during sintering in a vacuum or argon atmosphere, and the adsorption of the vapor phase on the surface of the tungsten particulates may result in low sinterability.

In one example, non-isothermal heating techniques may be used in the sintering process. For example, a constant rate of heating (CRH) technique may be employed. In one embodiment constant heating rates of 1 K/min, 3 K/min, 5 K/min, 7 K/min, 10 K/min, 12 K/min, 15 K/min or 20 K/min may be used. In another example an isothermal heating method may be employed.

The following non-limiting experimental examples were produced and analyzed.

Example 1

Figure 17:
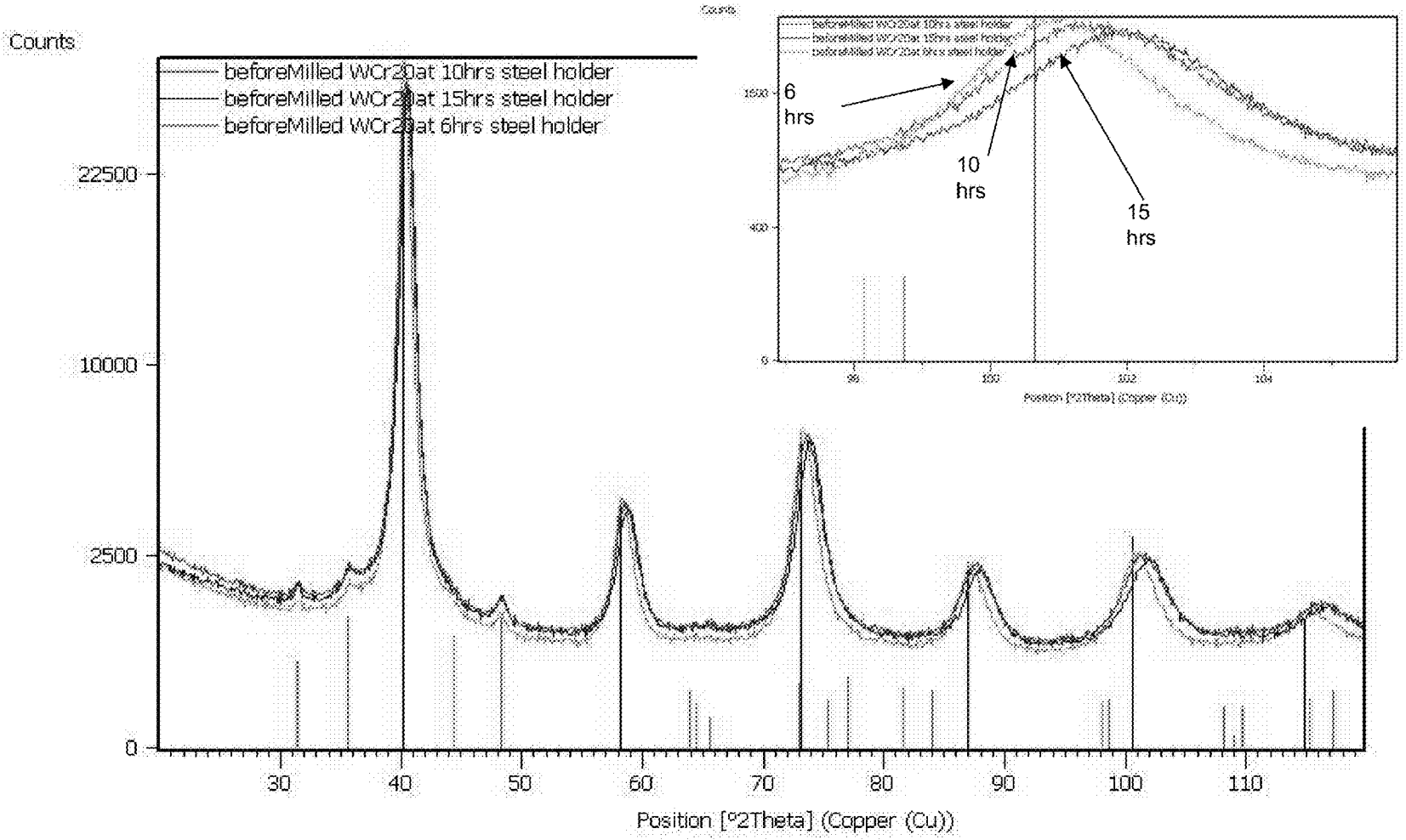
FIG. 17 depicts the X-ray diffraction patterns of W—Cr 20 at % at different milling times in one embodiment.
Figure 18:
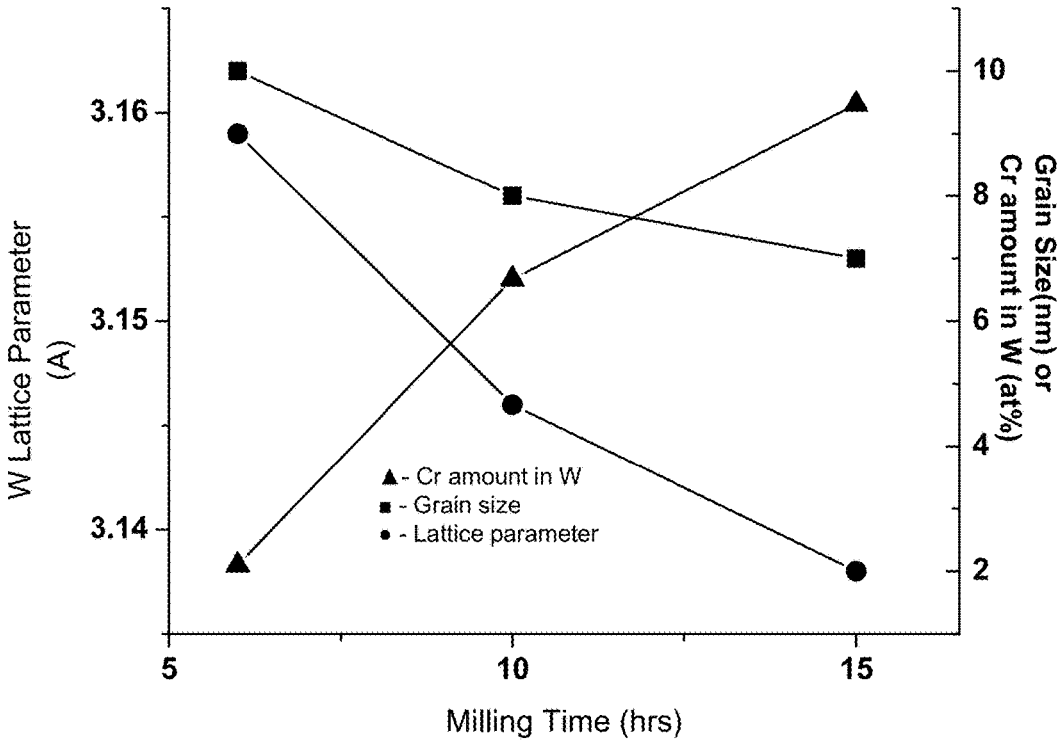
FIG. 18 depicts the grain size, lattice parameter, and amount of Cr in W as a function of milling time in one embodiment.
Figure 19:
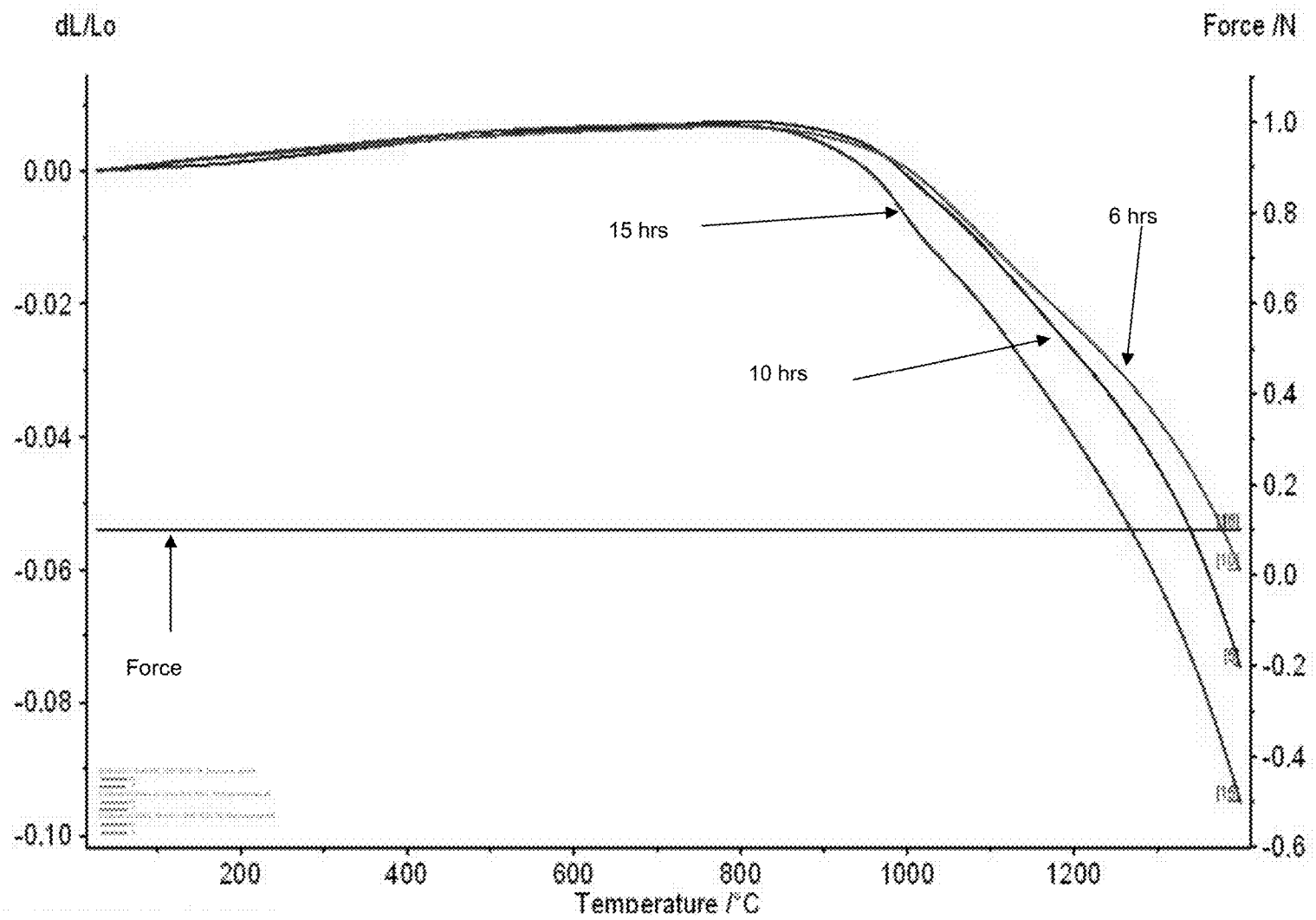
FIG. 19 depicts the effect of milling time on sintering behavior in one embodiment.

A tungsten powder containing 20 at % Cr was ball milled to produce nanocrystalline particulates. The nanocrystalline particulates were analyzed after 6 hours, 10 hours and 15 hours of ball milling. As shown in FIG. 17, the XRD peaks became broader with increasing ball-milling time. In addition, the grain size was found to decrease while the amount of Cr dissolved in the tungsten was found to increase with increasing ball milling time, as shown in FIG. 18. As shown in FIG. 19, the sintering temperature of the nanocrystalline particulates decreased as the ball-milling time increased and the amount of Cr dissolved in the tungsten increased. This indicates that an increased amount of the Cr activator material results in additional reductions in the sintering activation energy and sintering temperature. The sintering temperature of the W-20 at % Cr nanocrystalline particulates was about 1000° C. when a 3 K/min heating rate was employed. The amount of Cr dissolved in the tungsten was about 10 at %.

Figure 20:
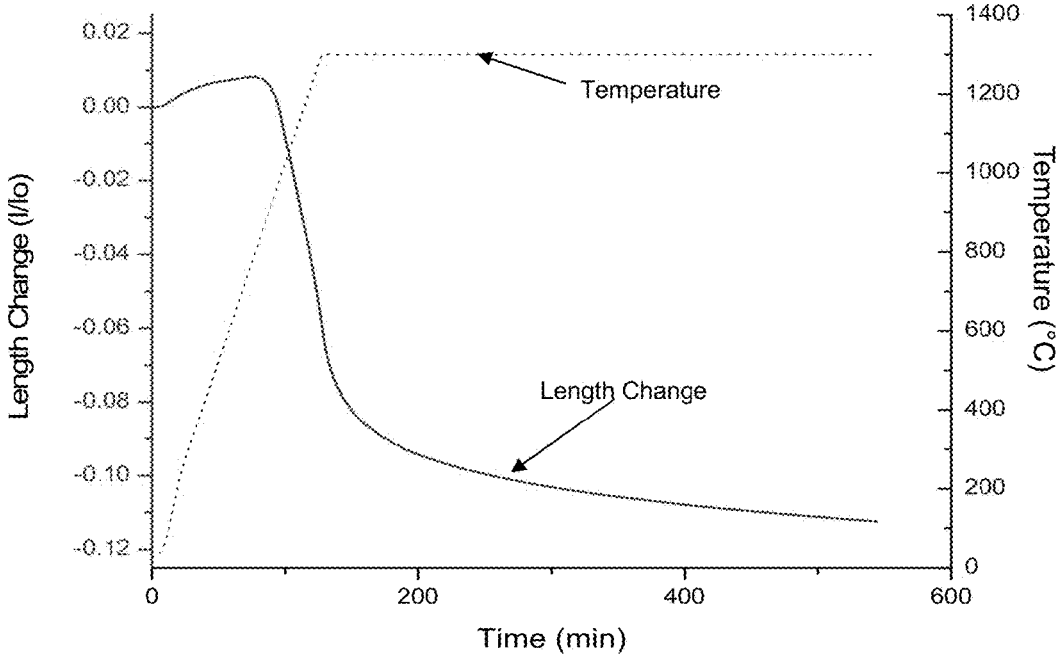
FIG. 20 depicts the sintering behavior of a W—Cr 20 at % material held at 1300° C. for seven hours in one embodiment.
Figure 25:
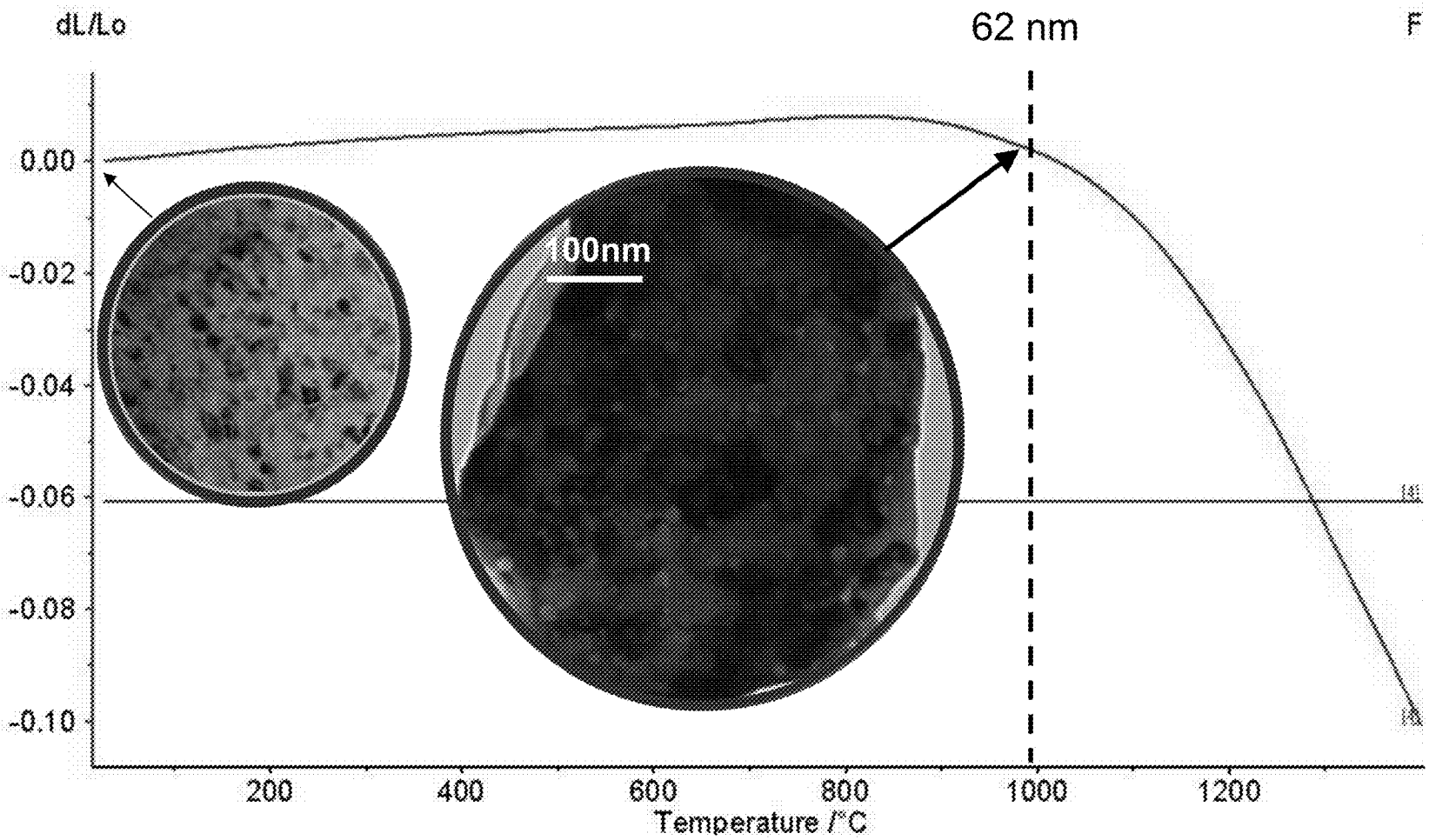
FIG. 25 depicts the grain size of a W—Cr 20 at % material at 1000° C. in the sintering process in one embodiment.
Figure 26:
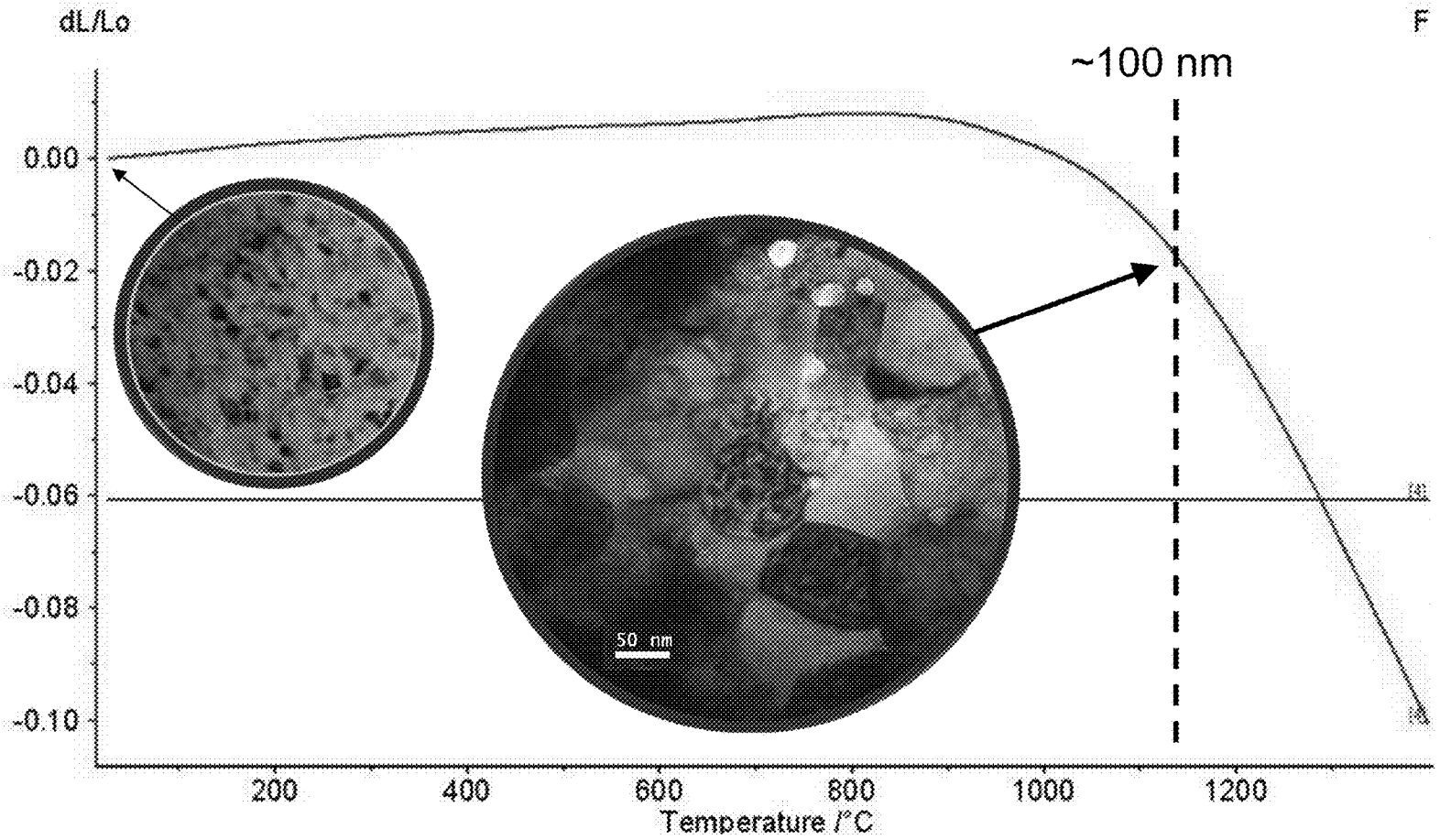
FIG. 26 depicts the grain size of a W—Cr 20 at % material at 1100° C. in the sintering process in one embodiment.
Figure 27:
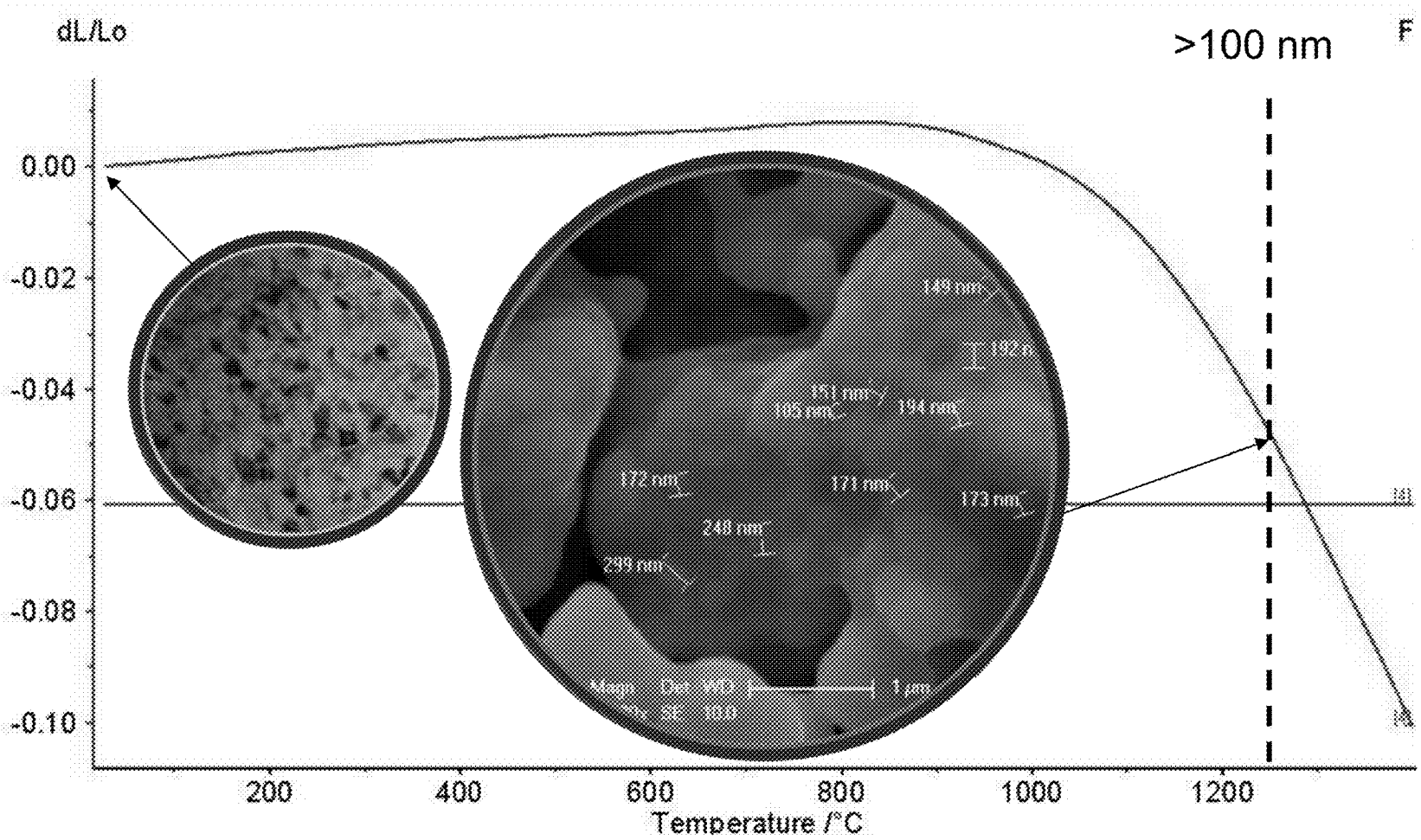
FIG. 27 depicts the grain size of a W—Cr 20 at % material at 1200° C. in the sintering process in one embodiment.
Figure 31:
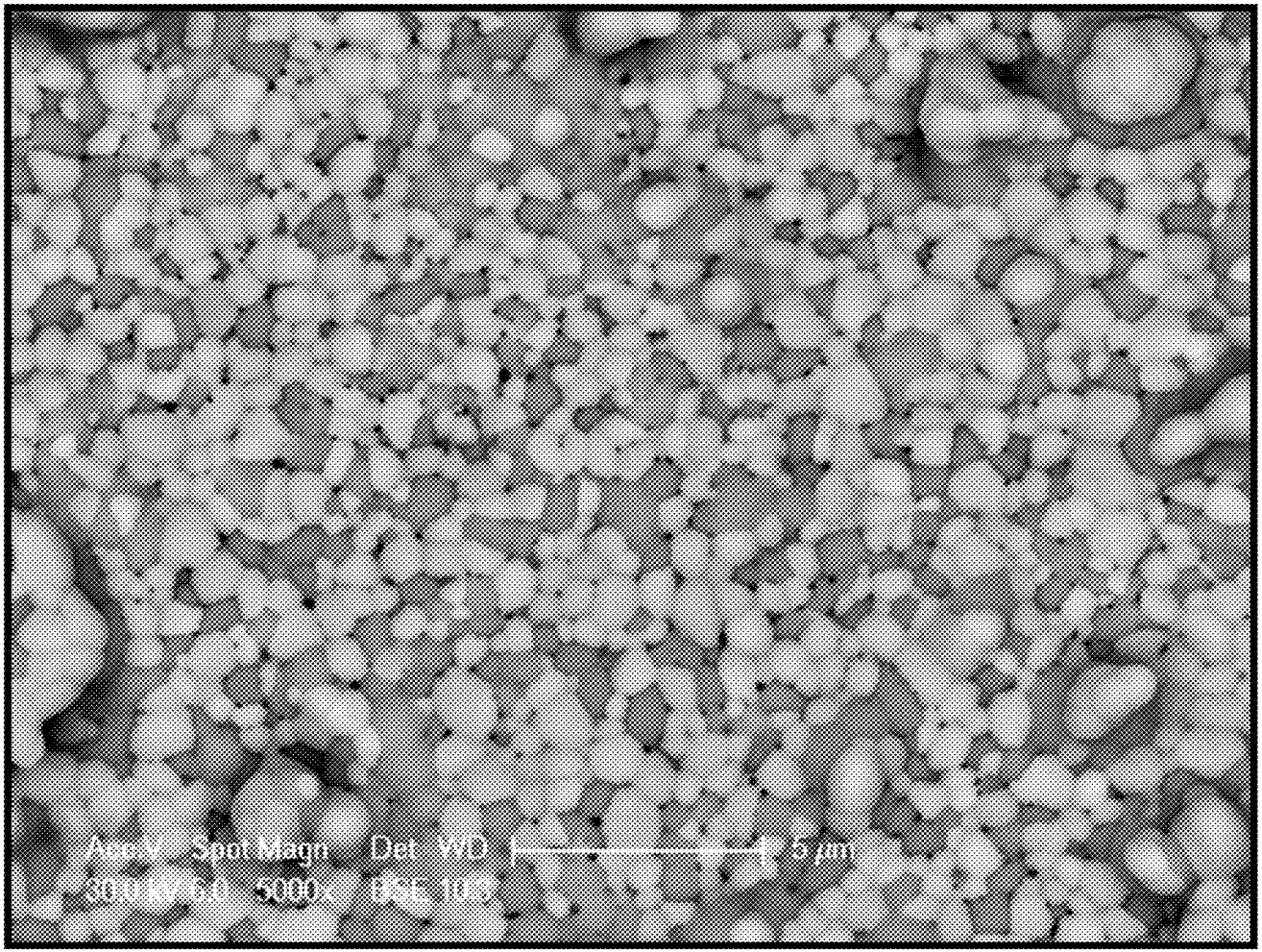
FIG. 31 depicts a W—Cr 20 at % material at the end of a sintering process in one embodiment.

When the W-20 at % Cr nanocrystalline particulates were sintered using an isothermal process at 1300° C., densification of greater than 90%, specifically about 91%, was achieved, as shown in FIG. 20. The W-20 at % Cr material exhibited a grain size of about 62 nm at 1000° C., about 100 nm at 1100° C., and greater than 100 nm at 1200° C. throughout the sintering process, as shown in FIGS. 25-27. The structure of the material after the completion of the sintering process is depicted in FIG. 31.

Figure 32:
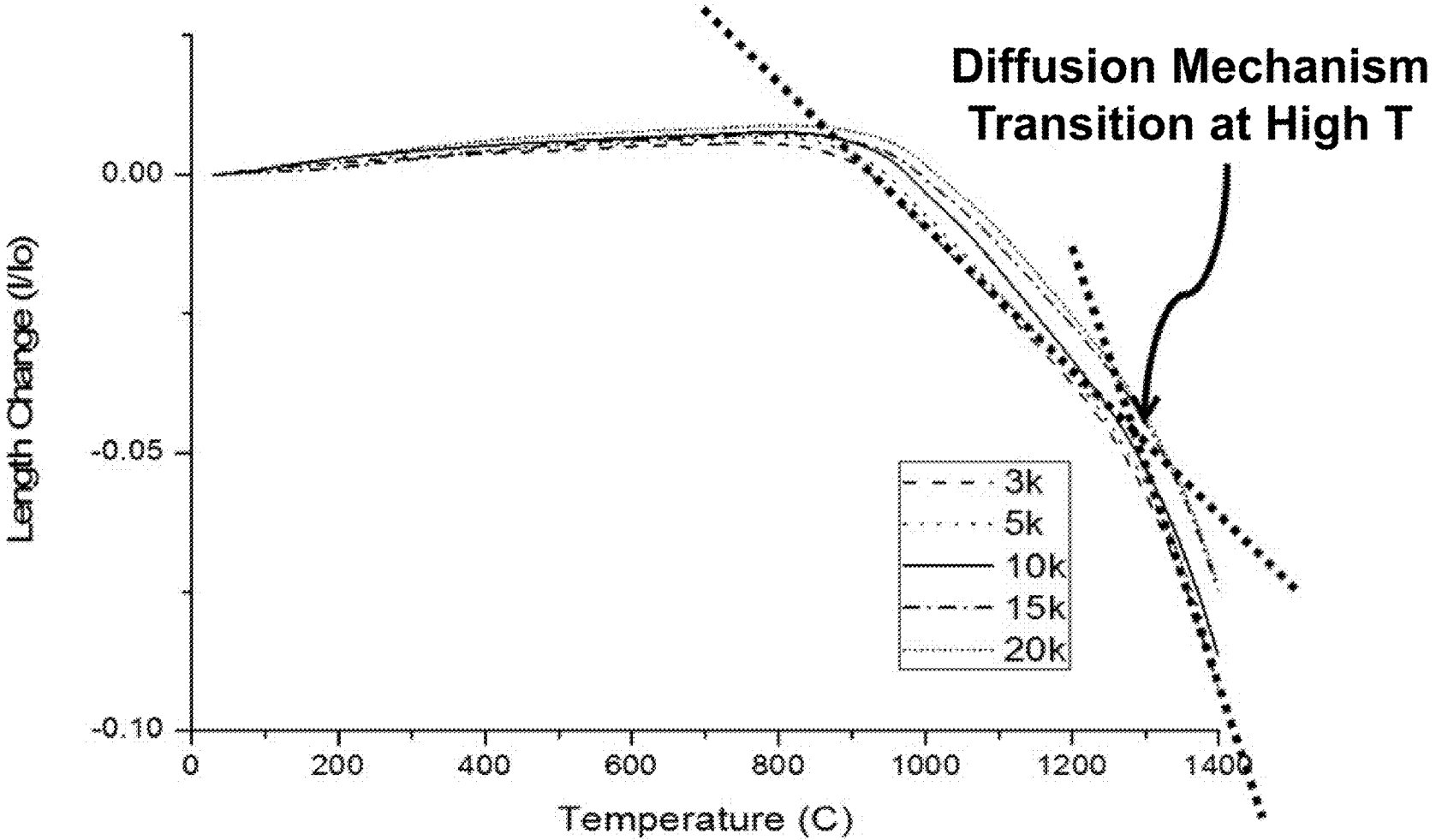
FIG. 32 depicts a sintering activation energy of a W—Cr 20 at % material in one embodiment.
Figure 36:
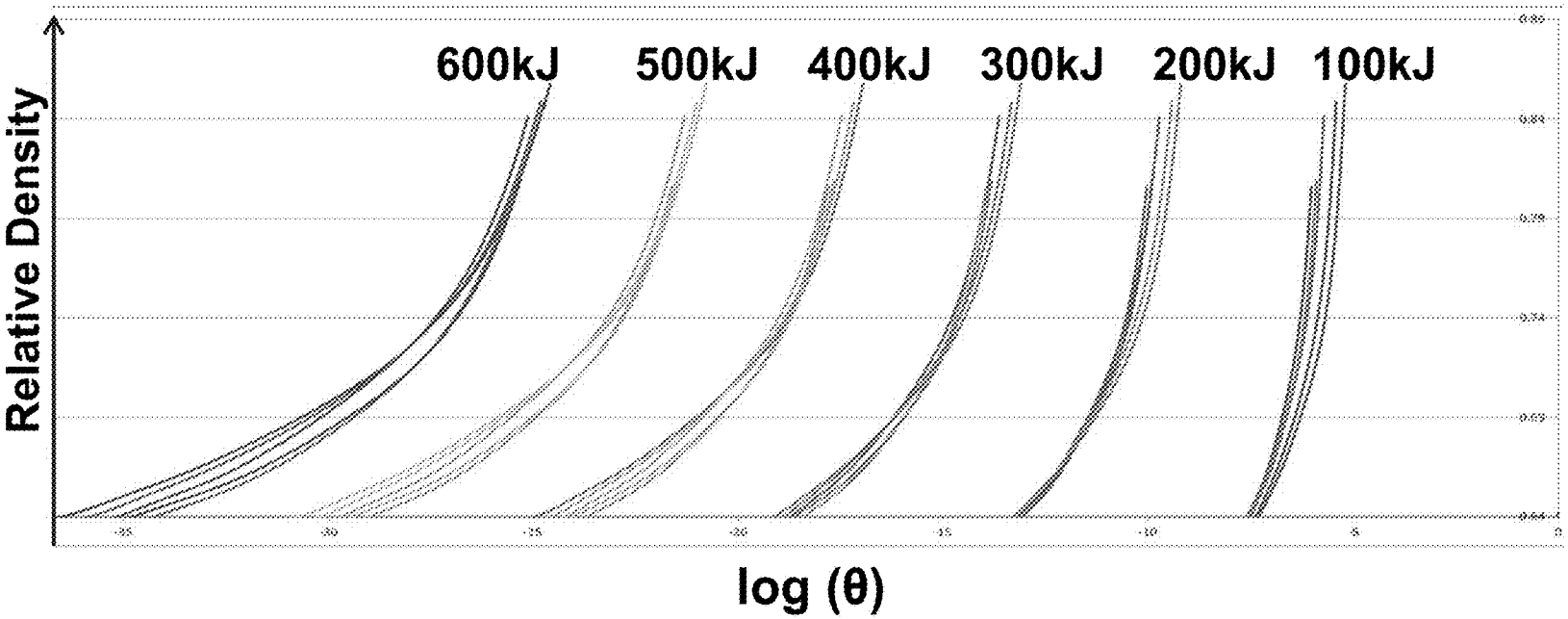
FIG. 36 depicts the sintering activation energy curves of a W—Cr 20 at % material calculated from the shrinkage data for various heating profiles and the degree to which the curves converge at different activation energy values in one embodiment.

The transition between an initial low density sintering mechanism and a second higher density intermediate sintering mechanism may be observed in FIG. 32 based on the change during sintering of the slope of the sintering length change curve. The transition in sintering mechanism may be from an initial mechanism in which the tungsten diffuses into and through the Cr to an intermediate tungsten volume diffusion mechanism. The sintering activation energy of the W-20 at % Cr particulates was determined for a variety of heating profiles from the raw shrinkage data, and is depicted in FIG. 36 as converted utilizing various activation energies as conversion factors. The sintering activation energy plots in FIG. 36 may converge to a single plot if the appropriate activation energy conversion factor is determined.

Figure 33:
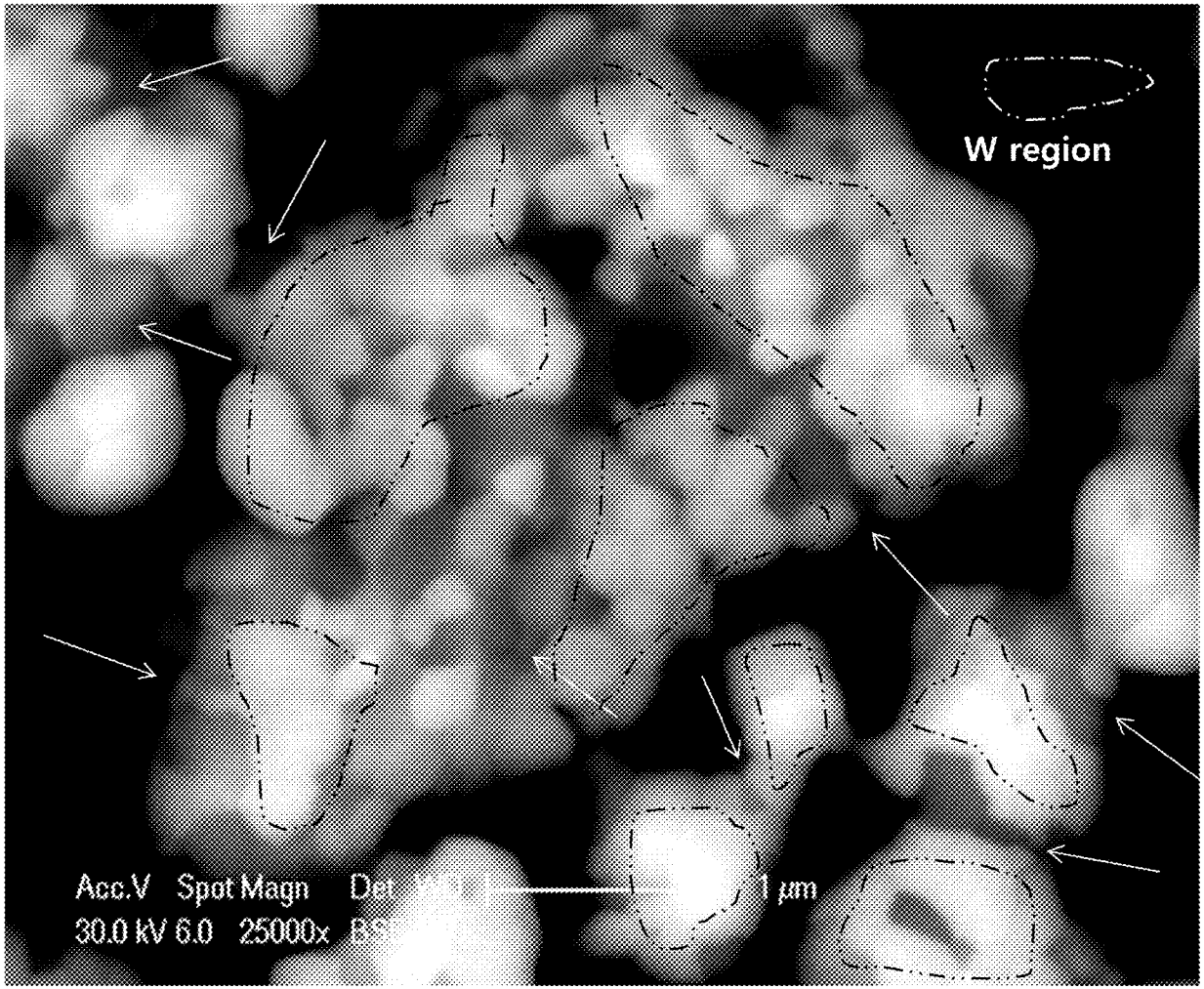
FIG. 33 depicts a back scattering SEM image of a W—Cr 20 at % material after heating to 1400° C. in one embodiment.
Figure 34:
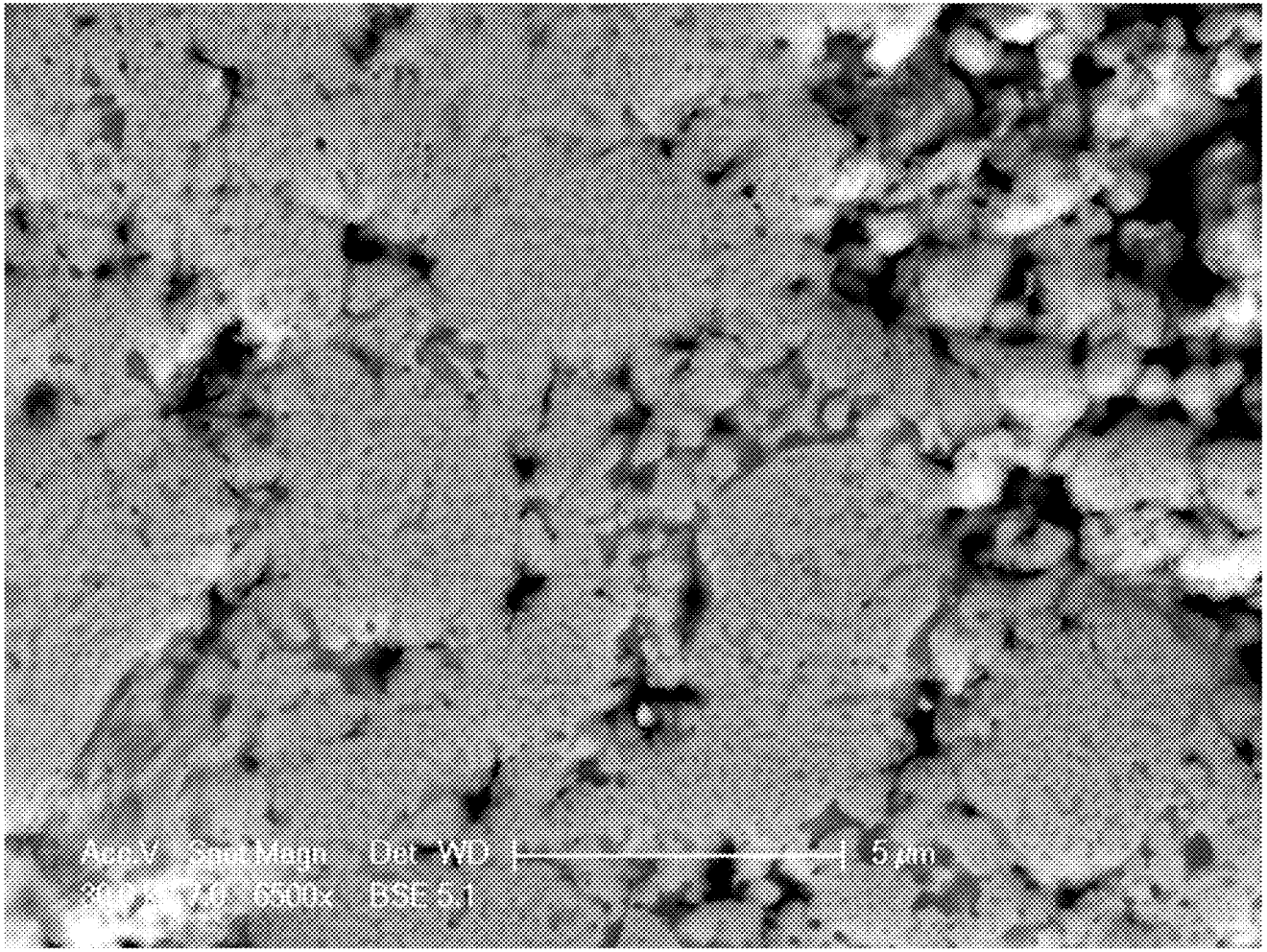
FIG. 34 depicts a back scattering SEM image of a polished W—Cr 20 at % material after heating to 1100° C. and holding for two hours in one embodiment.
Figure 35:
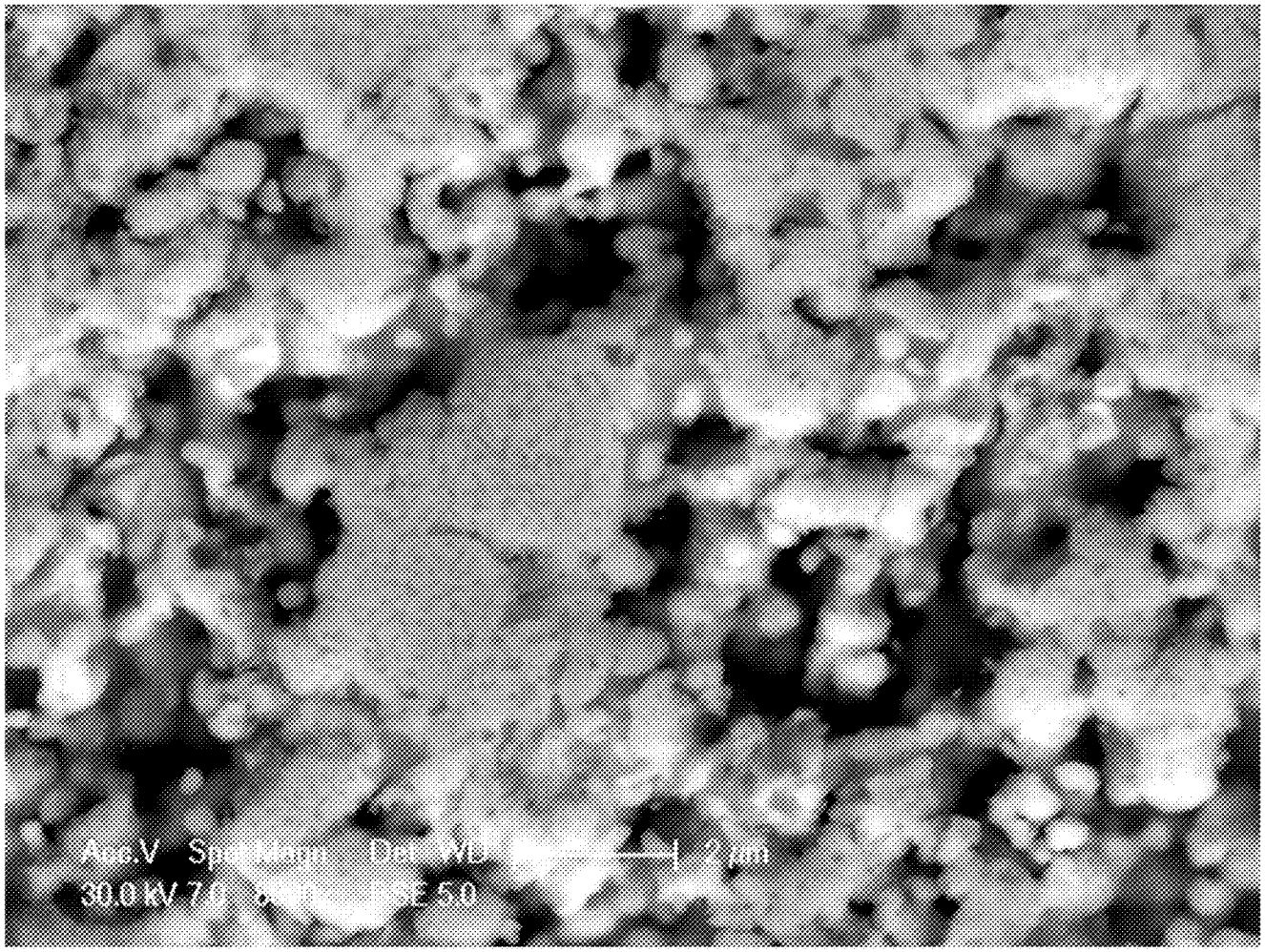
FIG. 35 depicts a back scattering SEM image of a polished W—Cr 20 at % material after heating to 1.100° C. and holding for two hours in one embodiment.

The formation of a Cr rich phase at the surface of the particulates of the W-20 at % Cr material after heating to 1400° C. is depicted in FIG. 33. The bright phase is the tungsten rich phase and the Cr rich phase is the dark phase between the tungsten rich phase particulates, as shown in FIG. 33. The microstructure of the W-20 at % Cr material after heating to 1.100° C. and holding for two hours is shown in FIGS. 34 and 35. The images depicted in FIGS. 34 and 35 were obtained after polishing the samples, and clearly show the Cr rich phase between the tungsten rich phase particulates.

Example 2

Figure 21:
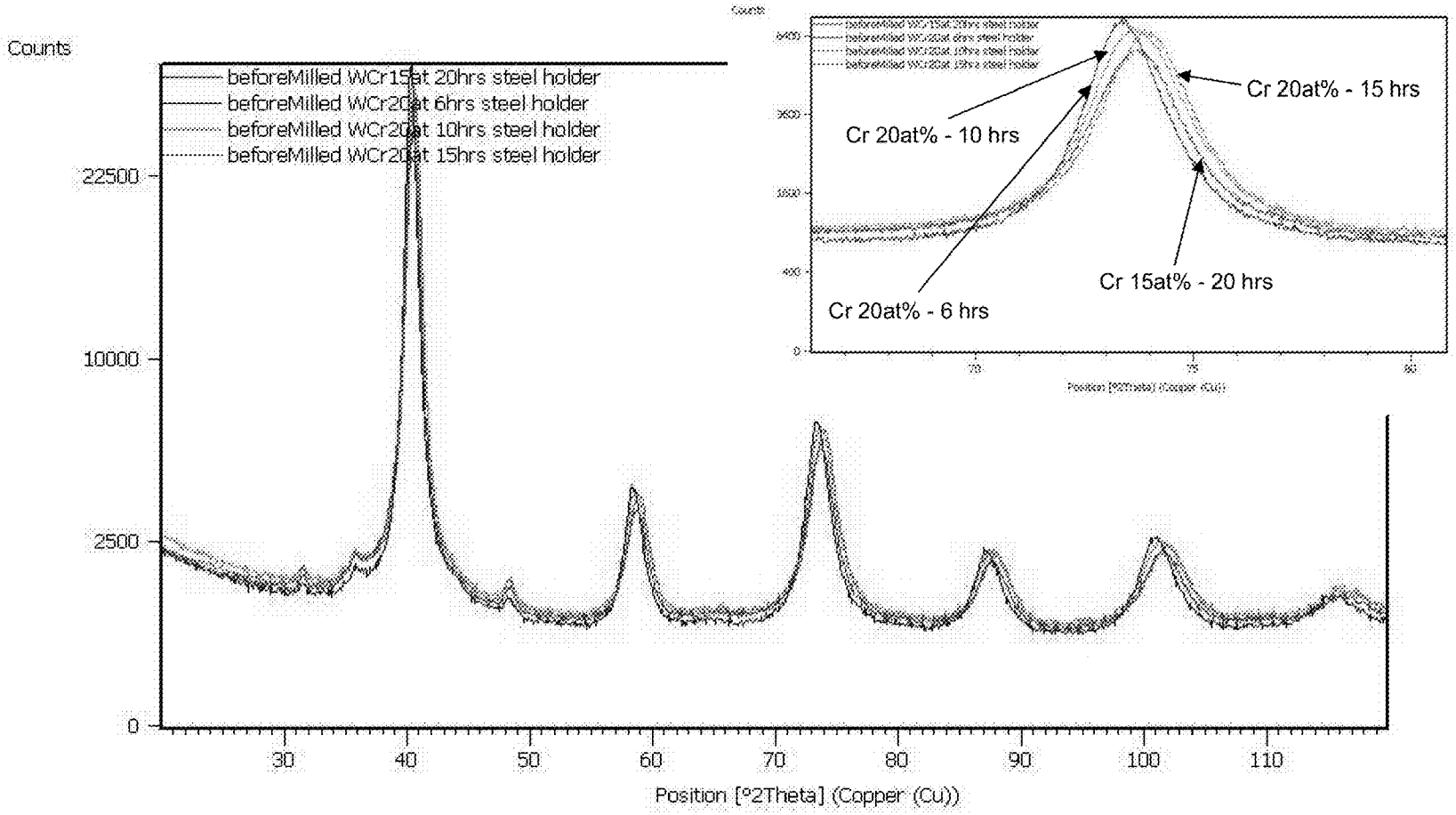
FIG. 21 depicts the X-ray diffraction patterns of a W—Cr 15 at % material at different milling times in one embodiment.

A tungsten powder containing 15 at % Cr was ball milled to produce nanocrystalline particulates. The nanocrystalline particulates were analyzed after 20 and 30 hours of ball milling. The W-15 at % Cr nanocrystalline particulates demonstrated the XRD peak broadening and peak shift characteristics of a supersaturated nanocrystalline phase, as shown in FIG. 21. The amount of Cr dissolved in the tungsten was approximately 6.5 at %.

Figure 22:
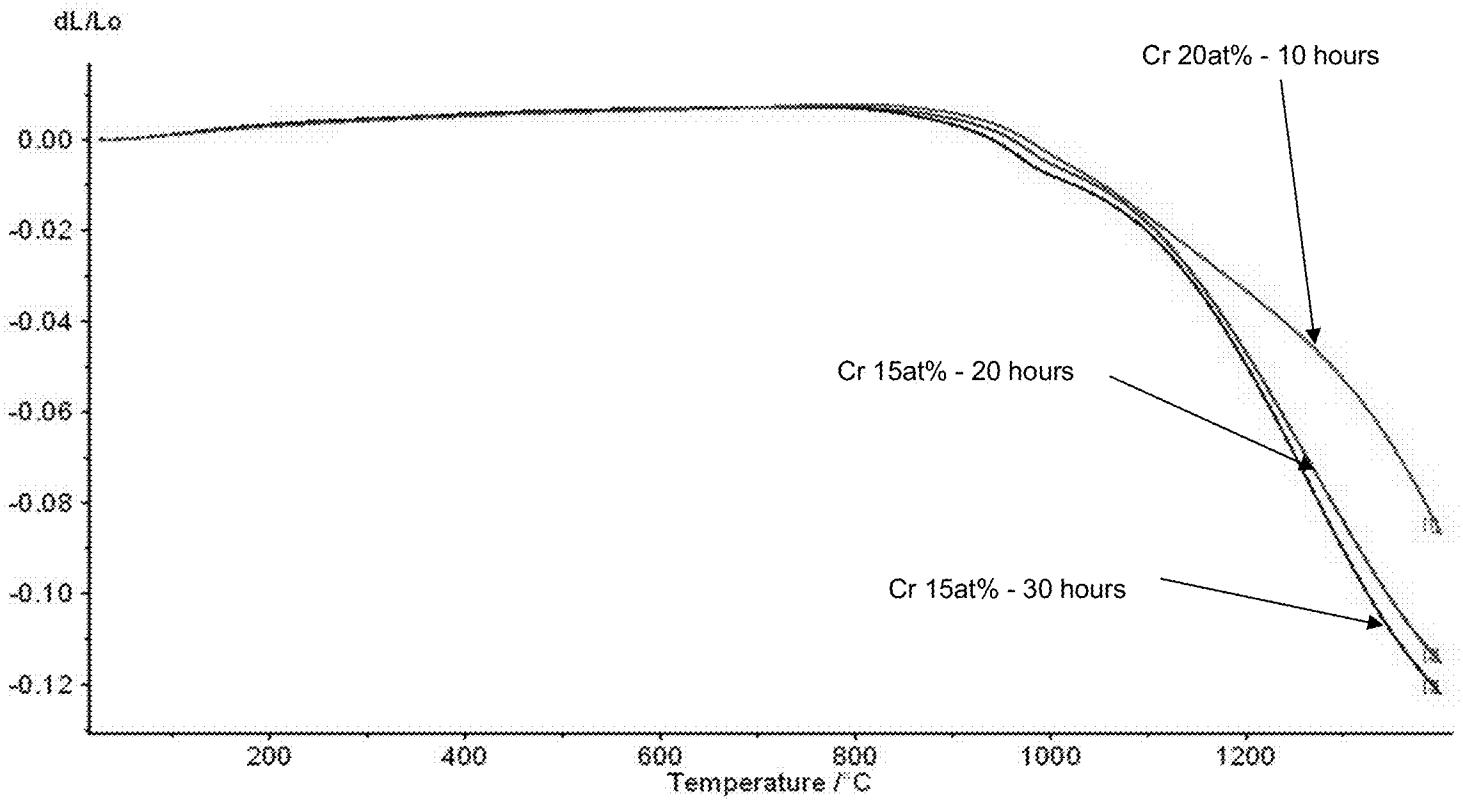
FIG. 22 depicts the effect of milling time on sintering behavior in one embodiment.

The nanocrystalline particulates exhibited improved densification behavior upon sintering compared to W-20 at % Cr nanocrystalline particulates that were ball milled for 10 hours, and the nanocrystalline particulates that were ball milled for 30 hours demonstrated slightly improved densification performance in comparison to the nanocrystalline particulates that were ball milled for 20 hours, as shown in FIG. 22.

Figure 23:
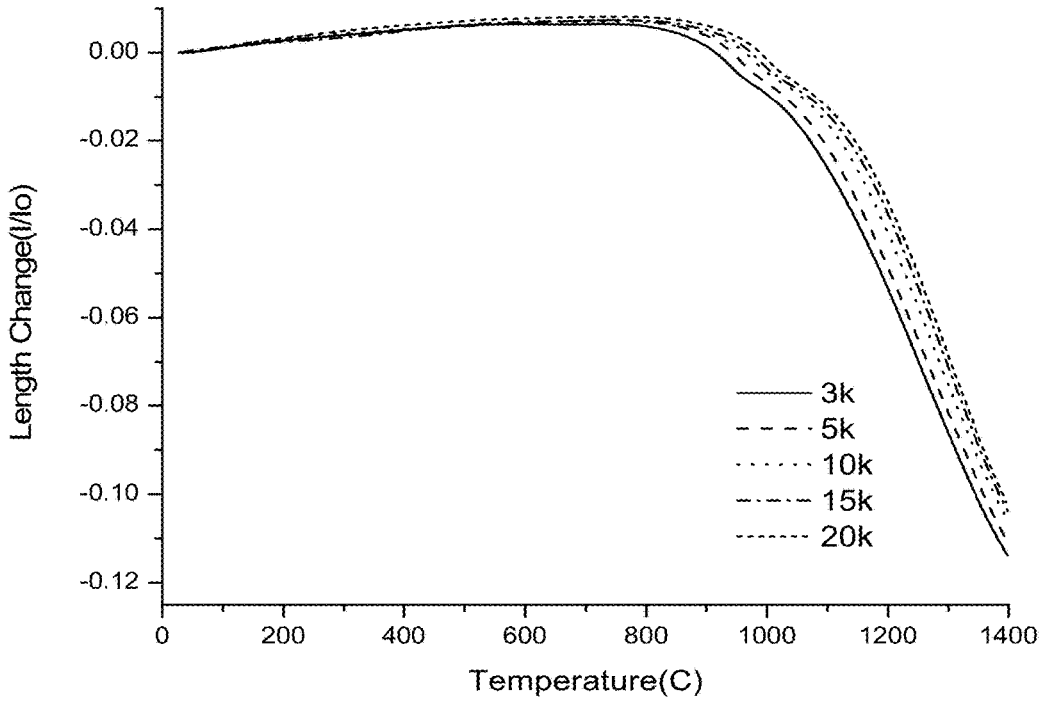
FIG. 23 depicts the sintering activation energy of a W—Cr 15 at % material at different heating rates in one embodiment.
Figure 37:
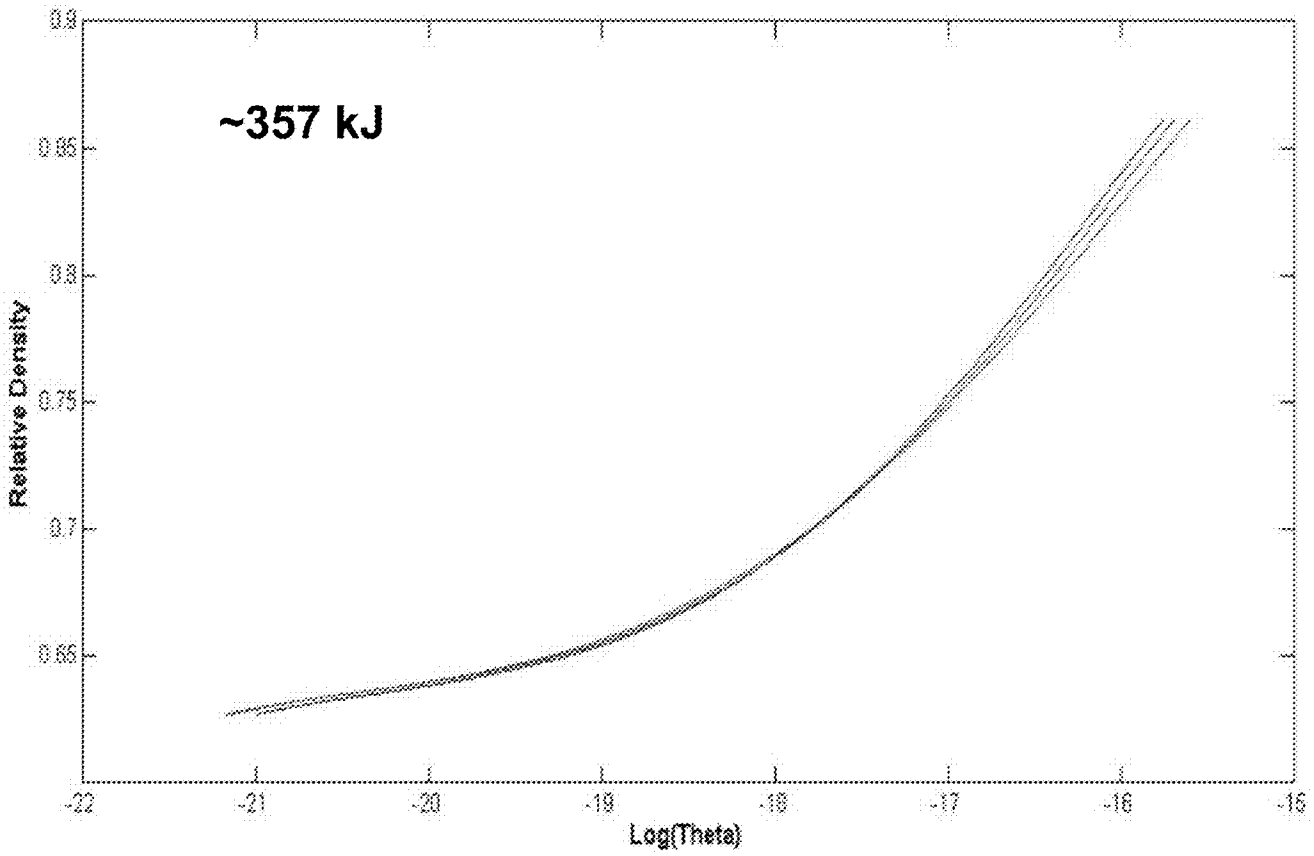
FIG. 37 depicts the activation energy curves of a W—Cr 15 at % material calculated from the shrinkage data for various heating profiles converging at an activation energy value of about 357 kJ in one embodiment.
Figure 38:
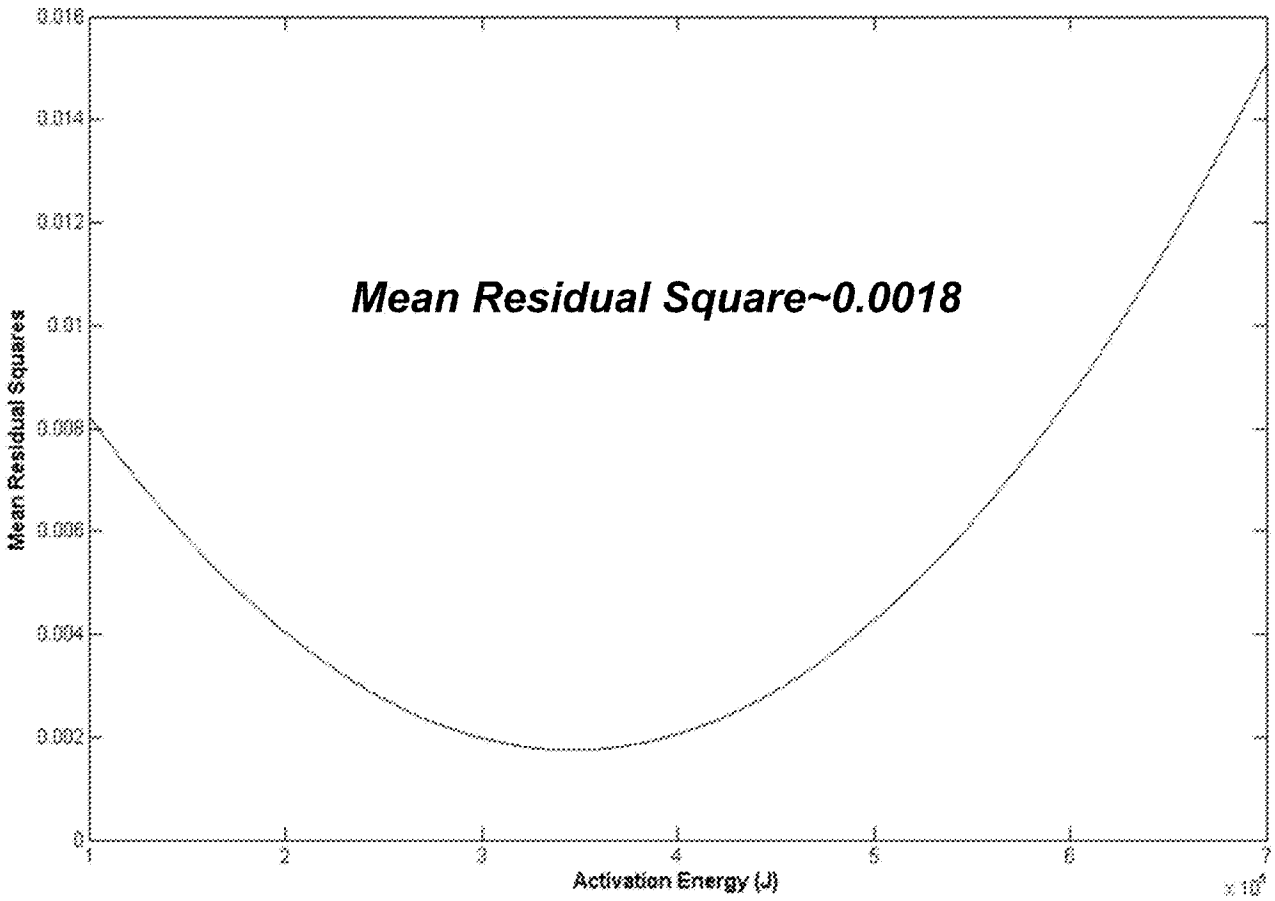
FIG. 38 depicts a plot of the mean residual squares value of the activation energy curves depicted in FIG. 37 as a function of activation energy in one embodiment.

The sintering activation energy of the 15 at % Cr nanocrystalline particulates was determined for a variety of heating rates, including 3 K/min, 5 K/min, 10 K/min, 15 K/min, and 20 K/min, and the result is shown in FIG. 23. The sintering temperature of the W-15 at % Cr nanocrystalline particulates was about 1000° C. when a 3 K/min heating rate was employed. The activation energy curves for the heating rates shown in FIG. 23 were calculated from the shrinkage data, and, as shown in FIG. 37, the curves converged at an activation energy value of about 357 kJ. The convergence of the curves shown in FIG. 37 at an activation energy of about 357 kJ was confirmed by determining that root mean squares value of the activation energy curves in FIG. 37 exhibited a minimum at an activation energy of about 357 kJ, as shown in FIG. 38.

Example 3

Figure 24:
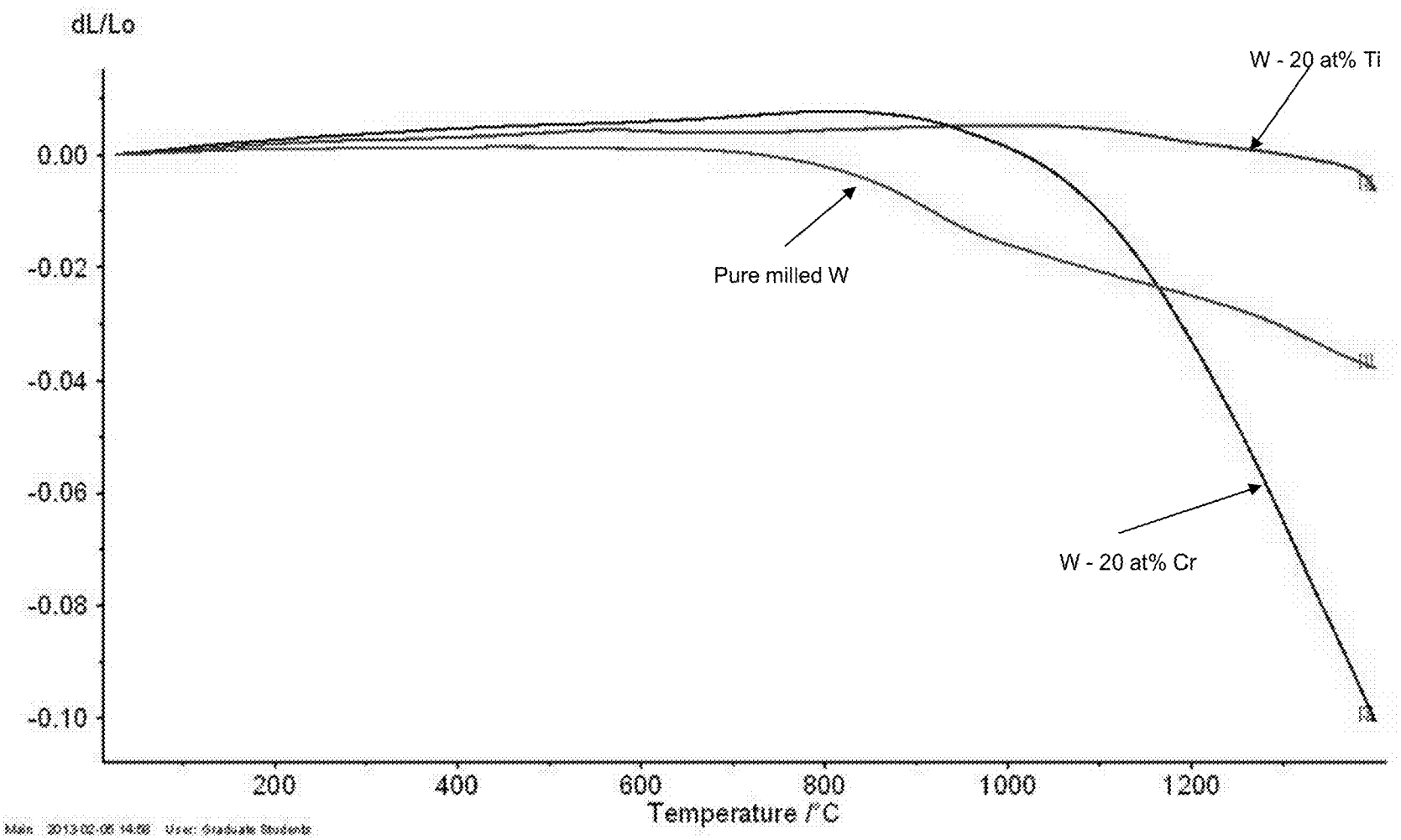
FIG. 24 depicts the sintering behavior of milled W, W—Cr 20 at %, and W—Ti 20 at % materials in one embodiment.

A tungsten powder containing 20 at % Ti was ball milled to form nanocrystalline particulates and then sintered. The nanocrystalline particulates exhibited inferior sintering behavior compared to pure tungsten nanocrystalline particulates and W-20 at % Cr nanocrystalline particulates, as demonstrated in FIG. 24.

Example 4

Figure 28:
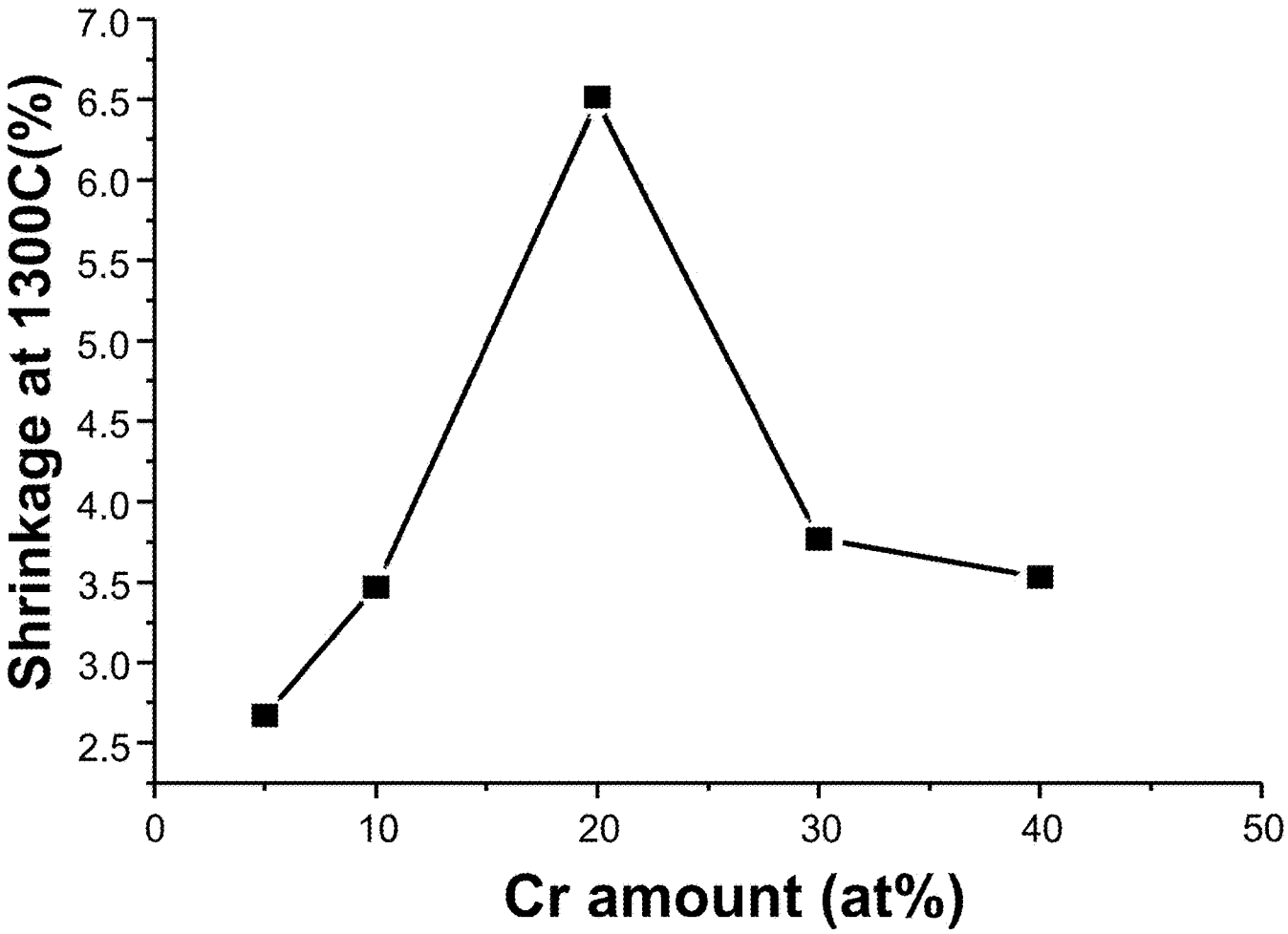
FIG. 28 depicts the shrinkage of tungsten with various amounts of Cr at 1300° C. in one embodiment.

In this example, tungsten powder mixtures containing Cr in an amount of about 5 at %, about 10 at %, about 20 at %, about 30 at %, and about 40 at % were ball milled for 10 hours and then sintered at 1300° C. The shrinkage of the samples, as shown in FIG. 28, indicates that there is an optimal amount of Cr for improving the sintering kinetics of tungsten, and that the optimum Cr content may be in the range of about 20 at %.

Example 5

Figure 29:
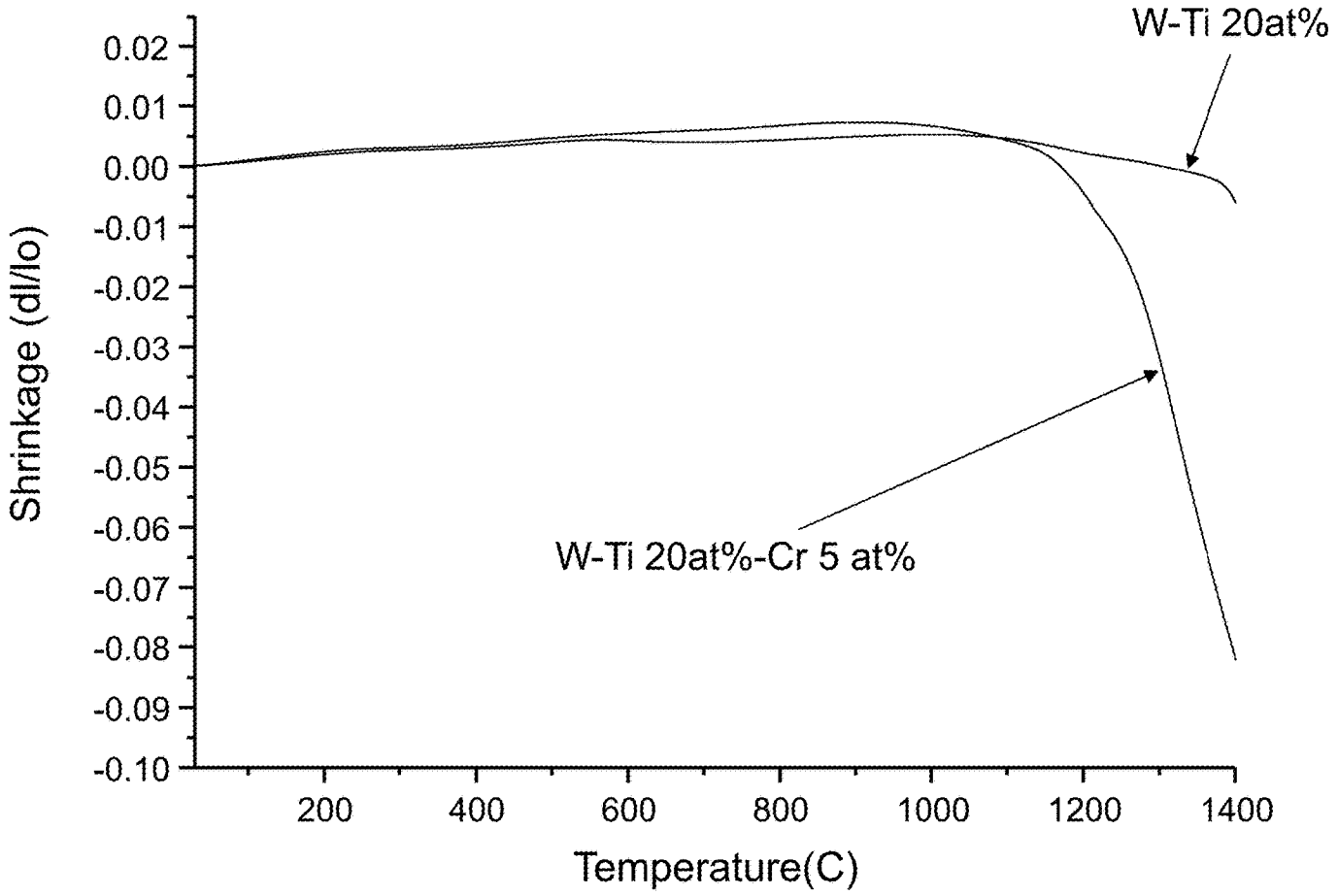
FIG. 29 depicts the sintering behavior of a W—Ti 20 at % material and a W—Ti 20 at %-Cr 5 at % material in one embodiment.
Figure 30A:
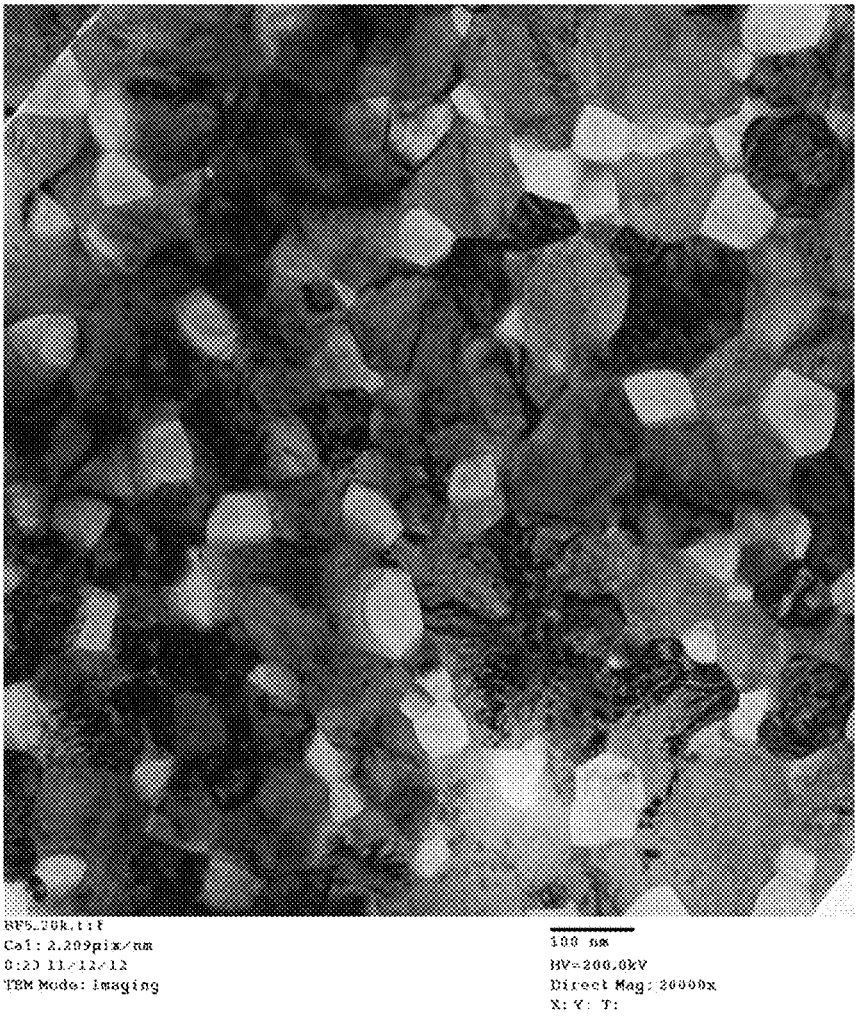
FIGS. 30(*a*)-30(*f*) depict, respectively, a bright field TEM image of a W—Ti 20 at %-Cr 5 at % sintered material in one embodiment, a dark field STEM image of a W—Ti 20 at %-Cr 5 at % sintered material in one embodiment, a dark field STEM image of a W—Ti 20 at %-Cr 5 at % sintered material with the Cr phases highlighted in one embodiment, a dark field STEM image of a W—Ti 20 at %-Cr 5 at % sintered material with the W phases highlighted in one embodiment, a dark field STEM image of a W—Ti 20 at %-Cr 5 at % sintered material with the Ti phases highlighted in one embodiment, and a dark field STEM image of a W—Ti 20 at %-Cr 5 at % sintered material with the Cr, W, and Ti phases highlighted in one embodiment.
Figure 30B:
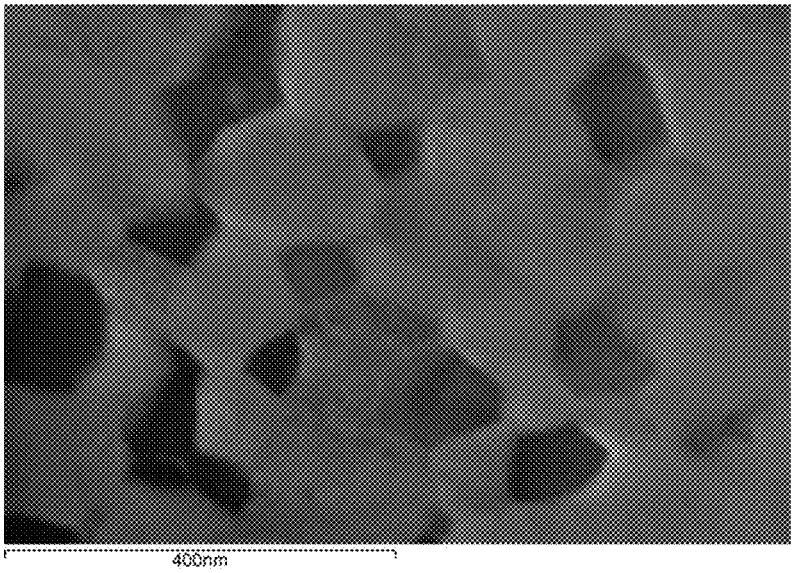
Figure 30C:
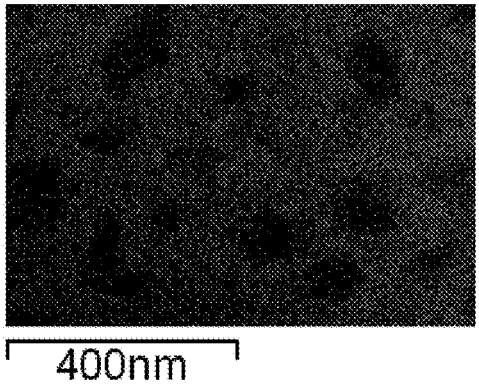
Figure 30D:
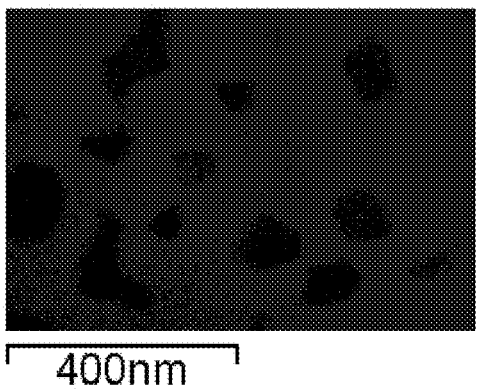
Figure 30E:
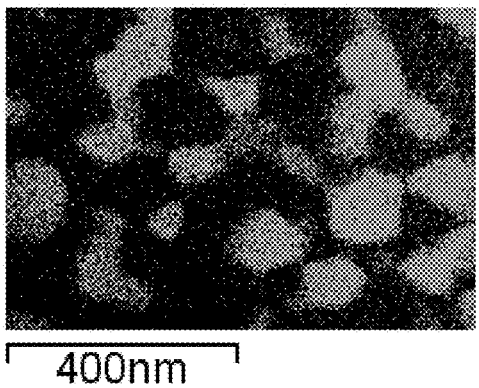
Figure 30F:
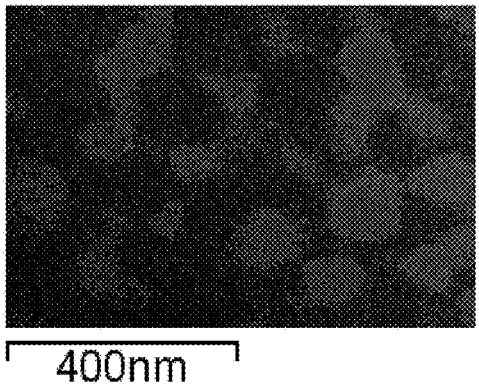

In this example, a W—Ti 20 at %-Cr 5 at % powder mixture was ball milled and then sintered by heating to 1300° C. The sintering behavior indicates that the Cr acts as an activator even in the presence of Ti, as shown in FIG. 29. The nanostructure of the sintered material is depicted in FIGS. 30(*a*)-(*f*). The data indicates that the W—Ti—Cr sintered material may be fully densified while maintaining a nanocrystalline grain size.

Example 6

Figure 39:
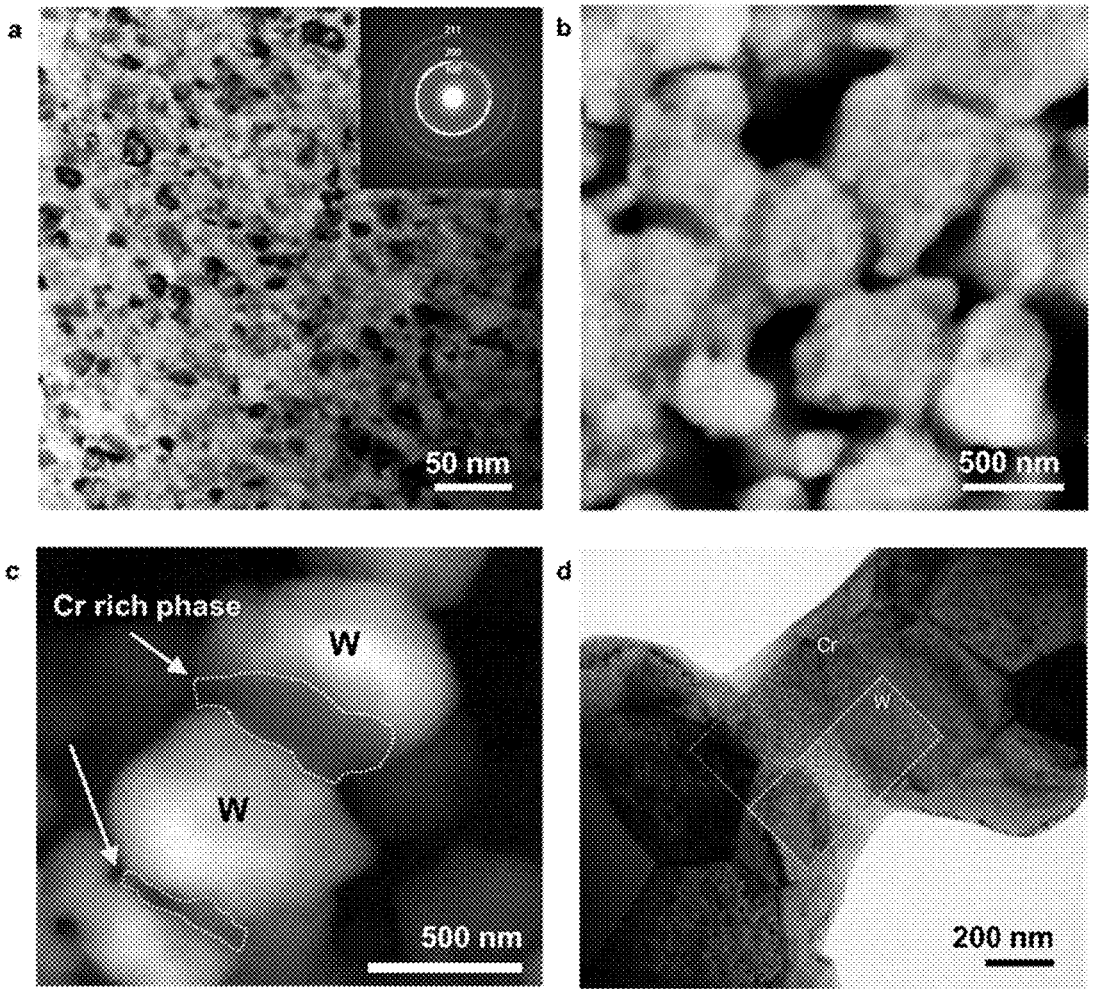
FIGS. 39(*a*)-39(*d*) depict, respectively, a bright-field TEM image of an as-milled for 20 hours W—Cr 15 at % material with the inset being a selected-area diffraction pattern of the material in one embodiment, a back-scattered SEM image of a chromium-rich phase precipitated from supersaturated tungsten after heating to 1100° C. in one embodiment, a back-scattered SEM image of necks formed between particles after heating to 1200° C. in one embodiment, and a bright-field TEM image of a Cr-rich neck adjacent to W-rich particles.

In this example, a W—Cr 15 at % mixture was ball milled to produce a supersaturated powder in which Cr is fully dissolved in W, with an average particle diameter of about 1 micron and an average grain size of about 13 nm, as shown in FIG. 39(*a*). The Debye-Scherrer ring of the powder indexed as being a BCC solid solution, as shown in the inset of FIG. 39(*a*).

The powder was heated to 1100° C., and a Cr-rich phase precipitated from the supersaturated W-rich phase and formed small Cr domains on the surface of the particles, as shown in FIG. 39(*b*). The powder was then heated to a temperature of 1200° C. and necks of a Cr-rich phase were formed between the particles, as shown in FIG. 39(*c*). FIG. 39(*d*) shows a Cr-rich neck adjacent to W-rich particles with a W and Cr elemental map produced using scanning transmission electron microscopy with energy dispersive spectroscopy (STEM-EDS) overlaid on the image.

Example 7

Figure 43:
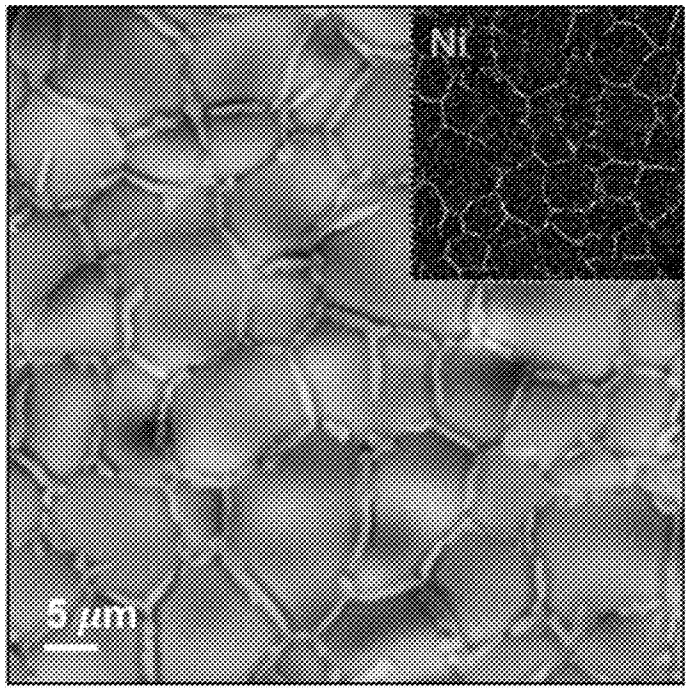
FIGS. 43(*a*) and 43(*b*) depict, respectively, relative density changes of Cr—Ni systems as a function of temperature in one embodiment, and a back-scattered SEM image of Cr—Ni 15 at % after sintering at 1200° C. with an inset of a Ni elemental map produced by energy dispersive spectroscopy (EDS) in one embodiment.
Figure 43:
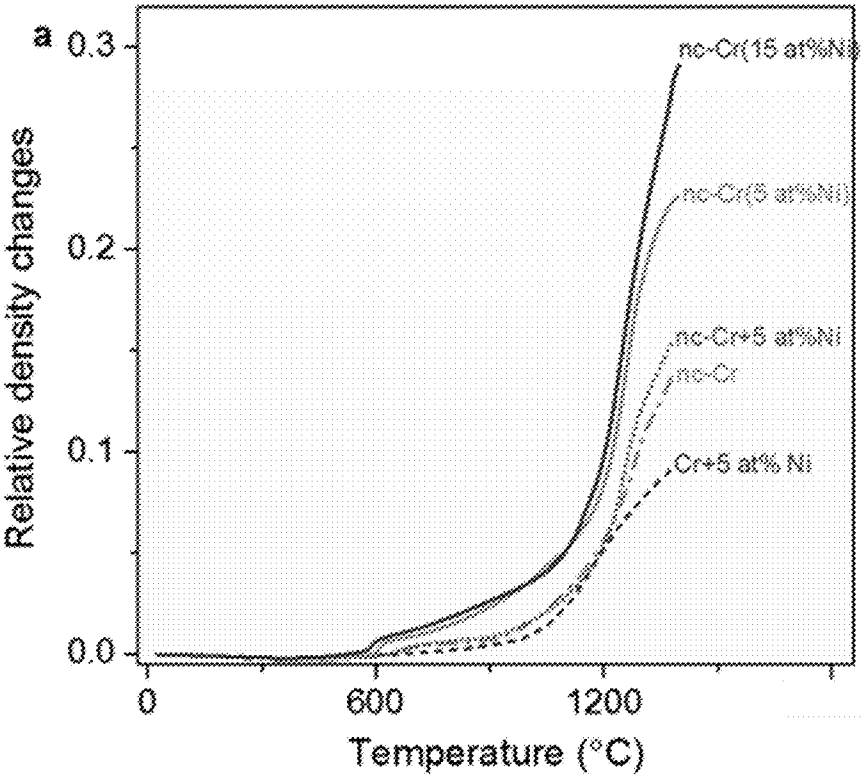

In this example, Cr—Ni 5 at % and Cr—Ni 15 at % samples were ball milled and then sintered. FIG. 43(*a*) depicts the relative density changes of the samples in addition to comparative examples of nanocrystalline Cr mixed with 5 at % Ni (nc-Cr+5 at % Ni), nanocrystalline Cr (nc-Cr), and a mixture of Cr and 5 at % Ni (Cr+5 at % Ni). FIG. 43(*b*) shows the microstructure of the Cr—Ni 15 at % sample includes Ni precipitated around Cr necks that act as fast transport layers after sintering at 1200° C., with the inset being an energy-dispersive spectroscopy (EDS) map showing local Ni content.

Figure 46:
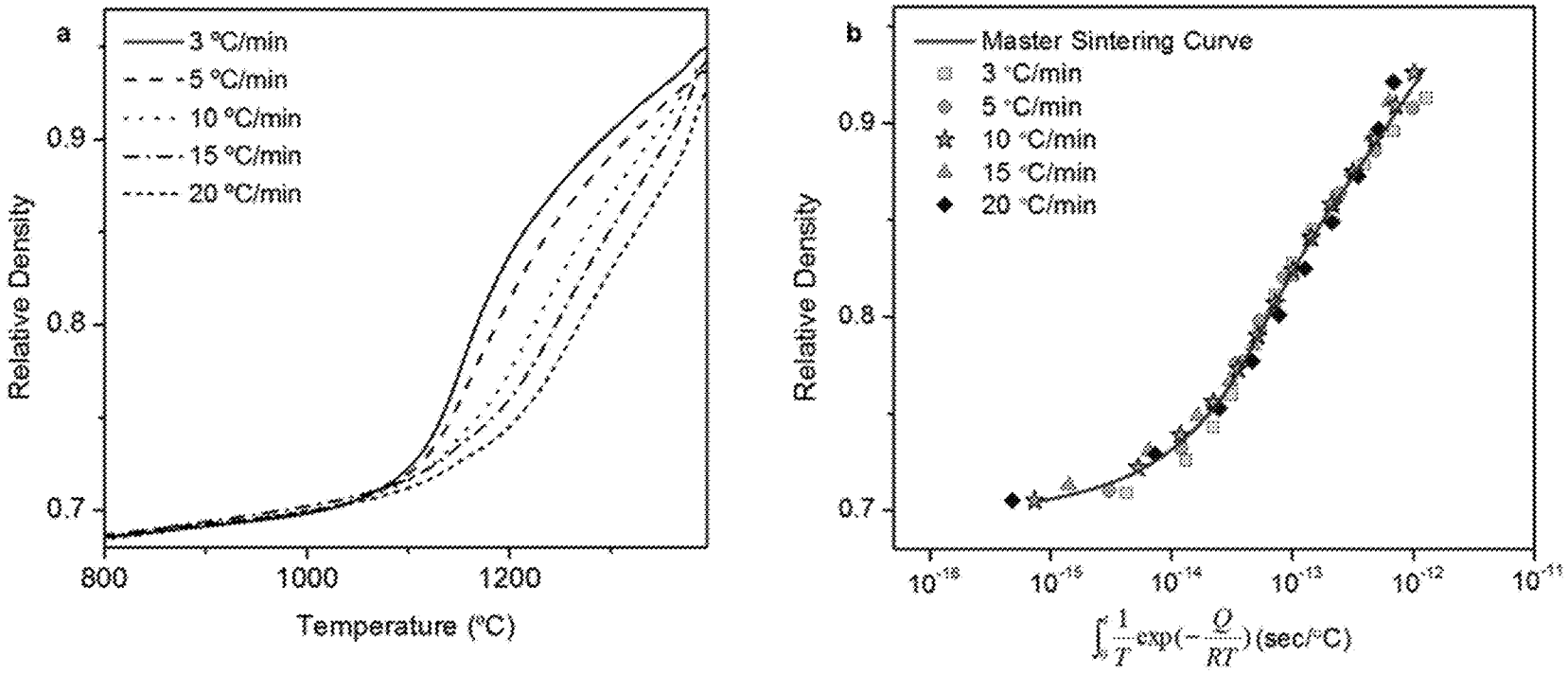
FIGS. 46(*a*) and 46(*b*) depict, respectively, relative density of Cr—Ni 15 at % as a function of temperature at a variety of heating rates in one embodiment, and the master sintering curve Cr—Ni 15 at % in one embodiment.
Figure 47:
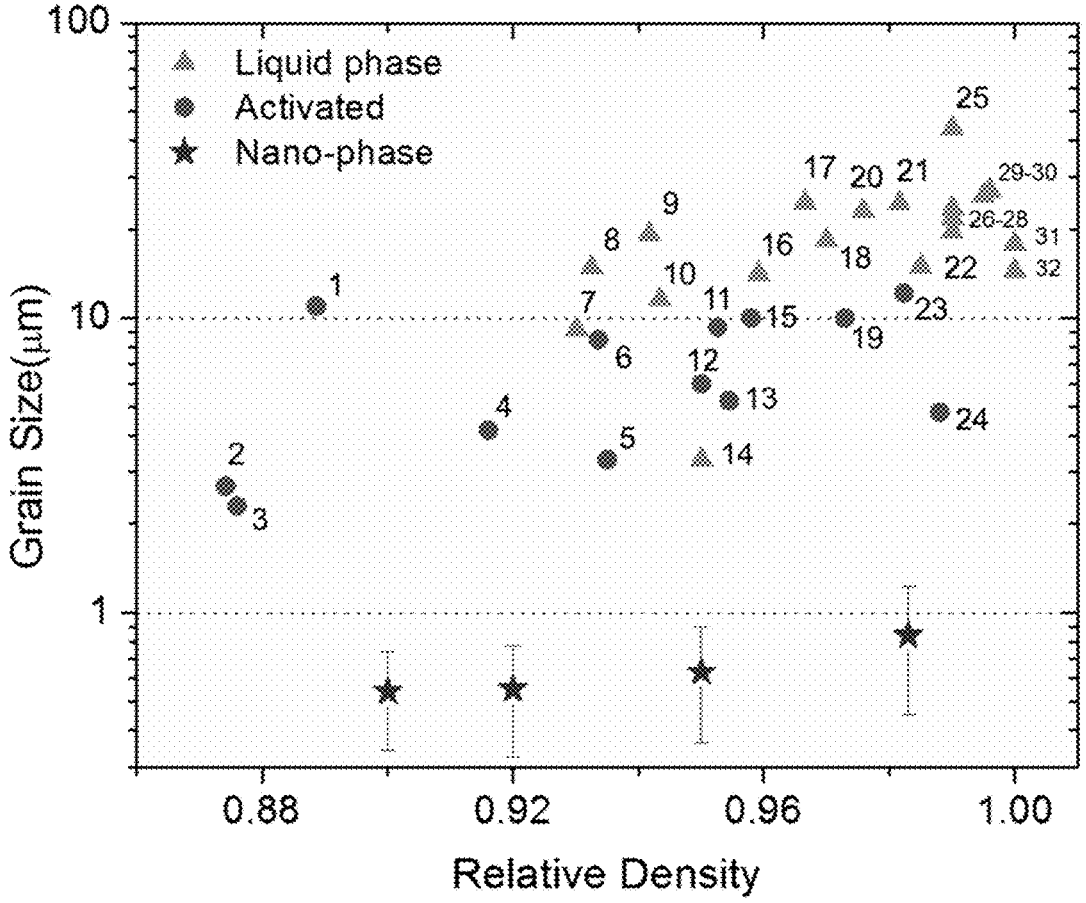
FIG. 47 depicts grain size as a function of relative density for a variety of sintered tungsten alloys.

FIG. 46(*a*) depicts the relative density of Cr—Ni 15 at % as a function of temperature with a variety of heating rates. As shown in FIG. 46(*b*), the heating profiles collapse to a master sintering curve at a sintering activation energy of 258 kJ/mol. The sintering activation energy of 258 kJ/mol matches the activation energy for diffusion of Cr in Ni, 272 kJ/mol, and is distinct from the activation energy for self-diffusion of Cr, 442 kJ/mol. As a result, the data indicates that the Cr—Ni 15 at % material undergoes nano-phase separation sintering.

Example 8

Figure 44:
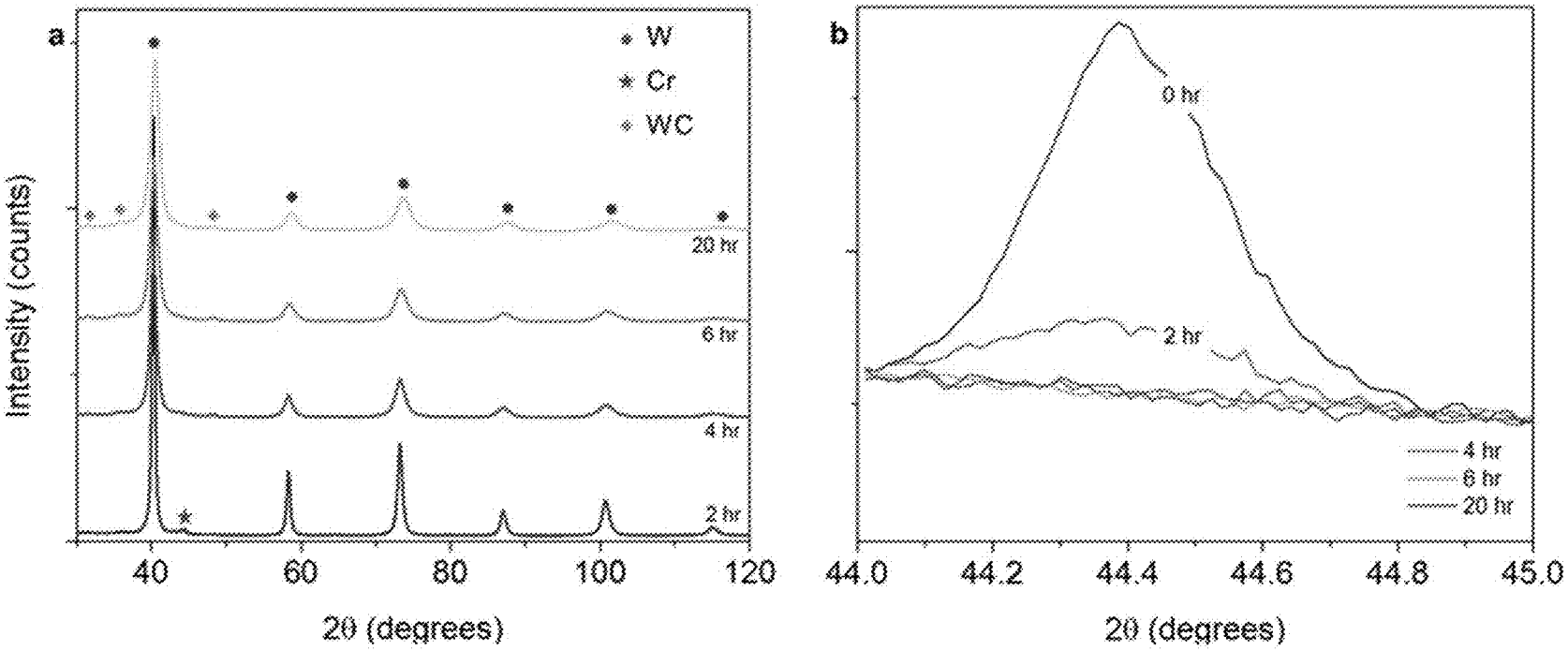
FIGS. 44(*a*) and 44(*b*) depict, respectively, X-ray diffraction patterns of W—Cr 15 at % in the 20 range between 30° and 130° in one embodiment, and in the 20 range between 44° and 45° in one embodiment.

In this example, W—Cr 15 at % was ball milled for 2 hours, 4 hours, 6 hours and 20 hours. As shown in FIGS. 44(*a*) and (*b*), the main diffraction peak of Cr at 44.4° disappears after about 4 hours of ball milling, indicating that the Cr is fully dissolved into the W. After about 4 hours of ball milling, WC from abrasion of the milling media starts to appear, and the amount of WC after 20 hours of ball milling is about 1 to 2 wt %, as measured by Rietveld refinement.

Comparative Example 1

Figure 40:
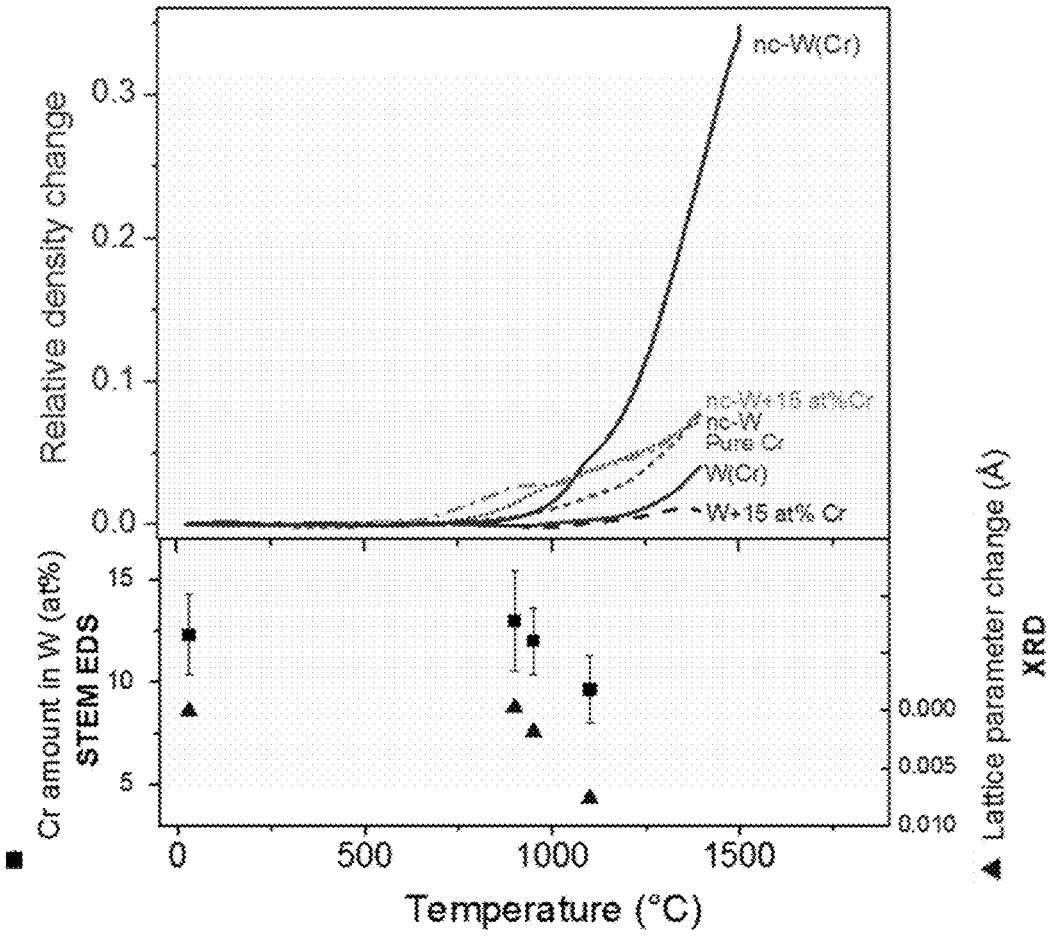
FIG. 40 depicts relative density, Cr amount in W, and BCC lattice parameter of a W-rich phase as a function of temperature in one embodiment, as well as relative density as a function of temperature for a series of control experiments.

A series of comparative examples were investigated to determine the independent effect of (i) nanocrystallinity and (ii) alloy supersaturation of the powder on sintering behavior. The relative density change of the comparative examples as a function of temperature is shown in FIG. 40. The samples depicted in FIG. 40 were quenched partway through the densification cycle. The data indicates that the sintering mechanism described herein desirable need that the powder to have nanocrystalline grains and the powder include a supersaturated solid solution. The specific compositions of the comparative examples and whether the comparative examples include (i) nanocrystallinity and (ii) a supersaturated solid solution are described below. The materials were heated at a rate of 10° C./min. A W—Cr 15 at % nanocrystalline supersaturated powder example under the same treatment conditions without the application of external pressure begins to noticeably densify at about 950° C., and is nearly fully dense by the time a temperature of 1500° C. is reached.

Pure nanocrystalline W (nc-W): pure tungsten was mechanically milled in the SPEX 8000 high-energy mill for 20 hours using tungsten carbide media and a ball-to-powder ratio of 5 to 1, with 1 wt % steric acid as a process control agent. The resulting sample had a grain size of 10 nm as revealed by Rietveld refinement but no Cr—this sample met condition (i) but not (ii). This powder was then compacted into 6 mm diameter and 3-4 mm high cylindrical disks of 0.62 relative density.

Nanocrystalline W with 15 at % Cr (not dissolved) (nc-W+15 at % Cr): powder of pure Cr was added to pure nanocrystalline W, produced by milling for 20 hours with a dry mixing method; 15 at % Cr was mixed with nanocrystalline W without milling or mechanical alloying, for approximately 15 minutes. The resulting sample comprised W with a grain size of 10 nm as revealed by Rietveld refinement, and contained chromium, but not in an alloyed or supersaturated condition; it met condition (i) but not (ii). This powder was then compacted into 6 mm diameter and 3-4 mm high cylindrical disks of 0.63 relative density.

W-15 at % Cr unalloyed and without nanostructure (W+15 at % Cr): 15 at % Cr was dry-mixed with W for approximately 15 minutes without mechanical alloying or milling. The resulting sample was a mixture of W-15 at % Cr, but had no nanoscale structure or supersaturation; it met neither condition (i) nor (ii). This powder was then compacted into 6 mm diameter and 3-4 mm high cylindrical disks of 0.67 relative density.

Supersaturated W-15 at % Cr (W(Cr)): W-15 at % Cr powders were mechanically milled in a SPEX 8000 high-energy mill for 30 minutes using tungsten carbide media without any process control agent. The resultant powder was then sealed in a quartz tube, first evacuated to $10^{-6}$ Torr using a turbo pump, and then backfilled with high-purity argon gas to 120 Torr. The sealed powder was annealed in a furnace that could be controlled to within ±3° C. at 1400° C. for 20 hours and then quenched. The resulting powder was a supersaturated W(Cr) solution, but with a coarse grain size in excess of one micron; it met condition (ii) but not (i). This tungsten solid solution powder was then compacted into 6 mm diameter and 2-3 mm high cylindrical disks of 0.65 relative density.

Pure Cr: Pure chromium powder was compacted into 6 mm diameter and 3-4 mm high cylindrical disks of 0.67 relative density.

Comparative Example 2

Figure 42:
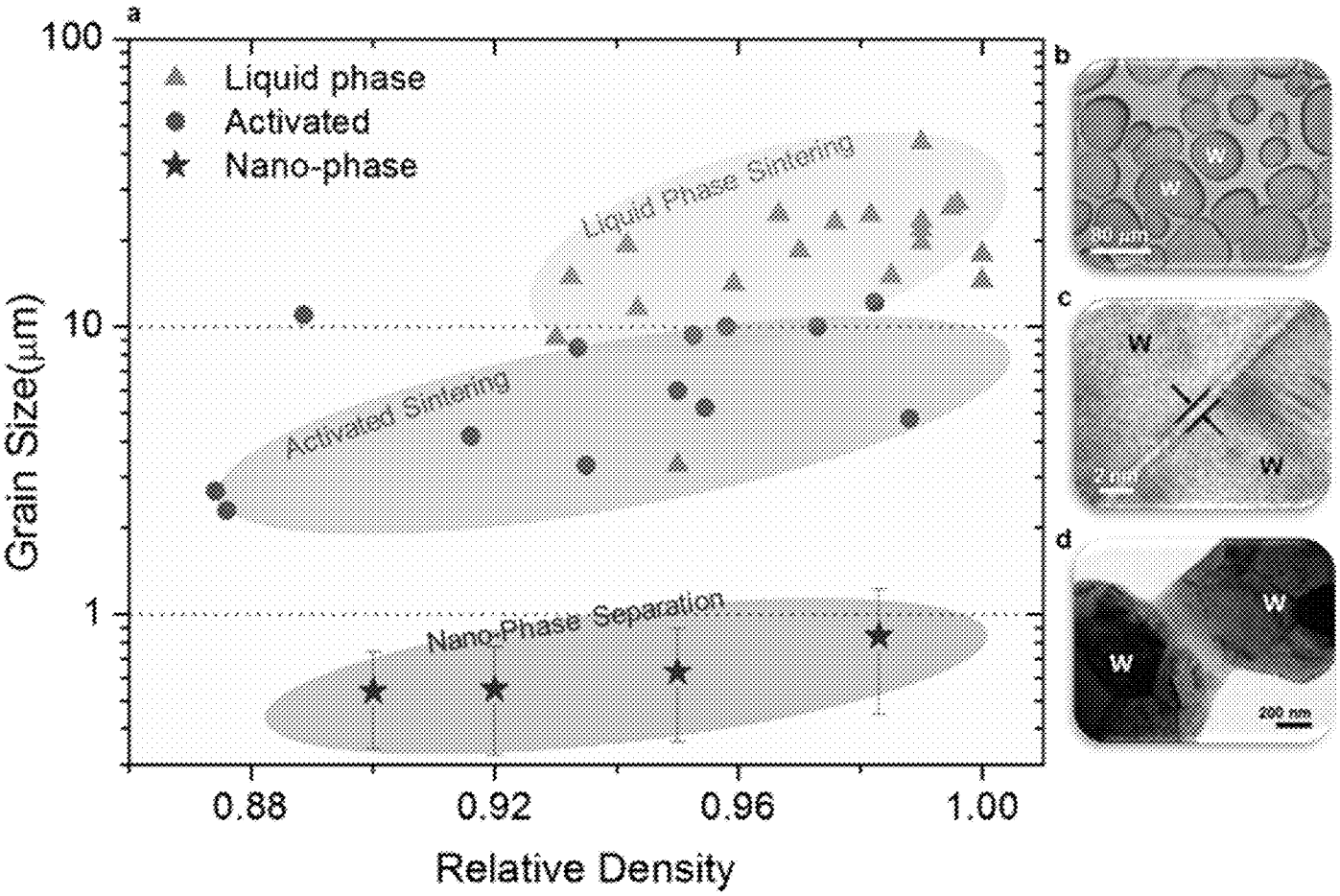
FIGS. 42(*a*)-42(*d*) depict, respectively, grain size as a function of relative density for nano-phase sintering, activated sintering and liquid phase sintering in one embodiment, liquid phase sintering microstructure, activated sintering microstructure, and nano-phase sintering microstructure in one embodiment.

Table 1 describes a number of comparative examples of W-alloys that were subjected to liquid phase and activated sintering processes. FIGS. 42(*a*) and 47 show the grain size of the resulting materials as a function of relative density. The data indicates that nano-phase separation sintering produces materials with smaller grain sizes at comparable densities as other methods. FIG. 42(*b*) depicts the microstructure of a W-alloy produced by a liquid-phase sintering mechanism in which W-particles are embedded in a liquid matrix that acts as a rapid transport path for sintering. FIG. 42(*c*) depicts the microstructure of a W-alloy produced by an activated sintering mechanism in which a film is formed on a grain boundary that acts as an active transport path for sintering. FIG. 42(*d*) depicts the microstructure of a W-alloy produced by a nano-phase separation sintering mechanism in which the separation of the supersaturated solution decorates the interparticle necks with a second solid phase that acts as a rapid diffusion pathway for sintering.

TABLE 2

| Number | Materials | Grain size (μm) | Density |
|---|---|---|---|
| 1 | W—1Ni | 11 | 0.889 |
| 2 | W—6Fe | 2.68 | 0.874 |
| 3 | W—8.4Ni—3.6Fe | 2.3 | 0.876 |
| 4 | W—2Fe | 4.17 | 0.916 |
| 5 | W—8.4Ni—3.6Fe | 3.3 | 0.935 |
| 6 | W—2Ni—2Fe | 8.48 | 0.934 |
| 7 | W—8Cu—3Ni | 9.21 | 0.930 |
| 8 | W—4Cu—7Ni | 14.87 | 0.933 |
| 9 | W—4Cu—7Ni | 19.25 | 0.942 |
| 10 | W—8Cu—3Ni | 11.59 | 0.943 |
| 11 | W—1Ni—1Fe | 9.35 | 0.953 |
| 12 | W—0.29Co | 6 | 0.95 |
| 13 | W—1Fe | 5.24 | 0.955 |
| 14 | W—9Cu—1Ni | 3.3 | 0.95 |

TABLE 2-continued

| Number | Materials | Grain size (μm) | Density |
|---|---|---|---|
| 15 | W—6Ni | 10.03 | 0.958 |
| 16 | W—8Cu—3Ni | 14.17 | 0.959 |
| 17 | W—4Cu—7Ni | 24.7 | 0.967 |
| 18 | W—8Cu—3Ni | 18.35 | 0.97 |
| 19 | W—2Ni | 10.03 | 0.973 |
| 20 | W—4Cu—7Ni | 23.1 | 0.976 |
| 21 | W—8Cu—3Ni | 24.47 | 0.982 |
| 22 | W—1Ni—1Fe | 15 | 0.985 |
| 23 | W—1Ni | 12.16 | 0.982 |
| 24 | W—8.4Ni—3.6Fe | 4.8 | 0.988 |
| 25 | W—1Ni—1Fe | 44 | 0.99 |
| 26 | W—11.9Ni—5.1Fe | 19.6 | 0.99 |
| 27 | W—8.4Ni—3.6Fe | 21.8 | 0.99 |
| 28 | W—4.9Ni—2.1Fe | 23.5 | 0.99 |
| 29 | W—3.99Ni—1.71Fe | 26 | 0.995 |
| 30 | W—7Ni—3Fe | 27 | 0.996 |
| 31 | W—4Mo—7Ni—3Fe | 17.9 | 1.00 |
| 32 | W—8Mo—7Ni—3Fe | 14.5 | 1.00 |

Additional Notes

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." Any ranges cited herein are inclusive.

The terms "substantially" and "about" used throughout this Specification are used to describe and account for small fluctuations. For example, they may refer to less than or equal to ±5%, such as less than or equal to ±2%, such as less than or equal to ±1%, such as less than or equal to +0.5%, such as less than or equal to ±0.2%, such as less than or equal to ±0.1%, such as less than or equal to ±0.05%.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" may refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein "at %" refers to atomic percent and "wt %" refers to weight percent. However, in certain embodiments when "at %" is utilized the values described may also describe "wt %." For example, if "20 at %" is described in one embodiment, in other embodiments the same description may refer to "20 wt %." As a result, all "at %" values should be understood to also refer to "wt %" in some instances, and all "wt %" values should be understood to refer to "at %" in some instances.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

What is claimed:

1. A sintered nanocrystalline alloy comprising W and Cr, wherein the W is present in an amount of at least about 60 at %, the Cr is present in an amount greater than or equal to 0.3 at %, the nanocrystalline alloy has a relative density of at least about 90%, and the nanocrystalline alloy comprises grains having a largest dimension smaller than about 1000 nm.

2. The alloy of claim 1, wherein the nanocrystalline alloy comprises the W and the Cr in a solid solution.

3. The alloy of claim 2, wherein the nanocrystalline alloy further comprises Ti.

4. The alloy of claim 1, wherein the nanocrystalline alloy is substantially thermodynamically stable at a temperature that is greater than or equal to about 1,000° C.

5. The alloy of claim 1, wherein the nanocrystalline alloy has a relative density of at least about 98%.

6. The alloy of claim 1, wherein the nanocrystalline alloy further comprises at least one of Pd, Pt, Ni, Co, Fe, Ti, V, and Sc.

7. The alloy of claim 1, wherein the nanocrystalline alloy has an average grain size of less than about 100 nm.

8. The alloy of claim 1, wherein the Cr is present in an amount greater than or equal to 1 at %.

9. The alloy of claim 1, wherein the Cr is present in an amount greater than or equal to 5 at %.

10. The alloy of claim 2, wherein the Cr is present in an amount greater than or equal to 10 at %.

11. The alloy of claim 1, wherein the Cr is present in an amount greater than or equal to 15 at %.

12. The alloy of claim 1, wherein the Cr is present in an amount of 0.3 at % to 40 at %.

13. The alloy of claim 1, wherein the Cr is present in an amount of 1 at % to 30 at %.

14. The alloy of claim 1, wherein the W is present in an amount of at least about 70 at %.

15. The alloy of claim 1, wherein the W is present in an amount of at least about 60 at % and less than or equal to about 95 at %.

16. The alloy of claim 1, wherein the W is present in an amount of at least about 70 at % and less than or equal to about 95 at %.

17. A bulk nanocrystalline alloy, comprising:

a first metal material that includes W; and a second metal material that includes Cr, wherein the bulk nanocrystalline alloy has an average grain size of less than about 100 nm, the W is present in an amount of at least about 60 at %, and the Cr is present in an amount greater than or equal to 0.3 at %.

18. The bulk nanocrystalline alloy of claim 17, wherein the bulk nanocrystalline alloy has a relative density of at least about 90%.

19. The bulk nanocrystalline alloy of claim 18, wherein the bulk nanocrystalline alloy has a relative density of at least about 95%.

20. The bulk nanocrystalline alloy of claim 19, wherein the bulk nanocrystalline alloy has a relative density of at least about 98%.

21. The bulk nanocrystalline alloy of claim 17, wherein the bulk nanocrystalline alloy is substantially thermodynamically stable at a temperature of about 1,000° C.

22. The bulk nanocrystalline alloy of claim 17, wherein the W and the Cr are in a solid solution.

23. The bulk nanocrystalline alloy of claim 17, wherein the Cr is present in an amount greater than or equal to 1 at %.

24. The bulk nanocrystalline alloy of claim 17, wherein the Cr is present in an amount greater than or equal to 5 at %.

25. The bulk nanocrystalline alloy of claim 17, wherein the Cr is present in an amount greater than or equal to 10 at %.

26. The bulk nanocrystalline alloy of claim 17, wherein the Cr is present in an amount greater than or equal to 15 at %.

27. The bulk nanocrystalline alloy of claim 17, wherein the Cr is present in an amount of 0.3 at % to 40 at %.

28. The bulk nanocrystalline alloy of claim 17, wherein the Cr is present in an amount of 1 at % to 30 at %.

29. The bulk nanocrystalline alloy of claim 17, wherein the W is present in an amount of at least about 70 at %.

30. The bulk nanocrystalline alloy of claim 17, wherein the W is present in an amount of at least about 60 at % and less than or equal to about 95 at %.

31. The bulk nanocrystalline alloy of claim 17, wherein the W is present in an amount of at least about 70 at % and less than or equal to about 95 at %.

* * * * *